United States Patent [19]

Yoshida et al.

[11] Patent Number: 4,870,447

[45] Date of Patent: Sep. 26, 1989

[54] COPYING APPARATUS

[75] Inventors: Nobutoshi Yoshida; Nobuyuki Miyake, both of Yokohama; Atsushi Takagi, Tokyo; Takashi Saito, Ichikawa; Tadashi Suzuki, Yokohama; Naoyuki Ohki, Tokyo; Masahiro Tomosada, Kawasaki; Hideki Adachi, Kawasaki; Hiroaki Takeda, Kawasaki, all of Japan

[73] Assignee: Canon Kabushiki Kaisha, Tokyo, Japan

[21] Appl. No.: 293,135

[22] Filed: Jan. 3, 1989

Related U.S. Application Data

[60] Division of Ser. No. 169,132, Mar. 10, 1988, which is a continuation of Ser. No. 830,745, Feb. 19, 1986, abandoned.

[30] Foreign Application Priority Data

| | | | |
|---|---|---|---|
| Feb. 21, 1985 | [JP] | Japan | 60-033278 |
| Mar. 8, 1985 | [JP] | Japan | 60-047241 |
| Mar. 8, 1985 | [JP] | Japan | 60-047242 |
| Mar. 8, 1985 | [JP] | Japan | 60-047244 |
| Mar. 28, 1985 | [JP] | Japan | 60-064248 |
| Mar. 28, 1985 | [JP] | Japan | 60-064249 |
| Mar. 28, 1985 | [JP] | Japan | 60-064250 |
| Jun. 5, 1985 | [JP] | Japan | 60-120380 |

[51] Int. Cl.[4] ..... G03G 15/00

[52] U.S. Cl. ..... 355/204; 355/233

[58] Field of Search ..... 355/7, 14 R, 3 R, 4, 355/14 C, 77

[56] References Cited

U.S. PATENT DOCUMENTS

| | | | |
|---|---|---|---|
| 4,322,157 | 3/1982 | Miura et al. | 355/7 X |
| 4,538,182 | 8/1985 | Saito et al. | 358/280 |
| 4,591,261 | 5/1986 | Saruwatari et al. | 355/14 D |
| 4,593,991 | 6/1986 | Aoki et al. | 355/14 D |
| 4,615,612 | 10/1986 | Ohno et al. | 355/14 D |
| 4,745,443 | 5/1988 | Adachi et al. | 355/40 |

FOREIGN PATENT DOCUMENTS

| | | |
|---|---|---|
| 179373 | 4/1986 | European Pat. Off. . |
| 2160737 | 12/1985 | United Kingdom . |

*Primary Examiner*—R. L. Moses

*Attorney, Agent, or Firm*—Fitzpatrick, Cella, Harper & Scinto

[57] ABSTRACT

There is a multi-color copying apparatus having image processing functions which can easily designate arbitrary areas when the trimming or masking is executed. This apparatus comprises: an area designating device to designate the first area of the original; a first developing device to develop the image of the first area in the first color; a second developing device to develop the image of the second area in the second color; and a control circuit for making the first developing device operative without making the second developing device operative in accordance with the designation of the first area and, after completion of the development of the image of the first area, making the second developing device operative without making the first developing device operative. The control circuit inhibits the operation of the first or second developing device by moving the first or second developing device to a position away from the photo sensitive drum, or by applying the bias voltage to the first or second developing device such that the toner from the inoperative developing device is not deposited onto the drum.

15 Claims, 42 Drawing Sheets

COPYING APPARATUS

This application is a division of application Ser. No. 169,132 filed Mar. 10, 1988, now allowed, which was a continuation of application Ser. No. 830,745 filed Feb. 19, 1986, now abandoned.

BACKGROUND OF THE INVENTION

1. Field of the Invention

The present invention relates to a copying apparatus having an image processing function.

2. Description of Prior Art

In recent years, various functions are required in copying apparatuses and the copying apparatuses having the functions of trimming, masking, color copy, etc. have been proposed. However, these apparatuses have inconvenience such that the operation and constitution are complicated and the like. In addition, when performing the copying operation using a plurality of functions as well, the operation becomes very complicated.

SUMMARY OF THE INVENTION

It is an object of the present invention to eliminate the above-mentioned drawbacks.

Another object of the invention is to improve a copying apparatus.

Still another object of the invention is to provide a copying apparatus which can easily designate an area when executing the trimming or masking.

Still another object of the invention is to provide a copying apparatus which can easily confirm an area when performing the trimming or masking.

Still another object of the invention is to provide a copying apparatus which an easily set a magnification when executing the variable magnification copy a plurality of times.

Still another object of the invention is to provide a copying apparatus which can easily obtain a multi-color copy from the same original using the area designating function and a plurality of developing devices.

Still another object of the invention is to provide a copying apparatus which can easily change an area when executing the masking or trimming.

Still another object of the invention is to provide a double-color copying apparatus which can separately copy in at least two different colors merely by designating specific areas of a single original.

Still another object of the invention is to provide a copying apparatus which can copy in different colors in a plurality of designated areas of a single original, respectively.

Still another object of the invention is to provide a copying apparatus which accurately detects a concentration of an image of original and can obtain the proper copied image according to the concentration of the original.

Still another object of the invention is to provide a copying apparatus which can commonly use the original size detecting function as the function to set a size of sheet.

Still another object of the invention is to provide a copying apparatus which can accurately detect the data regarding an original.

The above and other objects and features of the present invention will become apparent from the following detailed description and the appended claims with reference to the accompanying drawings.

BRIEF DESCRIPTION OF THE DRAWINGS

FIG. 9-1 is a perspective view showing an embodiment of a copying apparatus to which the invention is applied;

FIG. 9-2 is a top view of an original mounting plate;

FIG. 15-1 is a diagram of color detection circuits of developing devices;

FIG. 15-2 is a diagram showing an arrangement of a memory representing the registration of areas;

FIG. 15-3 is a diagram showing the content of the memory upon correction of areas;

FIGS. 15-4 to 15-7 are flowcharts showing the processes when the key regarding the registration or correction of areas is inputted, respectively;

FIGS. 16-1 to 16-3 are flowcharts showing an embodiment of the invention, respectively;

FIG. 16-4 is a diagram showing an example when an area is designated and the variable magnification copy is executed in this area;

DETAILED DESCRIPTION OF PREFERRED EMBODIMENTS

An embodiment of the present invention will now be described hereinbelow with reference to the drawings.

Figure 1:
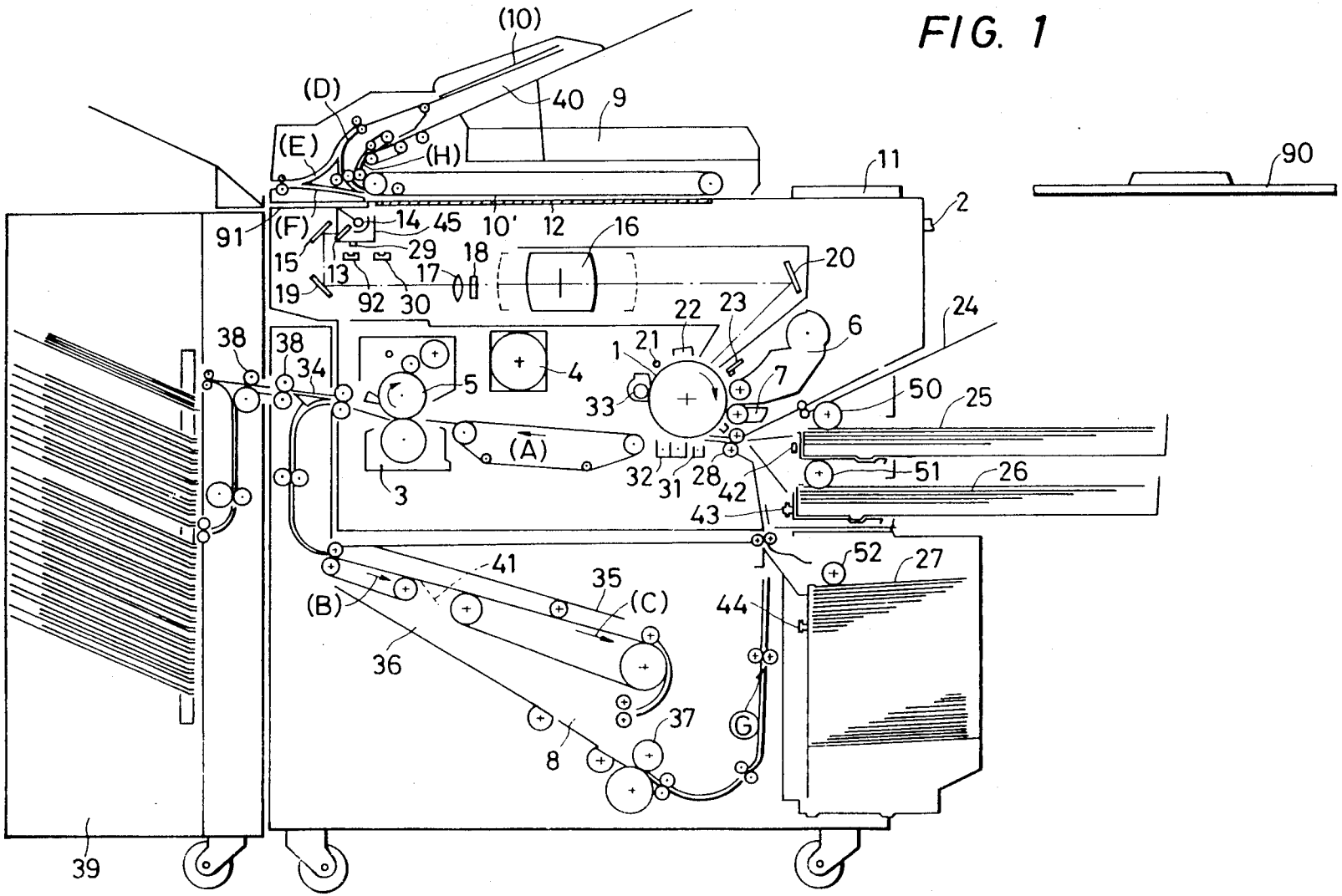
FIG. 1 is a cross sectional view showing a constitution of an embodiment of a copying apparatus to which the invention is applied.

FIG. 1 is a cross sectional view showing a constitution of an embodiment in the case where an RDF (automatic original feeding apparatus) 9 and a sorter 39 are attached to a two-sided copying apparatus to which the present invention is applied. There is also another copying apparatus in which a pressing plate 90 is set in place of the RDF 9. In the diagram, the surface of a drum 1 consists of a seamless photo sensitive material using amorphous silicon and the drum 1 is axially rotatably supported. When a power source is supplied by turning on a power switch 2, a fixing device 3 is heated. When the fixing device 3 reaches a predetermined temperature, the drum 1, conveying sections A, B, and C, and a fixing roller 5 start rotating in the directions indicated by arrows by a main motor 4. When the fixing device 3 becomes a predetermined temperature at which the fixing can be performed, a voltage control process (initial process), which will be explained later, and a discrimination to see if the toners exist in developing devices 6 and 7 or not are executed. Thereafter, the main motor 4 is stopped and the apparatus becomes the standby mode and waits until a copy start signal is inputted.

The copy mode which can be executed by the copying apparatus of the invention will be first simply described and the copy procedure will then be sequentially described. The copy mode includes the one-sided copy mode in which after an image was formed on one side of a transfer paper, the paper is ejected out, the two-sided copy mode in which after images were formed on both sides of a transfer paper, the paper is ejected out, and the multi-copy mode in which after a plurality of images were synthesized on one side of a transfer paper, the paper is ejected out. The copy is carried out using a middle tray 8 in the two-sided and one-sided copy modes. On one hand, by providing a plurality of developing devices 6 and 7, the copy can be executed in a plurality of colors on transfer paper. In addition, the AMS (automatic variable magnification selection) and APS (automatic paper selection) functions are provided by detecting a size of original. The apparatus is also provided with the zoom function and the like.

(Two-sided copy mode)

The procedure to obtain the two-sided copy from a two-sided original will be first described. After an original 10 was set to the RDF 9, a key to perform the two-sided copy from the two-sided original is inputted by an operating section 11, which will be explained later. Then, a copy quantity is set and the black developing device 6 is designated and therefter, a copy start key is inputted. The original 10 set to the RDF 9 is conveyed onto an original glass 12. In the main body of the copying apparatus, an illumination lamp 14 which is constituted integrally with a first scan mirror 13 is set at a reference position 92, and a voltage control (which will be explained later) and a control of an incident light into a CCD for detection of the original (the detail will be explained later) are executed.

The original 10 is illuminated by the illumination lamp 14 and the reflected light is scanned by the first scan mirror 13 and second scan mirror 15. The first and second scan mirrors 13 and 15 move at the velocity ratio of 1:½, thereby scanning the original while always keeping constant the distances of optical paths in front of a projection lens 16 and an original detecting lens 17. Thus, the reflected light image is formed onto a detecting element (CCD image sensor) 18 through the lens 17 and is also formed on the drum 1 through the projection lens 16, a third mirror 19, and a fourth mirror 20.

On the other hand, after the drum 1 was discharged by a pre-exposure lamp 21, it is corona charged (for example, to the positive charges) by a primary charging device 22. Thereafer, the image illuminated by the illumination lamp 14 is exposed through a slit to form a electrostatic latent image. During the scan to detect the size of original, the latent image is erased by an erasure lamp 23 and at the same time, a proper bias is given to remove the AC component of the bias of developing device and thereby to prevent deposition of the toner due to the DC component. The reflected light on a front original glass 91 is inputted as original information to the CCD 18 for detection of the size of original. However, an intensity of reflected light of the portion where no original exists is set to be very low. The process using the CCD will be explained later. The scan to copy is executed after completion of the CCD process and the electrostatic latent image is formed in a manner similar to the above. Then, the latent image is developed as a visible image by the developing device 6 or 7 designated. A transfer paper is fed by a paper feed roller 50, 51, or 52 from a paper delivery port of selected one of hand inserting means 24, an upper cassette 25, a lower cassette 26, and a deck 27 and conveyed to the position in front of a registration roller 28. After a member 29 attached to the unit of the illumination lamp 14 constituted integrally with the first scan mirror 13 (hereinafter, referred to as the movement optical system) was detected by a sensor 30 to detect the head position (image tip) of the original, the registration roller 28 is driven after an expiration of a predetermined time T and the transfer paper is sent toward the photo sensitive drum 1 at an accurate timing such that the latent image tip coincides with the head of the transfer paper. Thereafter, the transfer paper passes through the gap between the drum 1 and a transfer charging device 31, so that the toner image on the drum 1 is transferred onto the transfer paper. After completion of the transfer, the paper is separated from the drum 1 by a separation charging device 32. Then, the surface of the drum 1 is cleaned by a cleaning apparatus 33 and at the same time, a variation in voltage is also uniformed by the pre-exposure lamp 21, thereby enabling those components to be repeatedly used.

In addition, after the transfer paper separated from the drum 1 was led to the fixing device 3 by the conveying unit (A) and fixed, the paper path is switched such that the paper is conveyed to a two-sided unit 35 by a flapper 34. The transfer paper then passes through the conveying sections (B) and (C) and is switched back and collected onto the middle tray 8. After completion of the exposing operations commensurate with the set copy quantity, an original 10′ on the original plate 12 is switched back by way of paths (D), (E), and (F) of the RDF 9 and again set on the original plate 12 such as to copy the back side of the original 10'. After the original 10' was set, the transfer paper fed from the middle tray 8 by a paper feed roller 37 passes through a conveying path (G) and is conveyed to the postion in front of the registration roller 28. After the member 29 attached to the movement optical system unit was detected by the sensor 30, the registration roller 28 is driven after an elapse of a predetermined time $T_1$. The paper is sent toward the drum 1 at the accurate timing such that the latent image tip coincides with the head of the transfer paper. Afer that, the transfer paper passes through the gap between the drum 1 and the tansfer charging device 31, so that the toner image on the drum 1 is transferred onto the paper. After the end of transfer, the paper is separated from the drum 1 by the separation charging device 32. The surface of the drum 1 is cleaned by cleaning apparatus 33 and a variation in potential is also uniformed by the pre-exposure lamp 21, thereby enabling those components to be repeatedly used.

The transfer paper separated from the drum 1 is led to the fixing device 3 by the conveying unit (A) and fixed. Subsequently, it is ejected out to the sorter 39 through a paper delivery roller 38 by the flapper 34. The copy operation is completed by repeating the above-mentioned operations a number of times as many as the set copy quantity. The original 10' on the original glass 12 is ejected out onto an original tray 40 through the paper path (D).

It is also possible to perform the two-sided copy from a one-sided original. In this case, the original 10 set to the RDF 9 passes through a paper path (H) and is set on the original glass 12 and the exposing operation is repeatedly executed a number of times as many as the set copy quantity. The transfer paper is collected onto the middle tray 8 as mentioned above. After completion of the exposing operations as many as the set copy quantity, the original 10' is ejected out onto the original tray 40 through the paper path (D). The next original feeding operation is executed in parallel with the original ejecting operation and the original is set onto the glass 12. This original is exposed to copy the other side of the transfer paper in which one side was copied and which was collected onto the middle tray 8. Then, the copied paper is ejected out to the sorter 39. After the end of exposing operations as many as the set copy quantity, the original is delivered onto the original tray 40 through the paper path (D). This operation is repeated until the original is once circulated.

(Multi-copy mode)

The fundamental process in the multi-copy mode and the movement of transfer material will then be explained. After the original was set to the RDF 9, the multi-copy mode is designated by a key in the operating section 11, which will be explained later, and the copy quantity is set. The developing device which is used is selceted from among a plurality of developing devices and designated. Then, the copy start key is inputted. Thus, the original 10 set to the RDF 9 is conveyed to the exposing position on the original glass 12. The toner image is formed on the photo sensitive drum 1 and transferred onto the transfer paper in a manner similar to the case in the two-sided copy mode. The transfer paper separated from the drum 1 is led to the fixing device 3 by the conveying unit (A) and fixed. Subsequently, the paper path is switched such that the transfer paper is conveyed to a multi (two-sided) copy unit by the flapper 34. Due to this, the transfer paper passes through the conveying section (B) and is collected onto the middle tray 8 by a switching device 41. The copy operation is completed by repeating the above operation a nubmer of times as many as the set copy quantity. After the original 10' on the original plate 12 was ejected onto the original tray through the path (H) of the RDF, the next original is taken out from the RDF 9 and set on the plate 12 as mentioned above. Thereafter, the transfer paper fed by the paper feed roller 37 from the middle tray 8 is conveyed to the position in front of the registration roller 28 by way of the conveying path (G), thereby to execute the copy on the same side of the transfer paper. The copy operation is carried out in a manner similar to the copy of the back surface in the two-sided copy mode. The transfer paper separated from the drum 1 is led to the fixing device 3 by the conveying unit A and fixed. Thereafter, the paper passes through the paper delivery roller 38 by the flapper 34 and is ejected out to the sorter. The copy operation is completed by repeating the above operation a number of times as many as the set copy quantity.

In addition, the original on the glass 12 is delivered onto the original tray 40 through the paper path (H).

The continuous copy mode will then be described. After the original was set to the RDF 9, the key to execute the continuous copy is inputted by the operating section 11, which will be explained later, and then the copy quantity is set. The embodiment includes the mode to designate the developing device which is used among the developing devices and the mode in which the color of the first side and the color of the second color for the continuous copy are automatically preliminarily determined. An explanation will be made hereinafter with respect to the operation in the following case where: the size of original is A3; the direct copy is executed (i.e., the magnification is equal); the APS (automatic paper selection) mode is selected; and the developing devices of the first and second sides are preliminarily determined (for example, the black developing device is for the first side and the red developing device is for the second side). The copy size of the first side is set to A4 size (½ of the original size of A3). As described above, the original which is fed to the exposing position by the RDF 9 is scanned by the first scan mirror and illumination lamp 14 and the electrostatic latent image is obtained in a manner as mentioned above. Thereafter, the latent image is developed as a visible image by the predetermined black developing device. The paper feed port of the upper or lower cassette or deck where the transfer papers of the A4 size are set is selected by paper size sensors 42, 43, and 44 attached to those cassettes or deck. For example, in the case where the transfer papers of the A3 size, A4 size, and B4 size are respectively set into the upper cassette 25, lower cassette 26, and deck 27, the papers are fed by the paper feed roller from the paper feed port of the lower cassette 26 in which the transfer papers of the A4 size are set. The papers are then conveyed to the position in front of the registration roller 28. After the member attached to the movement optical system unit was detected by the image tip sensor 30, the registration roller 28 is driven after an expiration of a predetermined time $T_1$. The paper is sent toward the photo sensitive drum 1 at an accurate timing such that the latent image tip coincides with the head of the transfer paper. Thereafter, as mentioned above, the paper is subjected to the transfer process and fixing process through the conveying system and ejected out, so that the copy operation is completed. The operation advances to the copy of the second side. The apparatus is constituted in a manner such that the movement optical system is automatically returned to the optical system reference position 15 (home position) after completion of the exposure scan of the first side. The copy of the second side starts from the reference position 15 and after the member 29 attached to the movement optical system unit 45 was detected by the image tip detection sensor 30, the erasure lamp is lit up for a predetermined time $T_2$ (corresponding to the width of paper of the A4 size). The latent image of the first side and the potentials of the unnecessary areas are erased and the latent image of the second side is obtained. The latent image of the second side is developed to a visible image by the predetermined red developing device (color developing device). The transfer paper is fed by the paper feed roller from the paper feed port of the lower cassette 26 in which the transfer papers of the A4 size are set. This paper is conveyed to the position in front of the registration roller 28. Next, the roller 28 is driven after an expiration of a predetermined time $T_3$ and the paper is sent toward the drum 1 at the accurate timing such that the latent image tip coincides with the head of the transfer paper. Thereafter, the paper is subjected to the transfer process and fixing process through the conveying system as mentioned above, so that the copy operation is completed. In addition, as described above, the following combinations can be designated by the operating section, which will be explained later; namely, the combination of the two-sided copy mode and a plurality of developing devices; the combination of the two-sided copy mode and the continuous copy mode and the combination of the multi-copy mode and a plurality of developing devices; the combination of the multi-copy mode and the continuous copy mode; and the like. There is another function to vary the processing speed (peripheral speed of the drum 1). In other words, the processing speed is changed when an amount of illumination light to the photo sensitive drum 1 lacks. In the case where the writing function is selected by the operating section 11, the processing speed is automatically set to a low speed.

The apparatus also has the following function. A number of light emitting elements are finely arranged to constitute the erasure lamp and this lamp is provided and lit up before development after completion of the exposure of the image so that arbitrary portions of the latent image on the drum 1 can be erased. An arbitrary latent image can be erased by lighting up arbitrary light emitting elements of the light emitting section. The images can be synthesized by combining the multi-copy mode and the colors of a plurality of developing devices.

Figure 2:
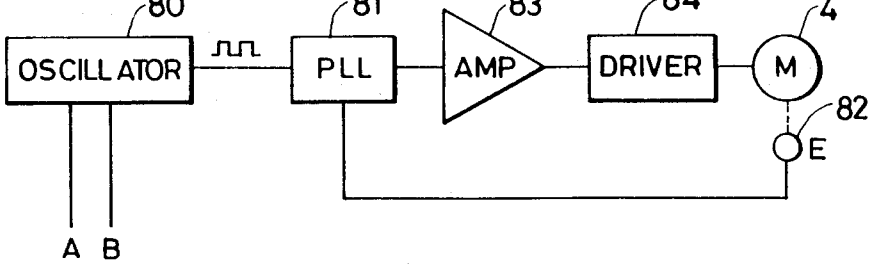
FIG. 2 is a block diagram of a circuit to determine a processing speed.

On the other hand, to vary the processing speed as mentioned above, in the embodiment, a DC motor 4 is used as a drive source and the speed is variably controlled in a PLL control manner as shown in FIG. 2. Practically speaking, a signal from an oscillator 80 is used as a reference signal. A speed signal from an encoder 82 connected to the DC motor 4 is fed back to a PLL control circuit 81. an output of the PLL control circuit 81 is amplified by an amplifier 83 and outputted to a driver 84. The DC motor 4 is driven by the driver 84 such that the reference signal from the oscillator 80 is synchronized with the signal fed back to the PLL control circuit 81. An oscillating frequency of the output of the oscillator 80 is changed in response to input signals A and B, thereby varying the speed. The signals A and B are connected to a speed command circuit (not shown).

Figure 3:
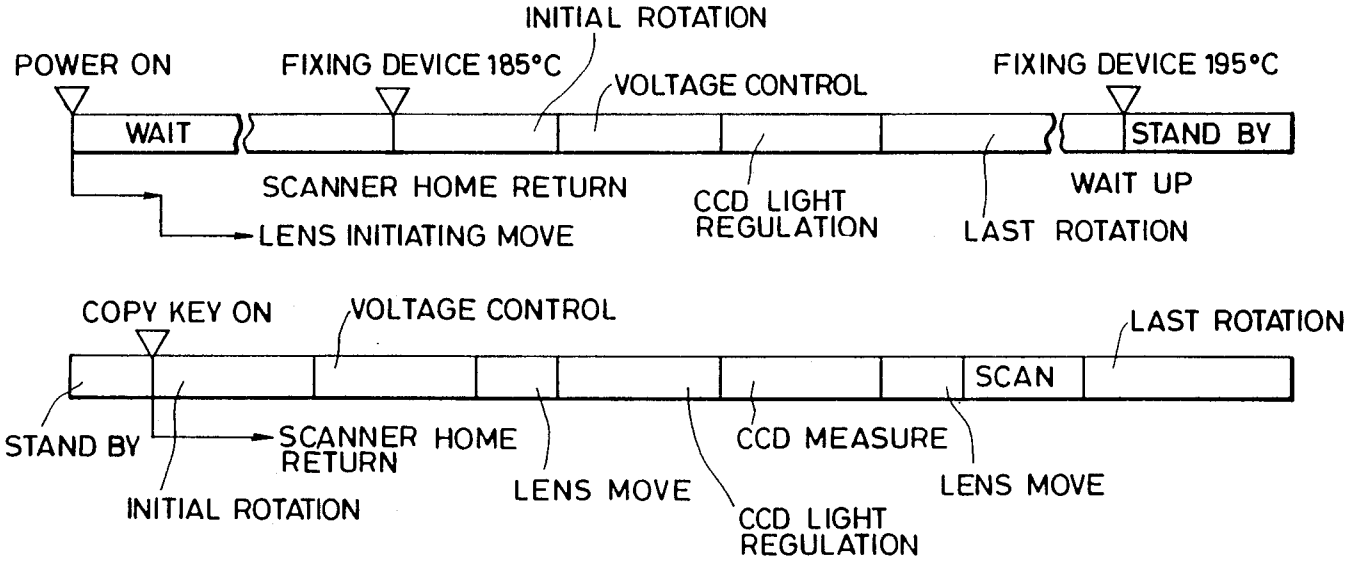
FIG. 3 is a timing chart for the whole apparatus.

FIG. 3 shows a timing chart for the whole apparatus. FIGS. 4 to 8 show timing charts for the initial rotation, voltage control, CCD light regulation and CCD measurement, scan, and last rotation, respectively. In FIG. 3, when a power switch is turned on, a fixing heater is turned on and a scanner is returned to the home position and the lens is initialized and moved. When the fixing temperature becomes 185° C., the initial rotation, voltage control, CCD light regulation, and last rotation are executed. When the fixing temperature becomes 195° C., the apparatus enters the standby mode and waits until the copy start key is inputted. When the copy start key is turned on, the voltage control is performed due to the initial rotation. Upon full scan, the lens is moved to the position where the second mirror doesn't collide with the lens in order to perform the CCD measurement scan. Next, the CCD light regulation and CCD measurement are executed and a size and a concentration of original are detected. Thereafter, the lens is moved in accordance with the magnification which is derived due to the calculation of the AMS or the magnification which is designated. After the scanning operation was repeated a number of times as many as the set copy quantity and the last scan was reversed, the last rotation is performed.

Figure 4:
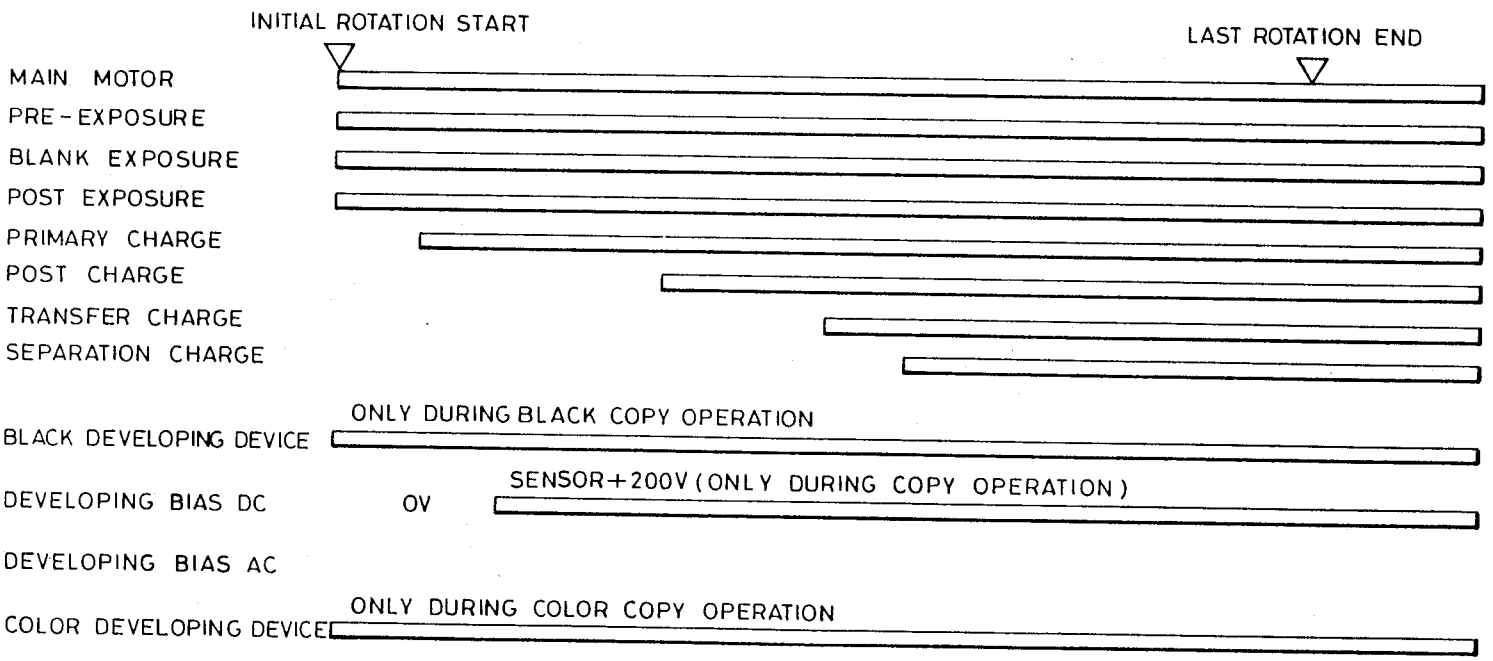
FIG. 4 is a timing chart for the initial rotation.

FIG. 4 is a timing chart for the initial rotation. The pre-exposure, blank exposure, and post exposure are started synchronously with the main motor. Subsequently, the primary charge, post charge, transfer charge, and separation charge are sequentially started. The initial rotation ends when the drum has been once rotated after the start of the pre-exposure. In the copy operation, the designated developing device is driven synchronously with the main motor. When the developing device passes the position of the voltage sensor from the pre-exposure, the developing bias is controlled to the output voltage of +200 V of the sensor. The other developing device is in the floating state.

Figure 5:
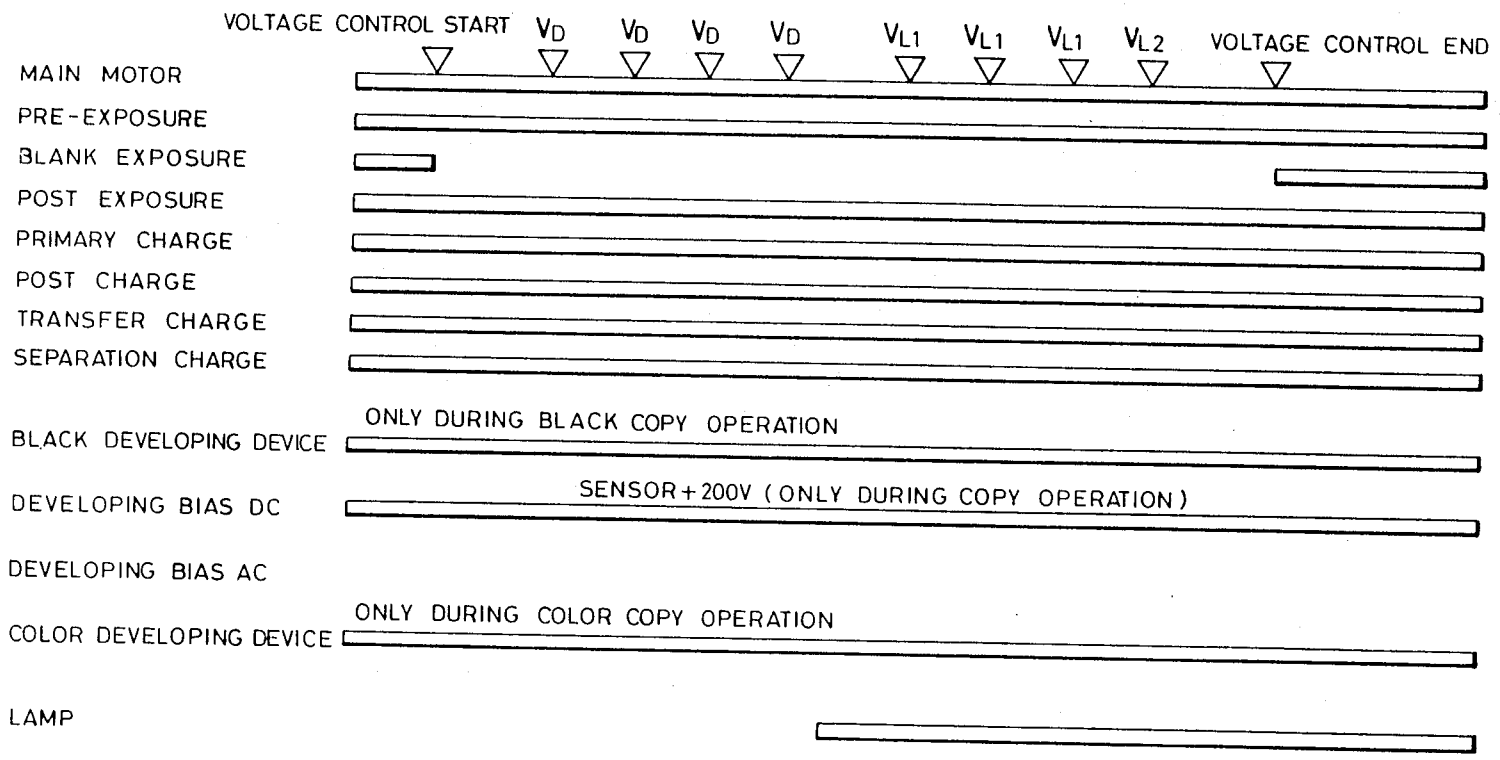
FIG. 5 is a timing chart for the voltage control.

FIG. 5 is a timing chart for the voltage control. When the voltage control starts, the blank exposure is turned off to form the dark section voltage on the drum. This voltage is measured by the voltage sensor and the current of the primary charge is controlled so as to approach the object voltage of 450 V. This voltage control is referred to as $V_D$ control. The $V_D$ control is executed four times. Next, an amount of light of the illumination lamp is controlled due to the primary current which is derived by the $V_D$ control. The lamp is lit up to form the bright section voltage on the drum. This voltage is measured by the voltage sensor. The amount of light of the illumination lamp is controlled so as to approach the object voltage of 50 V. This voltage control is referred to as $V_{L1}$ control and executed three times. The bright section voltage is measured again by the light amount which is derived due to the $V_{L1}$ control and the measured voltage is referred to as $V_{L2}$. The voltage $V_{L2}$ is used to determine the developing bias DC. After completion of the measurement of $V_{L2}$, the post voltage control is finished.

Figure 6:
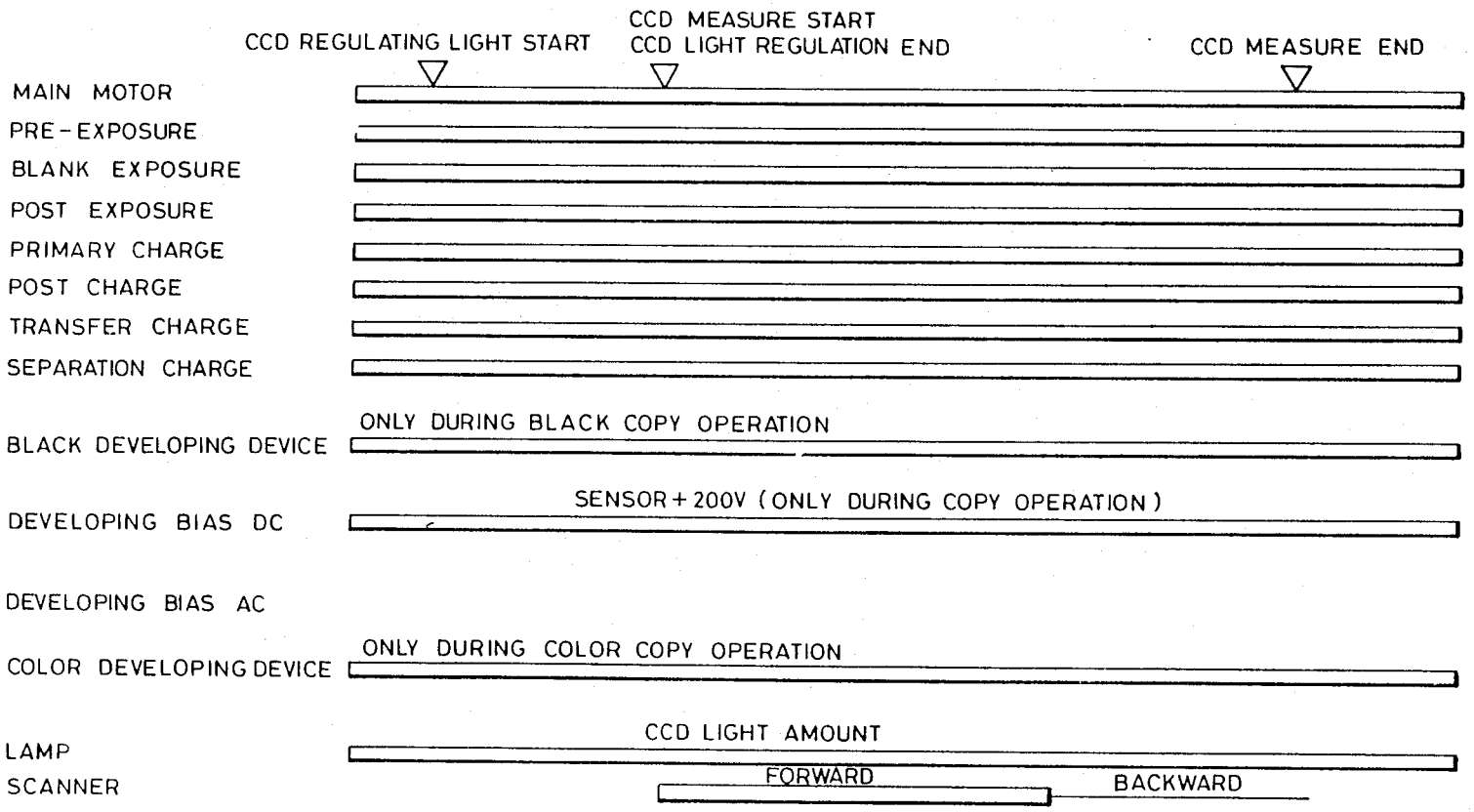
FIG. 6 is a timing chart for the CCD light regulation and CCD measurement.

FIG. 6 is a timing chart for the CCD light regulation and CCD measurement. For the CCD light regulation, the light amount of the illumination lamp is set to a value suitable for CCD measurement. The scanner is set at the home position. A standard white board is exposed. An amount of reflected light is measured by the CCD. The light amount is controlled such that the maximum value of one scanning line of the CCD becomes a predetermined level. After the end of this control, the optical system fully scans to detect the size, concentration, and mounting position of the original. If the absence of original is detected, the threshold level and the light amount of lamp are changed and the scan is restarted.

Figure 7:
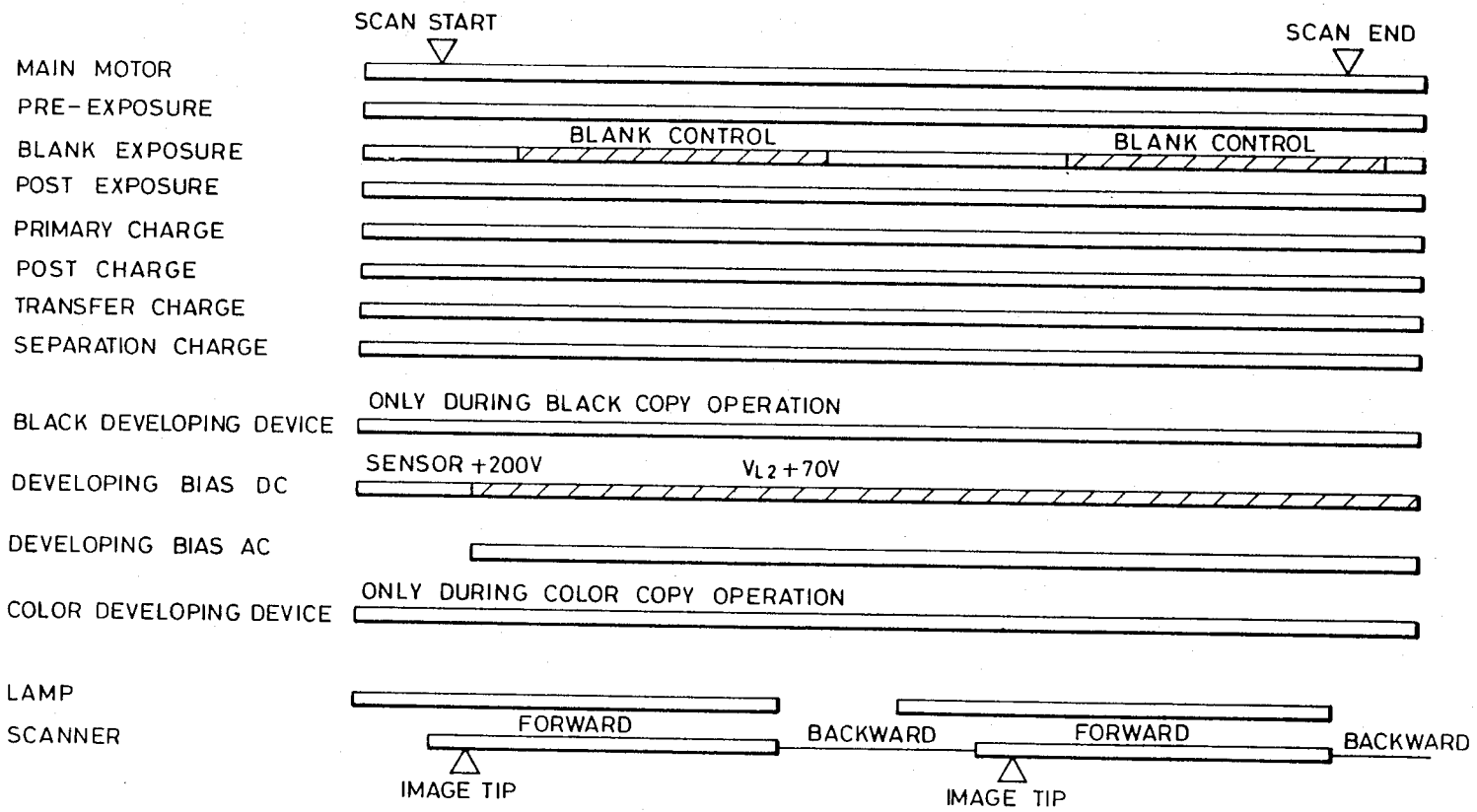
FIG. 7 is a timing chart for the scan.

FIG. 7 is a timing chart for the copy scan. When the image tip is detected after the optical system started forward, the developing bias DC becomes $V_{L2}+70$ V and the developing bias AC is also turned on. Further, after the image tip was detected, a desired blank light-up control is performed at a predetermined timing.

Figure 8:
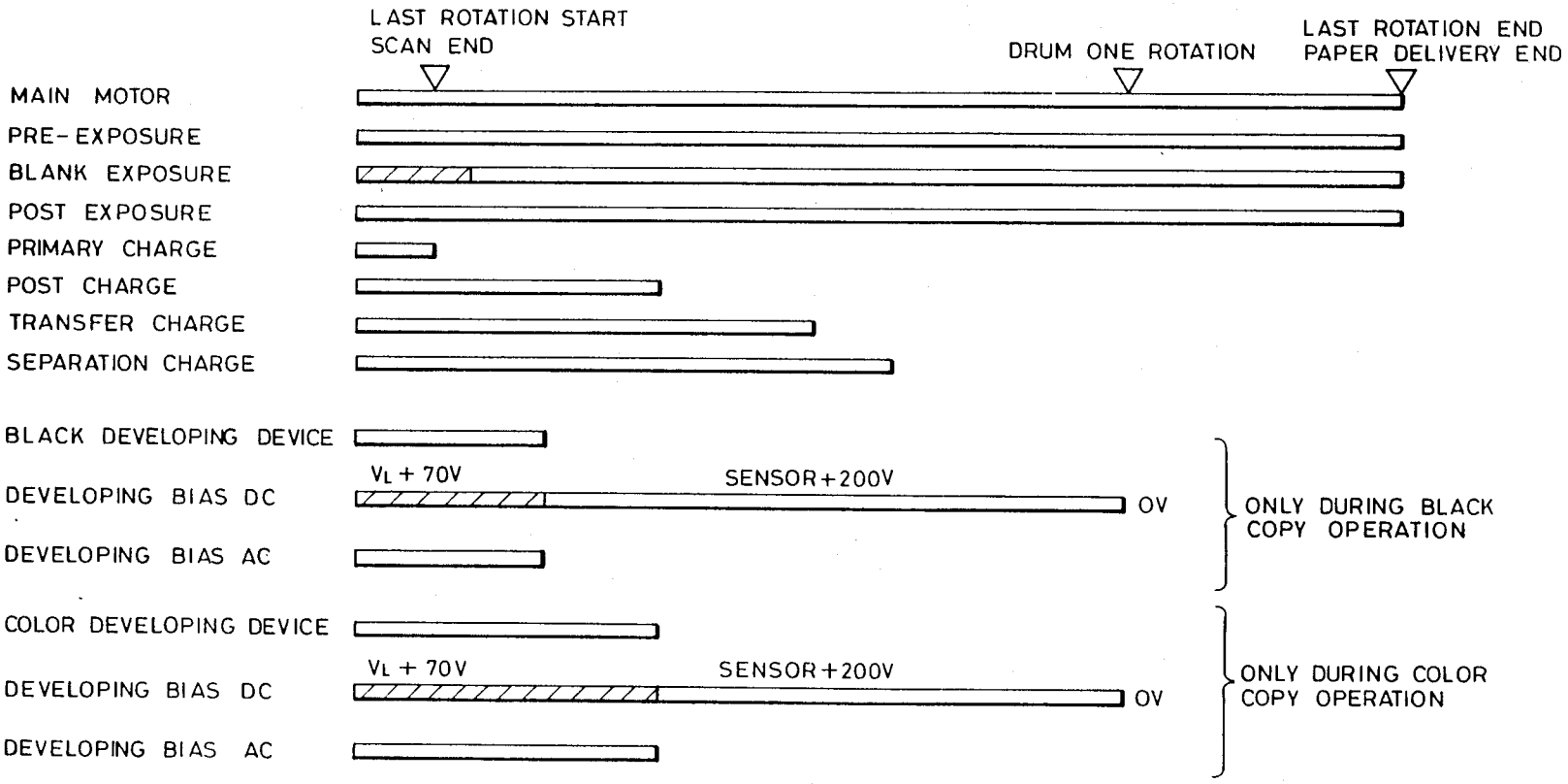
FIG. 8 is a timing chart for the last rotation.

FIG. 8 is a timing chart for the last rotation. After the final reverse of the scan, the last rotation is performed. After the primary charge was turned off, the developing device, developing bias DC, and developing bias AC are sequentially turned off. The sensor+200 V is turned off. Further, the post charge, transfer charge, and separation charge are turned off. After the drum was once rotated from the turn-off of the primary charge, the developing bias DC becomes 0 V.

After the last paper was ejected out, the main motor, blank exposure, post exposure, and pre-exposure are turned off and the apparatus enters the standby mode.

(Operating System)

Figures 1, 9:
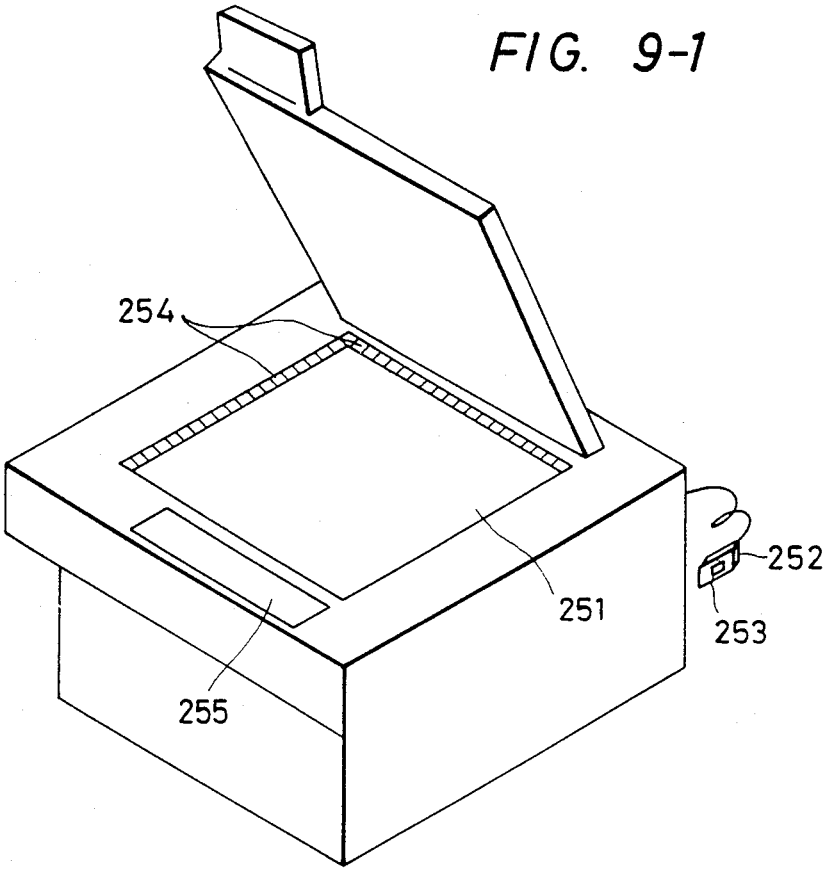
Figures 2, 9:
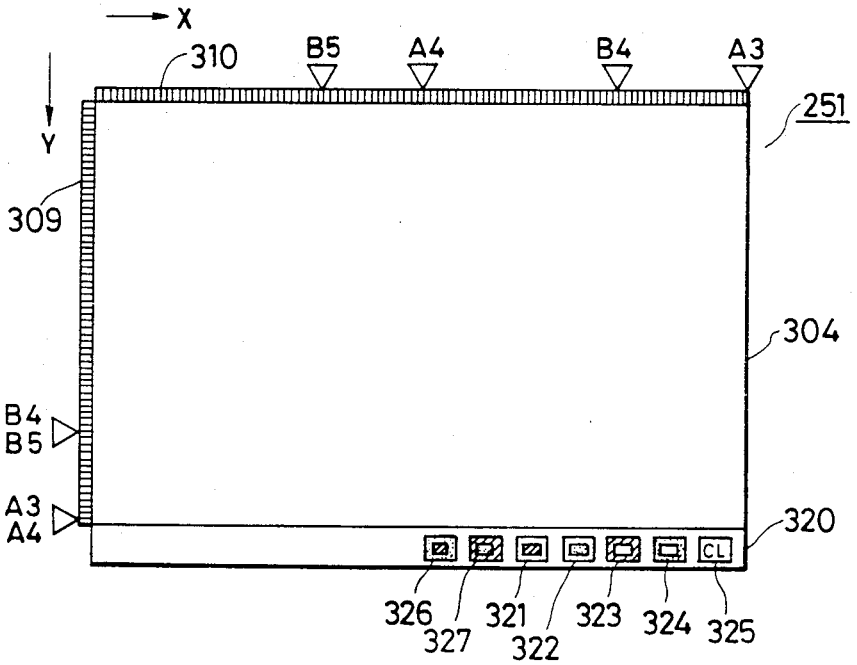

FIG. 9-1 is a perspective view of the copying apparatus according to the present invention. Reference numeral 251 denotes an original mounting glass and a touch panel (digitizer) using a transparent electrode is provided on the surface of the glass. The coordinates of the position designated can be detected by putting and pushing a pressure pen 252 onto the glass 251. The principle of the touch panel is omitted in this specification. It will be appreciated that even when the original is exposed to form an image, the latent image which is formed on the photo sensitive material will not be influenced at all since the transparent electrode is used. The pen 252 is formed with a switch 253. The coordinates can be inputted only when the switch 253 is pressed. An LED array 254 is attached at the edges of the glass 251 along the X and Y directions and can be arbitrarily lit up or off on the basis of an instruction from the CPU of the main body. An operating section 255 is used to give input/output control commands to the copying apparatus. The touch panel may be independently provided.

Figure 10:
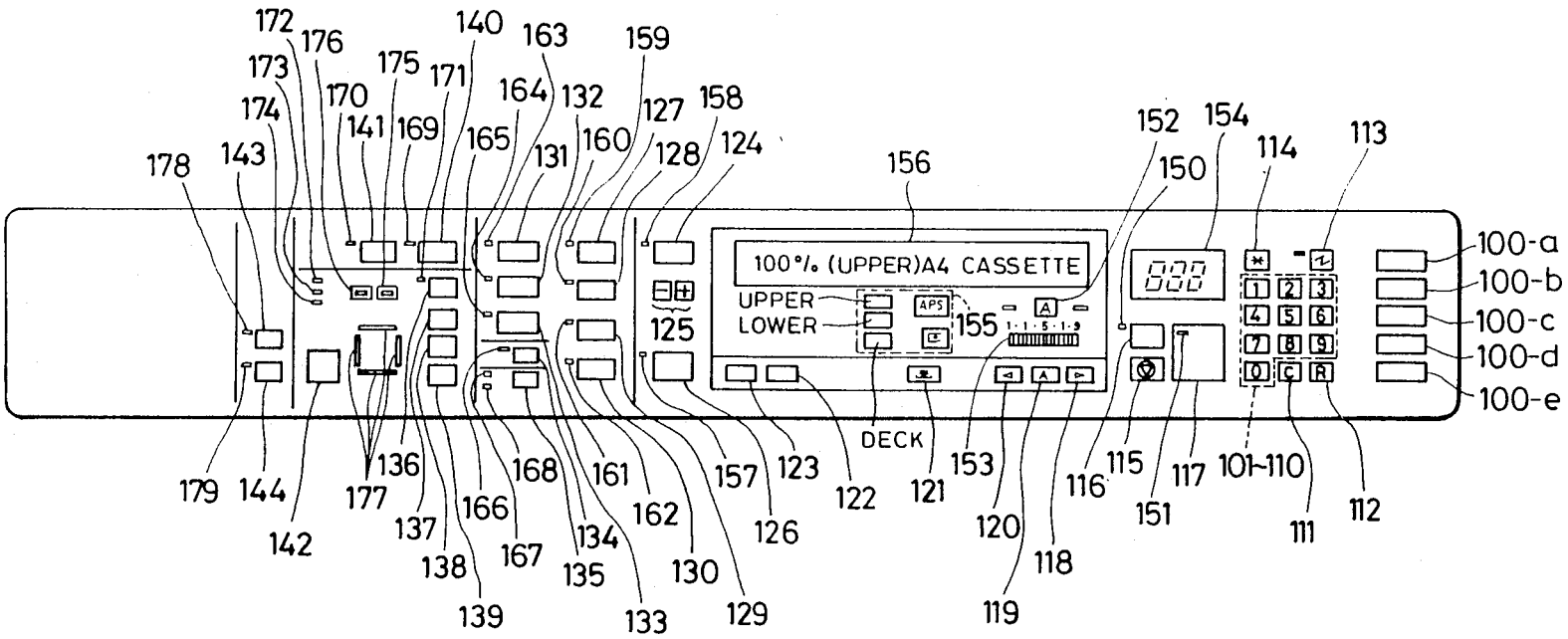
FIG. 10 is a top view of an operating section unit.

FIG. 10 is top view of the operating section unit. The functions of respective keys will be sequentially described hereinbelow.

Function keys 100-*a* to 100-*e* serve to store and access the copy mode which is arbitrarly set by each key of the operating section. Up to five kinds of modes can be stored. Namely, the mode which is ordinarily used by the user may be stored. The special magnifications which are used by the users or the areas which are designated due to an area designating process, which will be explained later, or the like can be stored. A desired copy mode can be promptly set merely by pressing one of those keys. In the copying apparatus, the memory contents are always held due to a backup power source.

Numerals 101 to 110 denote a ten-key having an ordinary function to set a copy quantity and a function to input various kinds of data in various kinds of asterisk modes by combining an asterisk key 114.

A clear key 111 is used to clear the set copy quantity or data. A reset key 112 cancels the set mode and returns to a predetermined standard mode. Numeral 113 is a pre-heating key; 114 is the asterisk key to shift to various asterisk modes; 115 a copy stop key; and 116 a color key to select arbitrary ones of a plurality of developing devices equipped in the main body of the apparatus. When the color developing device is selected, a built-in LED 150 is lit up for the purpose of warning as well.

Numeral 151 denotes a copy start key having an LED. This LED is lit up in green when the copy can be executed (excluding the time during the copy operation) and in red in the other cases. An AE key 119 selects the AE mode in which a concentration of original is detected and the developing bias is corrected and the copy of a proper concentration can be obtained. When the AE mode is selected, a display device 152 is lit up. A desired concentration can be obtained by increasing or decreasing the concentration level using manual concentration adjustment keys 118 and 120. Pressing the key 118 increases the concentration (i.e., thick concentration). Pressing the key 120 contrarily decreases the concentration (i.e., thin concentration). A concentration level of a display device 153 changes in accordance with depression of the keys 118 and 120. The display devices 152 and 153 indicate the foregoing concentration conditions. A seven-segment display device 154 displays a copy quantity.

A cassette selection key 121 is used to manually select an arbitrary cassette of transfer papers. This copying apparatus has the APS (Auto Paper Select) function. A display device 155 indicates the cassette which is selected by the cassette selection key 121 or the APS mode.

Reference numeral 122 denotes a selection key to select a fixed enlargement magnification; 123 is a selection key to select a fixed reduction magnification; and 124 is an AMS (Auto Magnification Select) key. The AMS key 124 has the function to automatically select the proper magnification on the basis of the size of original detected and the cassette size selected. The original size is detected by the CCD 18. When the AMS mode is selected, a display device 158 is lit up. A zoom key 125 makes it possible to adjust the magnification on a one-percent unit basis using the keys of "+" and "−". A direct copy key 126 sets the copy magnification to the equal magnification (100%). A display device 157 is lit up in the direct copy mode. Numeral 156 denotes a fluorescent indicative tuve of the dot matric type. The indicative tube 156 ordinarily indicates the set copy magnification, selected cassette size, copy mode, etc. and also functions as a message display to display complicated operation procedure or the like when an abnormality occurs in the apparatus or when the user erroneously operates.

Numeral 127 denotes a [one-sided→two-sided] copy selection key to automatically copy two one-sided originals onto two sides of a single paper using the middle tray in the main body of the apparatus. A [two-sided→one-sided] copy selection key 128 is used to copy a two-sided original to one side of each of two sheets of papers using an automatic circulating type original feeding apparatus (RDF). A [two-sided→two-sided] copy selection key 129 is used to copy a two-sided original to both sides of a single paper using the middle tray and RDF. A multi-copy selection key 130 is used to execute the multi-copy by overlapping two or more images on a single paper using the middle tray.

Pressing either one of the keys 127 to 130 allows one of display devices 159 to 162 to be lit up in correspondence to the key pressed.

A continuous copy selection key 131 is used to select the mode in which the original put on the original plate is divided into right and left parts and these two parts are exposed and scanned due to a single operation and two copies (which are respectively referred to as an A copy and a B copy) can be obtained.

A continuous copy/multi-copy selection key 132 has the function to multi-copy the A and B copies in the continuous copy mode mentioned above onto the same paper.

A continuous copy/two-sided copy selection key 133 has the function to copy the A and B copies onto the front and back surfaces of the same paper using the middle tray.

A frame deletion key 134 has the function to erase the shade which is caused at the edges of a book or in the central portion of double-spread pages in the continuous copy mode.

An image shift key 135 can shift an image to either the left or right. An amount of shift can be also adjusted by pressing the ten-key with the image shift key 135 pressed. The shift amount can be also stored by the function keys 100-*a* to 100-*e*. On the other hand, in the case where the multi-copy mode is set when the copy is executed in two different colors, the registration timing is controlled such that the shift amounts upon first and second copies coincide. The same shall also apply to the case of the monochromatic copy.

An area designation key 136 is used to designate areas and also used to cancel the areas designated. For the area designation, it is possible to select either one of two modes: in which a priority is given to the original (the size of area to be designated can be also varied in accordance with the variable magnification); and in which a priority is given to the cassette (the size of area to be designated is constant irrespective of the variable magnification). An X/Y key 137 serves as a data input key to input the coordinates of the area which is designated by the ten-key.

An in/out key 138 is used to select whether only the inside or outside of the area designated is developed.

A correction key 139 serves as a data recall key to call and correct the set area data.

An automatic switching key 140 is used to switch in/out of the area in the multi-copy mode and the developing colors. When the key 140 is pressed in the multi-copy mode, in/out and colors are automatically switched in accordance with the A copy and B copy.

An automatic color switching key 141 is used in the continuous copy mode and has the function to automatically switch the developing colors in the case of the A and B copies. A display device 170 is lit up when the key 141 is pressed.

Each LED indicated by numerals 157 to 171 denotes a mode display device to show the mode selected. Display sections 172 to 174 show the numbers of set areas. In the copying apparatus of the embodiment, up to three areas can be set. Display sections 175 and 176 indicate in/out of the area and either one of these display sections corresponding to the mode which is set by the key 138 is lit up. A group of LEDs indicated at 177 are display devices to show which one of the $X_{min}$, $X_{max}$, $Y_{min}$, and $Y_{max}$ the value of the set area is.

Numeral 142 denotes an area designation key using a CCD. Pressing the key 142 allows the optical system to start scanning and execute only the function to recognize the designated area by reading the markers written on the original.

A sort key 143 and a collate key 144 are also provided.

Display devices 178 and 179 display the sort mode and collate mode, respectively.

Figure 11:
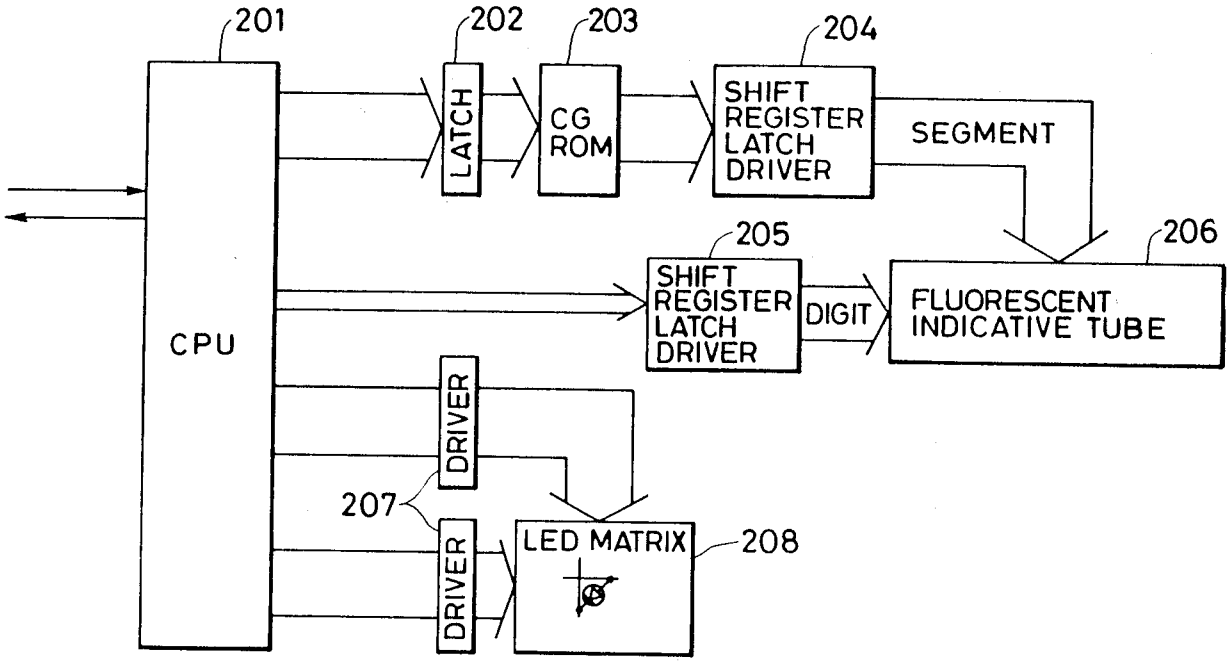
FIG. 11 is a block diagram showing an arrangement of a display section.

FIG. 11 is a fundamental block diagram showing an arrangement of the display section.

A CPU 201 is a microcomputer to control each display device and the display elements. The contents of display are based on the data from the CPU of the main body.

A fluorescent indicative tube 206 can display forty characters each consisting of 5×7 dots. The data of 7 bits×5 bytes is needed to constitute one character. The data of thirty-five bits is sequentially read out from a character generator 203 in response to an instruction of the CPU 201 and transferred to a shift register latch driver 204. The data as much as five bytes, namely, 35 bits is latched by the driver 204. Thereafter, a digit signal to determine the timing when one character is displayed is driven by the driver 205, so that one character is displayed. In this manner, the characters are displayed one by one by dynamically lighting up the fluorescent tube. The duty ratio is 1/40 or less (because of the blanking period).

Numeral 208 denotes another LED matrix in the display section. This LED matrix is driven by dynamically lighting up each LED.

Figure 12:
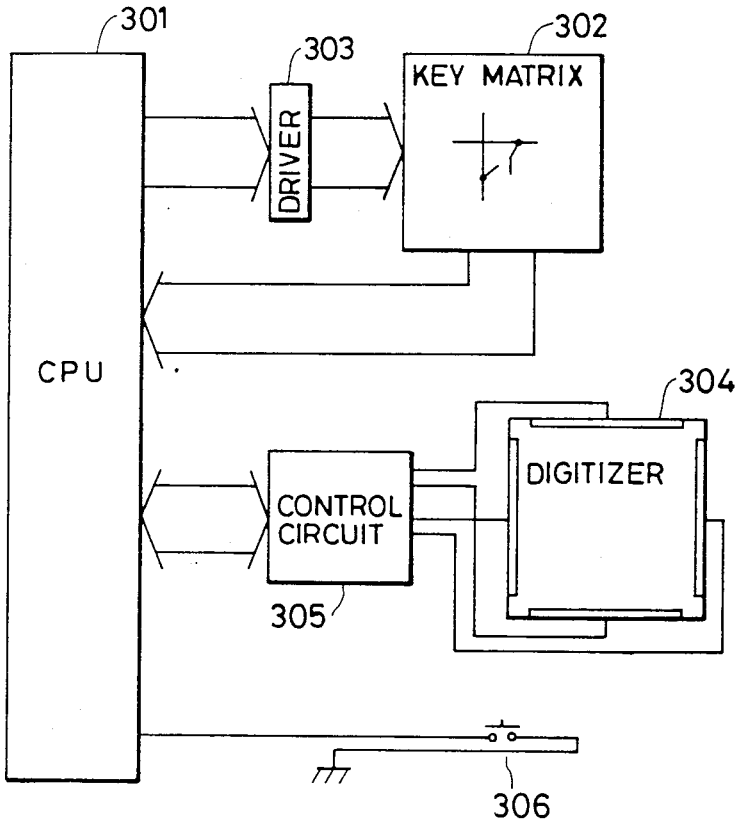
FIG. 12 is a block diagram of an input section.

FIG. 12 is a block diagram of the peripheral components of the input section of a CPU 301 to control the main body. A key matrix 302 is a group of switches which are provided for the respective input keys and is dynamically processed by the CPU 301 due to a well-known technique, thereby determining which key was pressed.

Numeral 304 denotes a digitizer. The x and y coordinates of the position which is indicated by pressing a light pen are detected by a control circuit 305.

The light pen is formed with a coordinate input trigger signal switch 306. The CPU 301 reads the coordinates of the portion pressed by the pen synchronously with the trigger edge of th coordinate input trigger signal.

Figure 13:
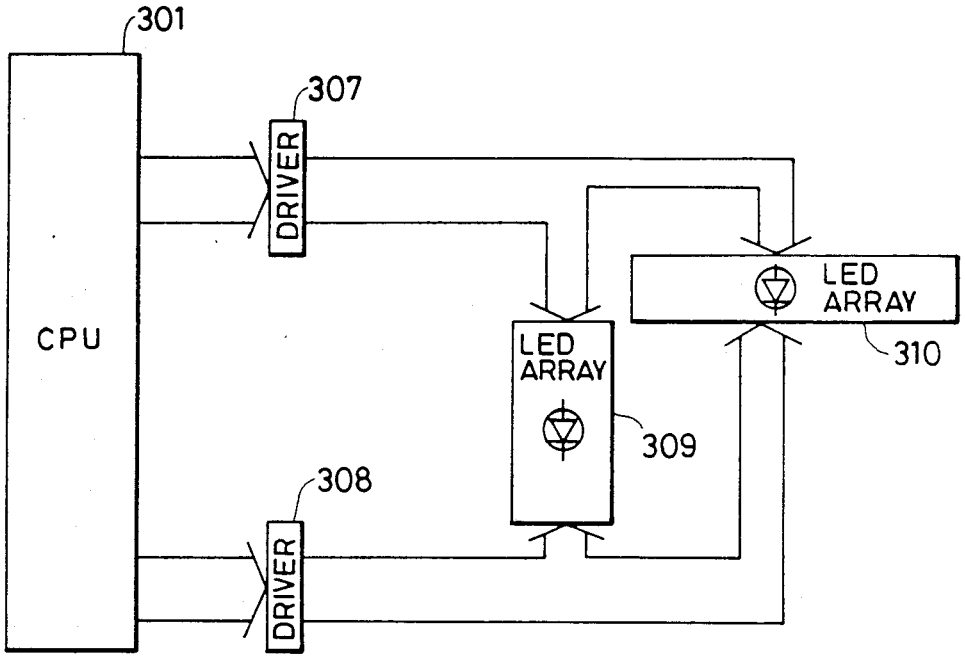
FIG. 13 is a block diagram of a drive circuit of an LED array.

FIG. 13 is a drive block diagram of the LED array arranged at the frame of the original glass plate for displaying the designated areas.

LED arrays 309 and 310 are arranged along the frame of the glass in the X and Y directions, respectively, and dynamically lit up by the CPU 301.

Figure 14:
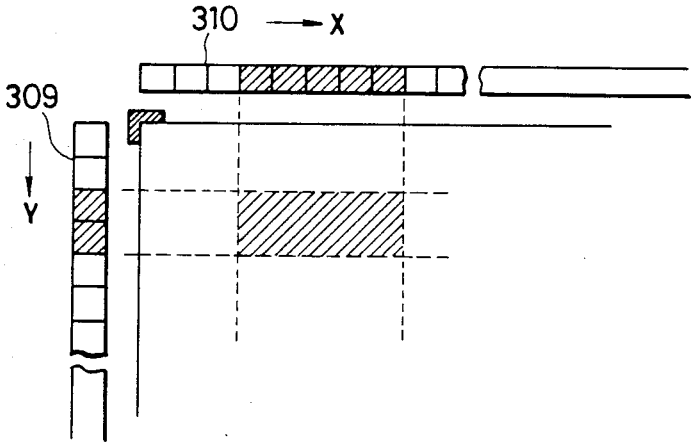
FIG. 14 is a diagram showing the situation in which the LED array was lit up.

FIG. 14 shows the situation of the LED arrays 309 and 310 when they were lit up. When it is now assumed that the copy in the area in the hatched portion in FIG. 14 was designated, the LEDs representing the x and y coordinates corresponding to the area where an image is formed are lit up (as shown by the hatched portions of the LEDs in the diagram).

On the contrary, if the copy out of the area was designated, only the LEDs of the hatched portions are lit off and the other LEDs are lit up.

On the other hand, the LEDs of the portion where no image is formed in the designated area may be lit up contrarily.

Figures 1, 15:
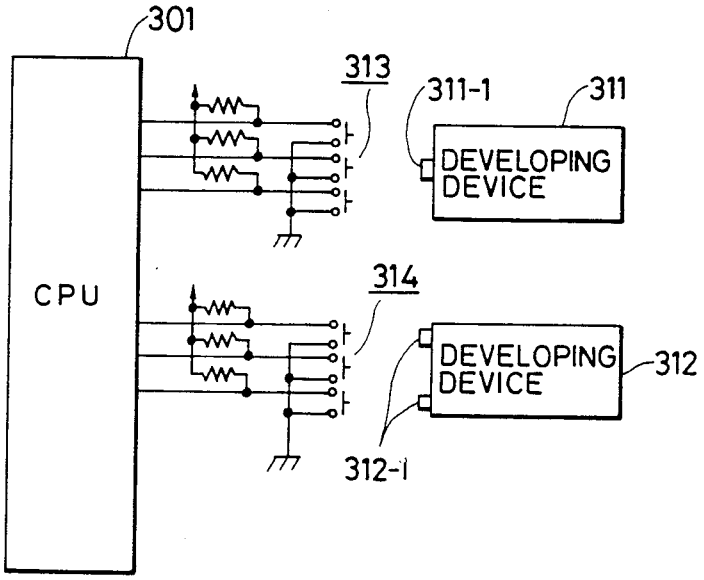
Figures 2, 15:
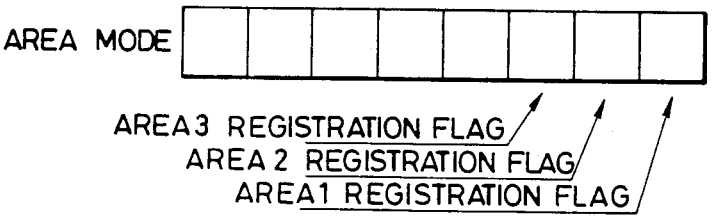
Figures 3, 15:
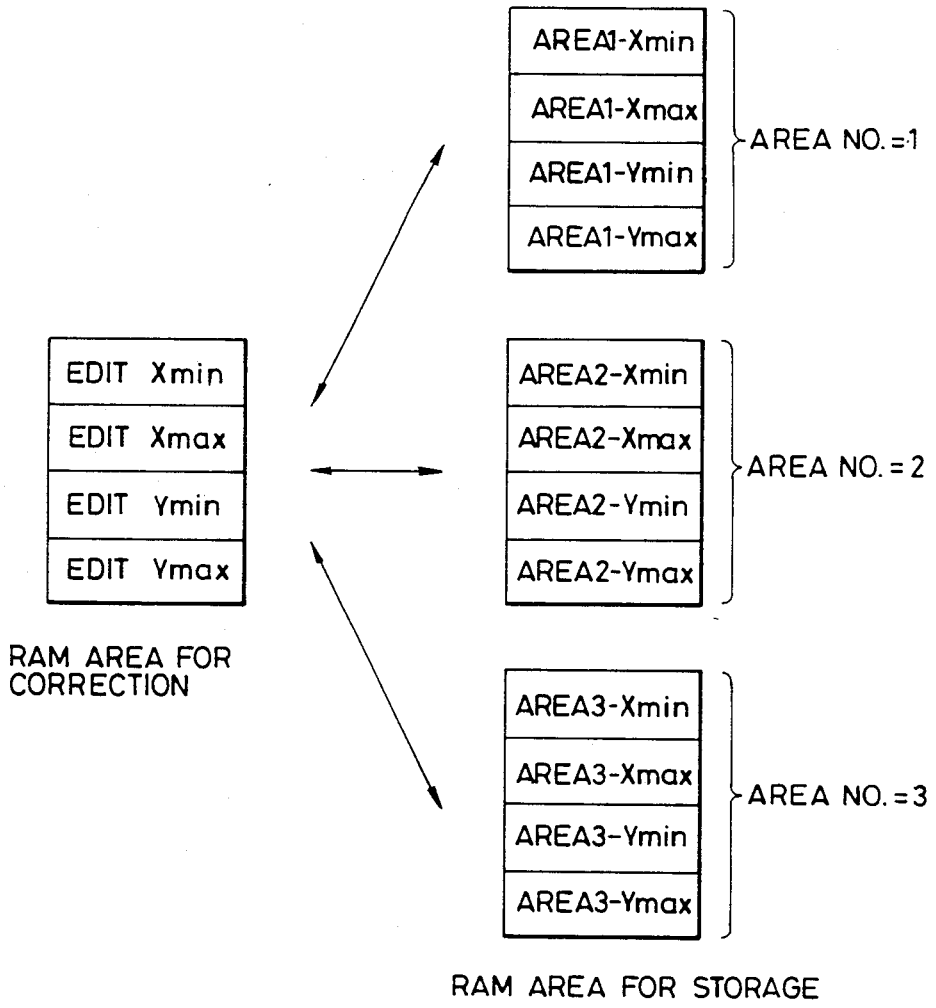
Figures 4, 15:
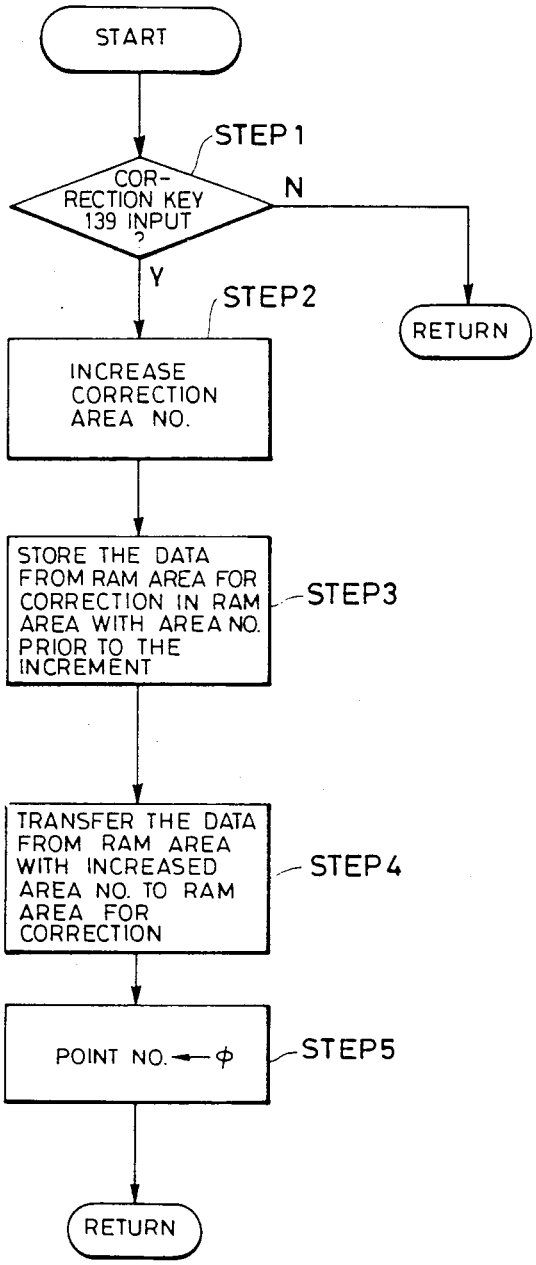
Figures 5, 15:
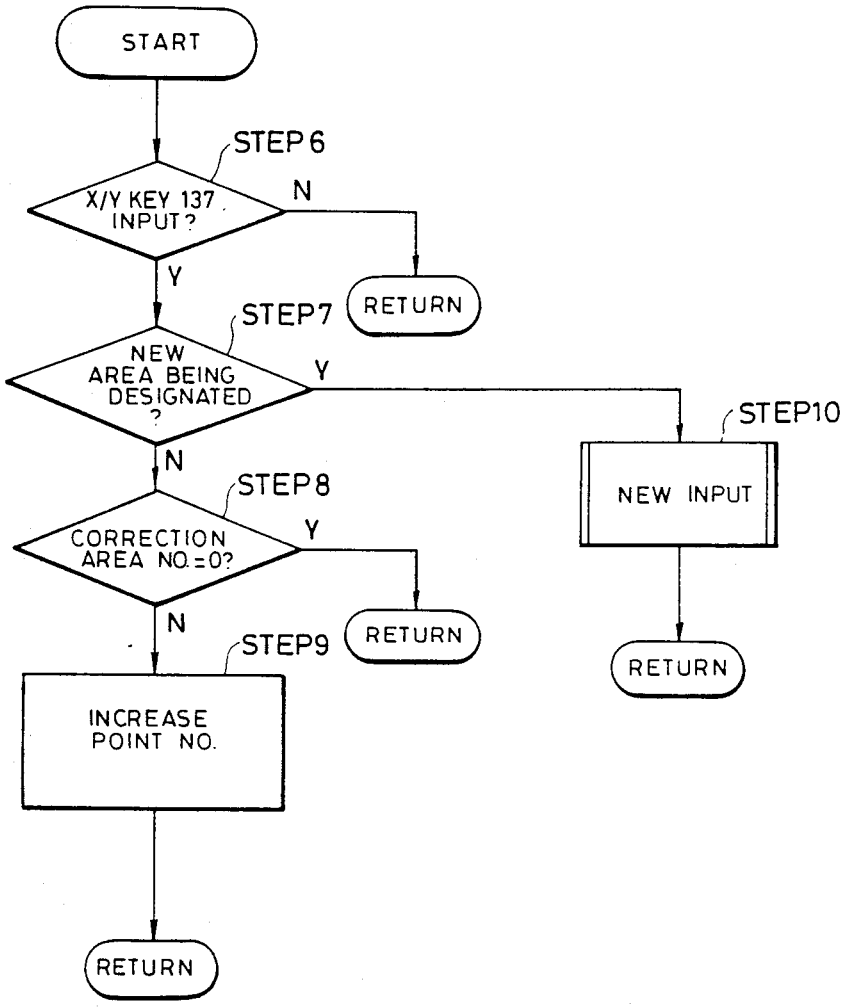
Figures 6, 15:
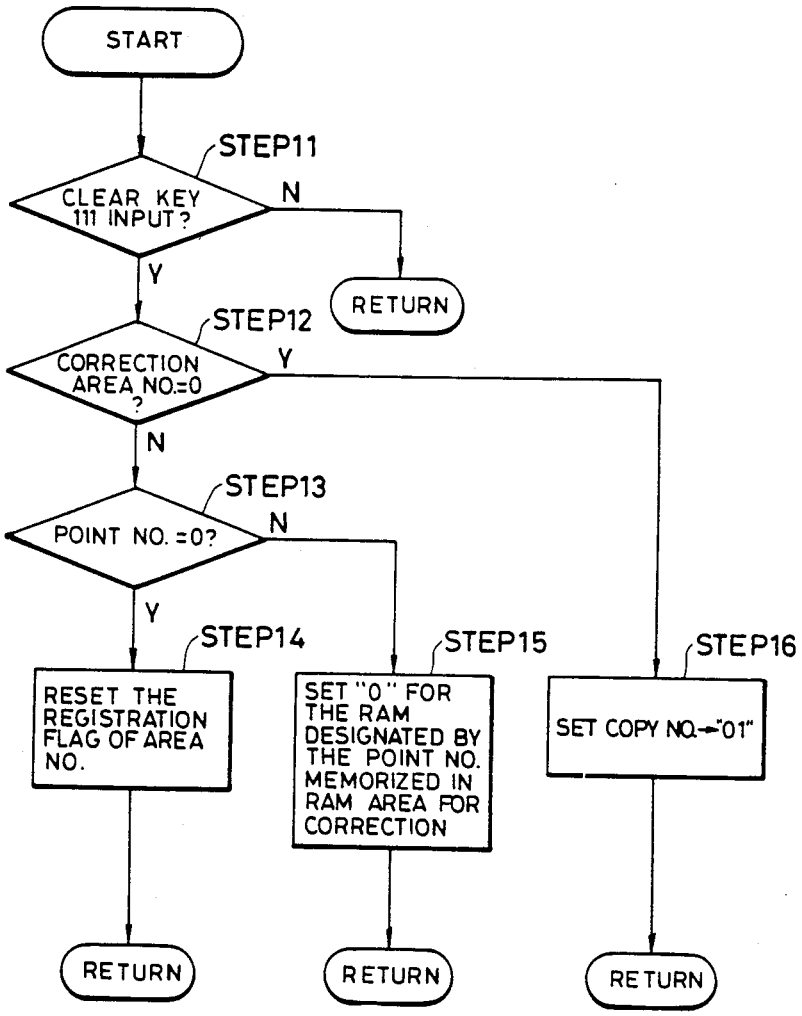
Figures 7, 15:
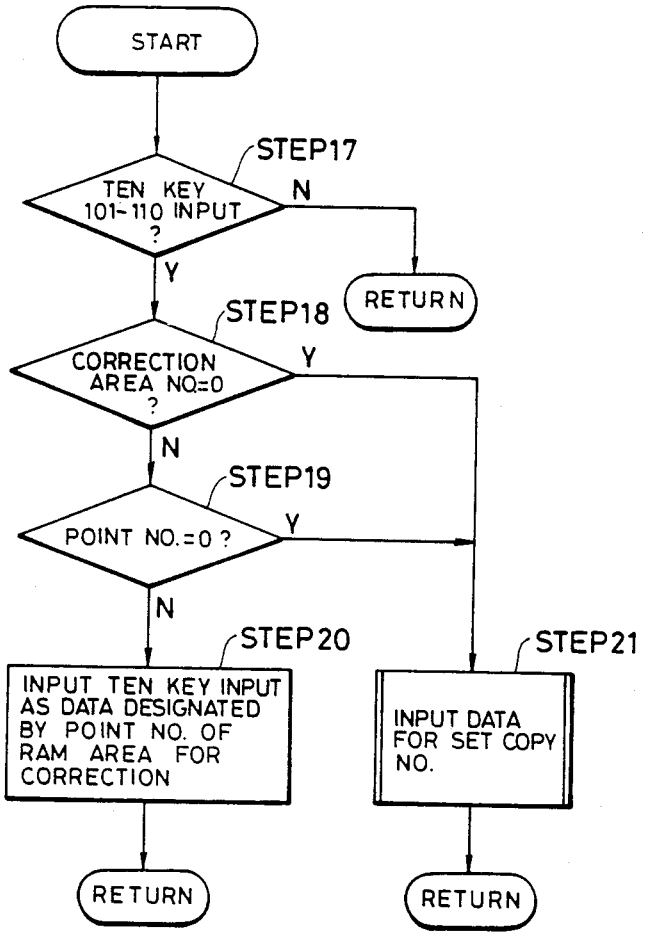

FIG. 15-1 shows color detection circuits of the developing devices.

Color detection switches 313 and 314 are closed by projections 311-1 and 312-1 provided for developing devices 311 and 312. The CPU 301 determines the color of the developing device which is set in dependence on the ON/OFF states of the color detection switches 313 and 314. Namely, each developing device has a peculiar switch pattern for every color. For instance, in the case where three color detection switches are used as shown in FIG. 15-1, seven ($2^3-1$) kinds of colors can be discriminated.

The case of setting areas will then be considered.

When the area designation key 136 in FIG. 10 is pressed, "Area Designation . . . 1: Original Standard 2: Cassette Standard" are displayed on the message display 156. The message corresponding to the content which is currently selected is displayed as a flashing message indication. The mode can be also changed by pressing "1" or "2" of the ten-key. A series of these display operations are executed only when the key 136 is pressed.

An explanation will be made with respect to the case of selecting the area designation mode of the original reference. In this mode, the values of the X axis (sub-scanning direction, i.e., the scanning direction of the optical system) and Y axis (main scanning direction, i.e., the scanning direction of the CCD) from the origin of the coordinates determined with regard to the original are inputted to designate the area. The designated area is also automatically enlarged or reduced in the variable magnification copy mode.

Four points are designated by the ten-key 101 to 110 and X/Y key 137 in accordance with the sequence of the $X_{min}$ coordinate, $X_{max}$ coordinate, $Y_{min}$ coordinate, and $Y_{max}$ cordinate and the deisgnation of one area is completed. Practically speaking, each data is inputted in accordance with the sequence of "X/Y", $X_{min}$, "X/Y", $X_{max}$, "X/Y", $Y_{min}$, "X/Y", $Y_{max}$, "X/Y". Each coordinate is set on a one-mullimeter unit basis.

When the "X/Y" key 137 is inputted after the numerical values were set, a group of LEDs of 177 are sequentially lit up. Thus, the user can confirm that the coordinate of each point is inputted. In this case, each coordinate is inputted on the hasis of the interactive manner by way of the message display 156, such as "Area 1: Coordinate to Xmin . .ooomm". Therefore, even in the case of the user which uses the apparatus for the first time, he can easily set the necessary data.

After one area was set by inputting four points in this manner, the LED 172 is lit up to inform that one area was set. In addition, the out mode (copy in the area) is automatically selected and the display device 175 is lit up. It is possible to change to the in mode (copy out of the area) by the in/out key 138.

On the other hand, an area can be also designated by way of the touch panel using a group of switches of the transparent electrode on the original plate 251.

In this case, the original is set on the original plate such that the image side faces upwardly. However, a reference point in this case is located leftwardly on this side of the original plate and differs from the reference point (leftward on the back side) when the copy is actually executed. In this state, two points on a diagonal line of the designated area (which is limited to only a rectangle) on the original are pointed by pressing the pressure pen 252. The input switch 253 is then pushed with the pressure pen 252 pressed. The coordinates of the portion pushed by the pen 252 are inputted by a signal which is instantaneously generated whtn the input switch 253 was pressed or removed. No coordinate is inputted even when the coordinates are designated by the pressure pen in the state in which the input switch 253 is continuously depressed.

In the case of designation of the coordinates by the pen, two coordinates of X and Y are simultaneously designated merely by pressing a single point. Therefore, two of the LEDs of 172 are simultaneously lit up. In addition, since the coordinates inputted are displayed as the numerical values in the message display section 156 simultaneously with the input of the coordinates, they can be confirmed by the eyes. As described above, the area can be set merely by designating two points on a diagonal line due to such a transparent digitizer input method.

The area designation by way of a CCD will then be described.

First, the original whose area is designated is set on the original plate and copied using a color developing device (other than black). A desired area is thickly marked like a frame on the copied paper using a marking pen or the like. The reason why the original was developed in color is because it is necessary to obtain the concentration difference between this color and the color of the marking pen. It is desirable to develop in slightly thin color so that a desired area can be distinguished. In addition, the original may be covered with a transparent sheet or a thin paper or the like and a desired area may be marked on this sheet or paper. Next, the marked original (including the transparent sheet or thin paper or the like) is reset on the original plate and the area designation key 142 is pressed. Thus, the optical system starts scanning and the marked area on the original is recognized by the CCD 18 arranged on the optical path. It is now assumed that upon area detection, only one portion can be recognized by a single scan. The recognized area can be confirmed since the coordinates are displayed by the message display.

In this manner, the area can be designated by three kinds of input methods using the ten-key, touch pen, and CCD. Up to three areas can be designated by arbitrarily combining these methods.

When the areas are designated, they can be also stored using the function keys 100*a* to 100*e*.

Further, the inputted area data can be confirmed by the message display 156 and can be also checked by the eyes by the LED array 254 arranged along the X and Y axes of the original glass plate 251.

Upon confirmation, the areas can be selected by the correction key 139. Namely, the first area is selected by once pressing the key 139. The second area is selected by again pressing the key 139. The third area is selected by further pressing the key 139. Then, the correction mode is canceled by pressing the key 139 still again and the first area is again selected by moreover pressing the key 139. In addition, by selecting the X and Y coordinates by the X/Y key 137, these coordinates can be sequentially accessed on the message display. In this state, by changing the area data stored in the memory using the ten-key, the set area can be also corrected. Obviously, the numerical values inputted by the transparent digitizer (tough panel) or CCD or the like can be also corrected by the ten-key.

In addition, by selecting the area by the correction key and pressing the clear key 111, only the special area can be also deleted.

After the area was set and the in/out was set as described above, the latent image corresponding to the portion in or out of the area is erased by the erasing means in the copy process, so that a desired copy can be derived.

On the other hand, by constituting the apparatus such that ON/OFF of the LED array can be instructed by the operating section and by lighting up the LEDs in a desired range, the area can be also designated.

After the CPU 301 confirmed the coordinates of the area, it lights up (copy out of the area) or lights off (copy in the area) the blank exposure lamp (LED array) at the timings corresponding to the $X_{min}$ to $X_{max}$ of the image formed on the drum with respect to the sub-scanning direction (X direction). The CPU 301 lights up (copy out of the area) or lights off (copy in the area) the LED array in the range corresponding to the $Y_{min}$ to $Y_{max}$ of the image formed on the drum with respect to the main scanning direction (Y direction). Due to this, the copy in or out of the area is obtained.

The key input upon area designation will then be described.

FIG. 15-2 shows a RAM of the area mode and lower three bits are flags indicative of registration of areas 1 to 3. When an area is set by the ten-key or digitizer or the like, the flag of the number of this area is set.

FIG. 15-3 is a conceptional diagram showing the contents of the RAM when the area is corrected. When the new area is set, the flag indicative of the number of the new area is set, and at the same time the data of four points ($X_{min}$, $X_{max}$, $Y_{min}$, $Y_{max}$) is stored for each area. Since up to three areas can be set, memory locations as many as the areas are provided in the RAM.

In the case of correcting or erasing the area, the area is selected by th correction key 139 and the data in the selected area is loaded into the area for correction in the RAM. Further, the points are selected by the X/Y key 137 and the relevant data is corrected by the ten-key and clear key and the data is again stored into a predetermined area in the RAM and the correction is completed. The area correcting procedures which are executed for every key will then be described hereinbelow with reference to flowcharts.

FIG. 15-4 is a flowchart when the correction key 139 was inputted.

In step 1, a check is made to see if the correction key has been inputted or not. If it is YES, the correction area number is increased and the area number of 1, 2, or 3 is selected (step 2). However, in the case where the area which is indicated by the area number is not registered yet, this number is skipped (namely, when none of the areas is registered, the correction area number is always "0"). After the area No. 3, the area No. 1 is selected.

In step 3, the data which has already been stored into the RAM area for correction is stored into a predetermined RAM area and the data of the area No. which is newly selected is loaded into the RAM area for correction (step 4).

At this time, the point number is set to "0" (step 5).

FIG. 15-5 is a flowchart when the X/Y key 137 was inputted.

When the X/Y key 137 was inputted (step 6), a check is made in step 7 to see if the new area is at present being set or not. If the new area is set, the different processes are executed; however, the description is omitted (step 10).

The correction area number is checked in step 8. When the correction area No. = "0" (namely, in the case where the correction is not being performed) the input of the X/Y key 137 is ignored. When the correction area number was given, the point number is selected in step 9 in a manner such that:

Point No. 0 (initial)→Point No. 1 ($X_{min}$)→Point No. 2 ($X_{max}$)→Point No. 3 ($Y_{min}$)→Point No. 4 ($Y_{max}$)→Point No. 0

FIG. 15-6 is a flowchart when the clear key 111 was inputted.

When it is determined that the clear key 111 was inputted in step 11, a check is made in step 12 to see if the designated area is at present being corrected or not. In the case where the correction (including the designation) is not being executed, the set copy quantity is cleared (step 16). When the area is being corrected, a check is made in step 13 to see if the point number has been designated or not (i.e., the point No. = 0 or not). If it is NO (=0), the registered area is canceled (i.e., the registration flag of the area mode is reset) in step 14. When the point number was designated (≠0), the RAM data of the designated point is cleared (set to "00") in step 15. For example, when the point No. = 1, "0" is substituted for the edit $X_{min}$ of the RAM area for correction.

FIG. 15-7 is a flowchart when the ten-key 101 to 110 was inputted.

When it was determined that the ten-key was inputted in step 17, steps 18 and 19 follow. When it is decided that the area is being corrected (including the case where the area is being designated) in steps 18 and 19, the data which is inputted by the ten-key is inputted as the data which is designated by the point number of the RAM area for correction in step 20.

On the contary, when the area is not being corrected, the input ten-key data is inputted as the numerical data for the set copy quantity or the like (step 21).

FIG. 9-2 is a diagram showing the original mounting plate. A command section 320 is provided on this side in the digitizer 304 which is formed from the transparent electrode. A command is selected by pressing with the pen in a manner silimar to the input of the coordinates in the case of the area designation. In this case, the coordinates pushed by the pen are read. If the coordinates which are read lie in the original mounting area, the area designation or magnification designation is determined. If the coordinates lies in the command section area, the command corresponding to the coordinates is selected. Reference numeral 321 denotes a command to copy the portion inside of the designated area in black; 322 is a command to copy the portion inside of the designated area in color (for instance, red); 323 a command to copy the portion out of the designated area in black; 324 a command to copy the portion out of the designated area in color; 325 a command to clear the coordinates inputted by the pen; 326 a command to copy the portion inside of the designated area in black and to copy the portion out of the designated area in color; and 327 a command to copy the portion inside of the designated area in color and to copy the portion out of the designated area in black. In this manner, the area and color can be designated by the digitizer.

It will be appreciated that the degitizer is not arranged on the original glass plate but may be provided on the front side of the original cover or may be provided separately from the main body of the copying apparatus.

As the principle of the digitizer, it is possible to consider various kinds of principles such as detection of a position by way of detection of a resistance value, and electrostatic capacitance, or a distortion factor, or by way of the light, or the like.

The copying apparatus of this embodiment has the original size detecting means using the CCD 18 and comprises the cassette size input means and the zoom lens 16 for continuous variable magnification, thereby realizing the AMS and APS.

When a copy start key 117 is pressed, the optical system starts pre-scanning. The original image at this time is inputted to the CCD to detect the original size. The pressing plate 90 is formed as the mirror surface for this purpose and the concentration difference between the original and the mirror surface is provided, thereby detecting the original size on the basis of the position where the concentration changes. The erasure means prevents that the toner is deposited onto the latent image corresponding to the mirror surface portion and formed as a visible image. There are some originals which are decided such that no original is set because they have thick concentrations. Therefore, in the case where it has once been determined that no original is set, the lighting voltage and discrimination reference level and the like are changed and the pre-scan is again executed, thereby detecting the original size.

In the case where the set position of the original detected is deviated from the reference point by a distance larger than a predetermined value, this fact is warned by the meassage display 156 as the wrong original set position. The execution of the copy sequence after that is stopped. In a manner similar to the above, when it is detected by the CCD 18 that the original is obliquely set, the alarm indication is also performed and the subsequent copy sequence is stopped. In this case, the oblique setting of the original is detected by the coordinates of the corner portion of the original or from the gradient of the edge of original.

However, there is also a case where the user purposely sets the original obliquely. Therefore, even in such a case, if the alarm canceling mode is selected by a alarm canceling switch (not shown), the copy sequence can be executed. In this case, the X and Y coordinates of the point at the farthest position from the reference point are determined as the original size and the AMS and APS can be executed. The erasure means is apparently needed to erase the portion which was decided to be out of the original.

Further, if the original is set at the position which is deviated with respect to the X axis (in the scanning direction of the optical system), the image is automatically shifted and the scan timing and the paper feed timing (operation timing of the registration roller 29) are adjusted and the proper image can be also derived.

On one hand, even if an alarm was generated, by pressing again the copy key, the copy may be executed by ignoring the warning.

When either one of the selected cassette size or copy magnification was designated for the original size detected as mentioned above, the other can be automatically calculated and determined (AMS, APS).

The paper size which is calculated from the original size and magnification is not always the formal size. Therefore, in this calculation, the minimum cassette size including this calculated paper size is considered as the first condition. In order to prevent that the original size is erroneously determined to be the size which is one-stage larger due to the slight missetting or misdetection, the data indicative of the original size is processed in a manner such as to be handled as the size which is slightly smaller than the actual size (in other words, an allowance is given). Practically speaking, an allowance of a few millimeters is given in each of the X and Y directions.

On the other hand, the proper magnification is determined by the original size and cassette size. However, it is a general manner to copy from a formal size to another formal size at a variable magnification (including the direct copy mode, i.e., the copy from a formal size to the same formal size). Therefore, in the case where the detected original size coincides with or is nearly equal to the formal size, the peculiar magnification between those formal sizes may be also preferentially selected in place of the accurately calculated magnification.

For the copy paper size, as well as the standard size which is prepared by the maker side, there are some cases where special sizes are frequently used by the user or country. In the copying apparatus of this invention, to execute the AMS and APS in correspondence to these special sizes as well, the X and Y dimensions can be also registered with respect to these universal cassette. The setting method in this case includes three kinds similarly to the area designation.

First, the apparatus is set to the standby mode by the asterisk (*) mode. At this time, the dimensions are displayed and instructed on the message display in an interactive manner.

"Universal 1:
X (vertical):—mm",
Y (horizontal):—mm"

In the initial state in which nothing is instructed, the maximum paper size of A3 or LGR or the like is set.

The dimensions in the X and Y directions are inputted by the ten-key on a 1-mm unit basis in this state.

The original is set onto the original plate 251 and the paper size can be set by the transparent electrode, or the paper size can be detected and registered due to the CCD scan as well. The CCD scan is executed by the area designation key 142. These size detection and registration are effective only in the universal cassette registration mode among the asterisk modes (*).

As described above, the APS and AMS can be also executed with respect to informal original size, informal paper size, and between arbitrary magnifications.

On the other hand, the copying apparatus of this invention having the area designating function can also execute the AMS or APS on the basis of the size of designated area and paper size or magnification instead of the original size.

The magnification setting method will then be described.

In this copying apparatus, the magnification can be also set using the transparent digitizer on the original plate in addition to the setting of the magnification by the fixed magnification selection keys 122 and 123, arbitrary magnification (zoom) selection key 125, automatic magnification selection key 124, etc. In this case as well, the magnification can be set by selecting the magnification setting mode among the asterisk (*) modes and indicating two points on the digitizer on the original plate. That is, the magnification is set in correspondence to the ratio between the distance from the point indicated by the first push to the reference point of the original and the distance from the point indicated by the second push to the reference point of the original. If a distant point than the point indicated by the first push is indicated by the second push, the enlarged image can be obtained. Contrarily, if a near point is indicated, the reduced image can be obtained. This instruction is also displayed on the message display.

"1 push:2 push=—mm:—mm→—%"

The variable magnification can be also decided by substituting two values using the ten-key in a manner similar to the above. There is also a case where the calculated magnification exceeds the possible variable magnification which can be set by the copying apparatus due to those two magnification deciding methods. In this copying apparatus, in order to make it possible to obtain a desired magnification by repeating the copy up to two times, if the magnification cannot be obtained by only the first copy, the second copy magnification can be simultaneously instructed as shown below.

" OOO% 1st: OOO%, 2nd: OOO%"

After the first copy was performed, the paper which was copied at a variable magnification is set onto the original plate and the displayed magnification is inputted and the copy is again executed, so that the copy of a desired magnification can be obtained.

Therefore, this apparatus having the copy magnifications of 50 to 150% can instruct the copy magnification within a range of 25 to 225%.

After completion of the first copy, the magnification of the second copy may be automatically set.

In addition, the copy magnification can be also determined by way of a combination of the digitizer input and the original detection due to the CCD. Namely, the position corresponding to a desired size to which the copy area is enlarged or reduced by the digitizer is designated by the pen. Then, the original is set and the original size is detected upon pre-scanning. The copy magnification may be determined from the ratio between those two sizes. The repetitive number of copy times may be set to an arbitrary value as far as the deterioration of picture quality is permitted.

Figures 1, 16:
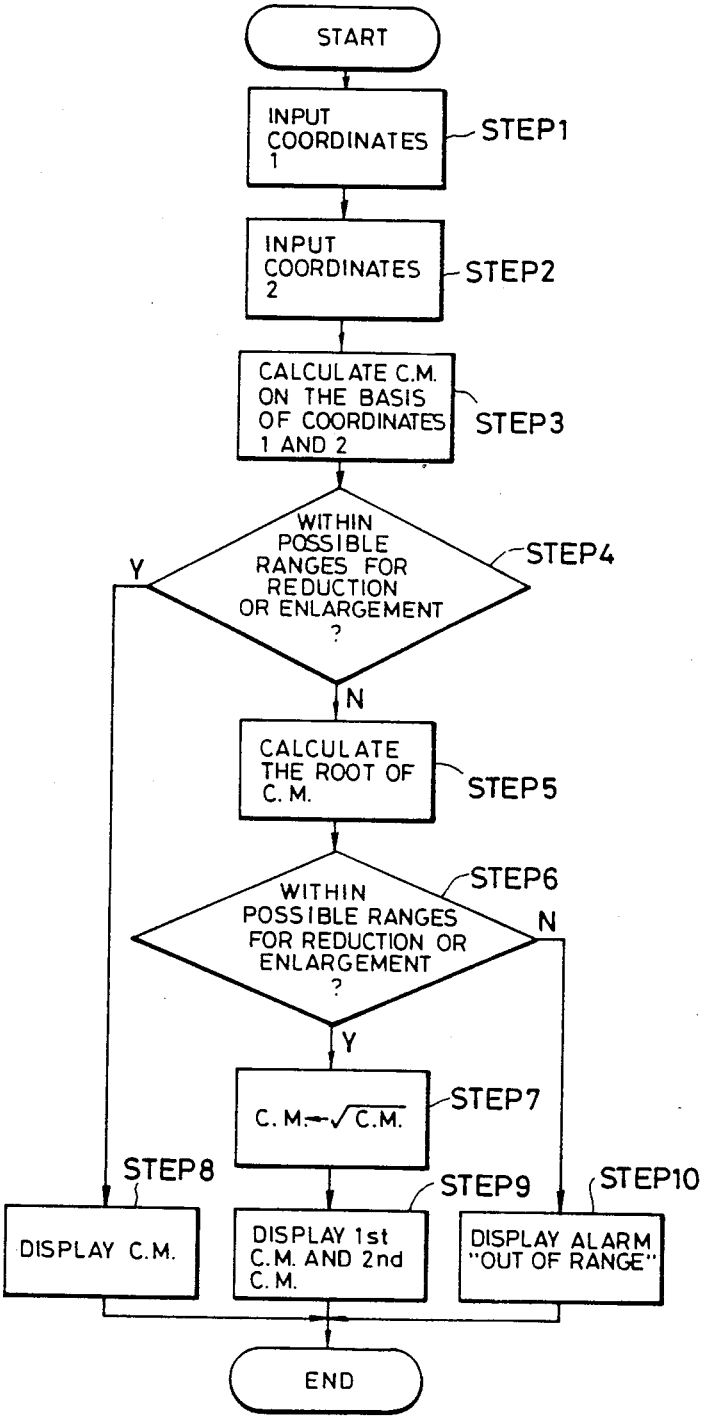
Figures 2, 16:
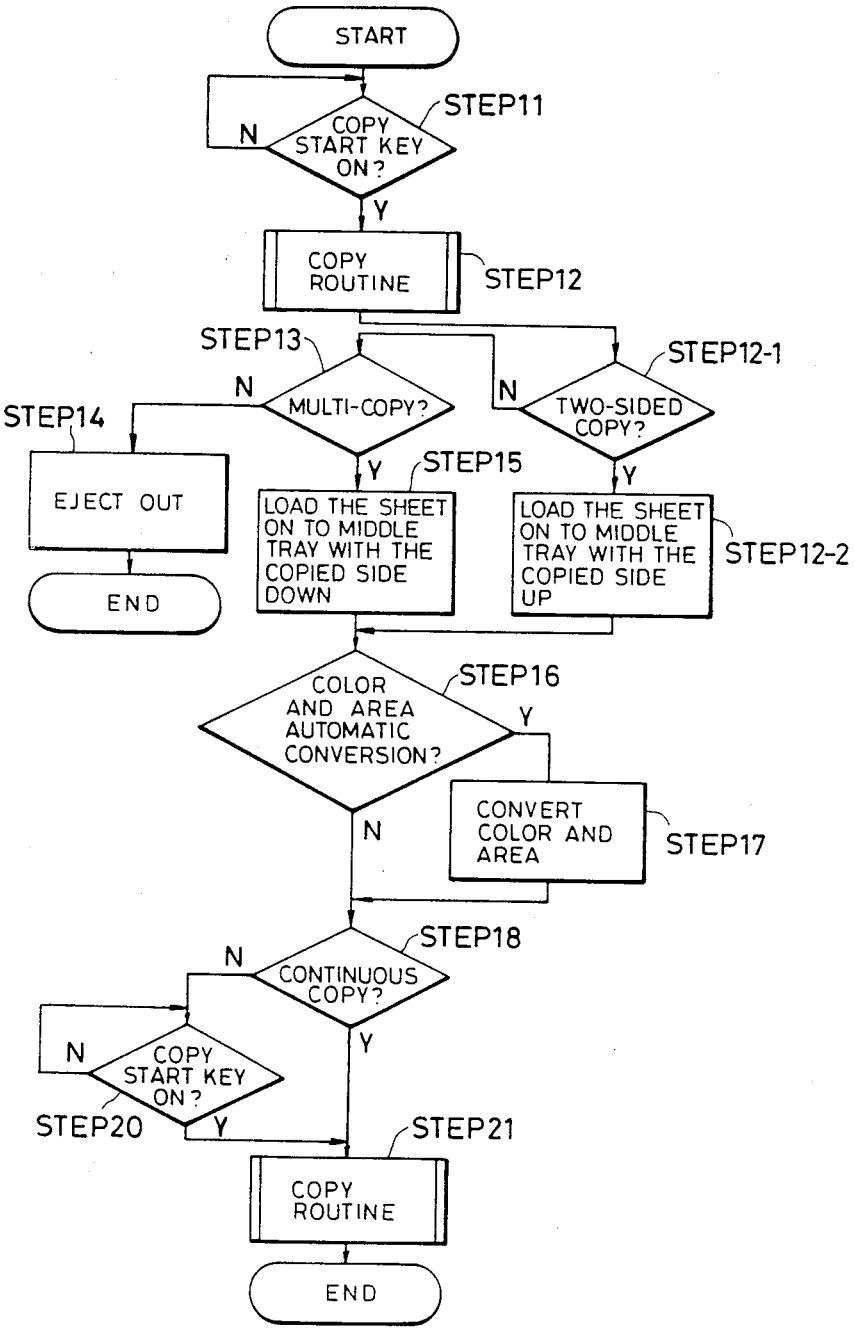
Figures 3, 16:
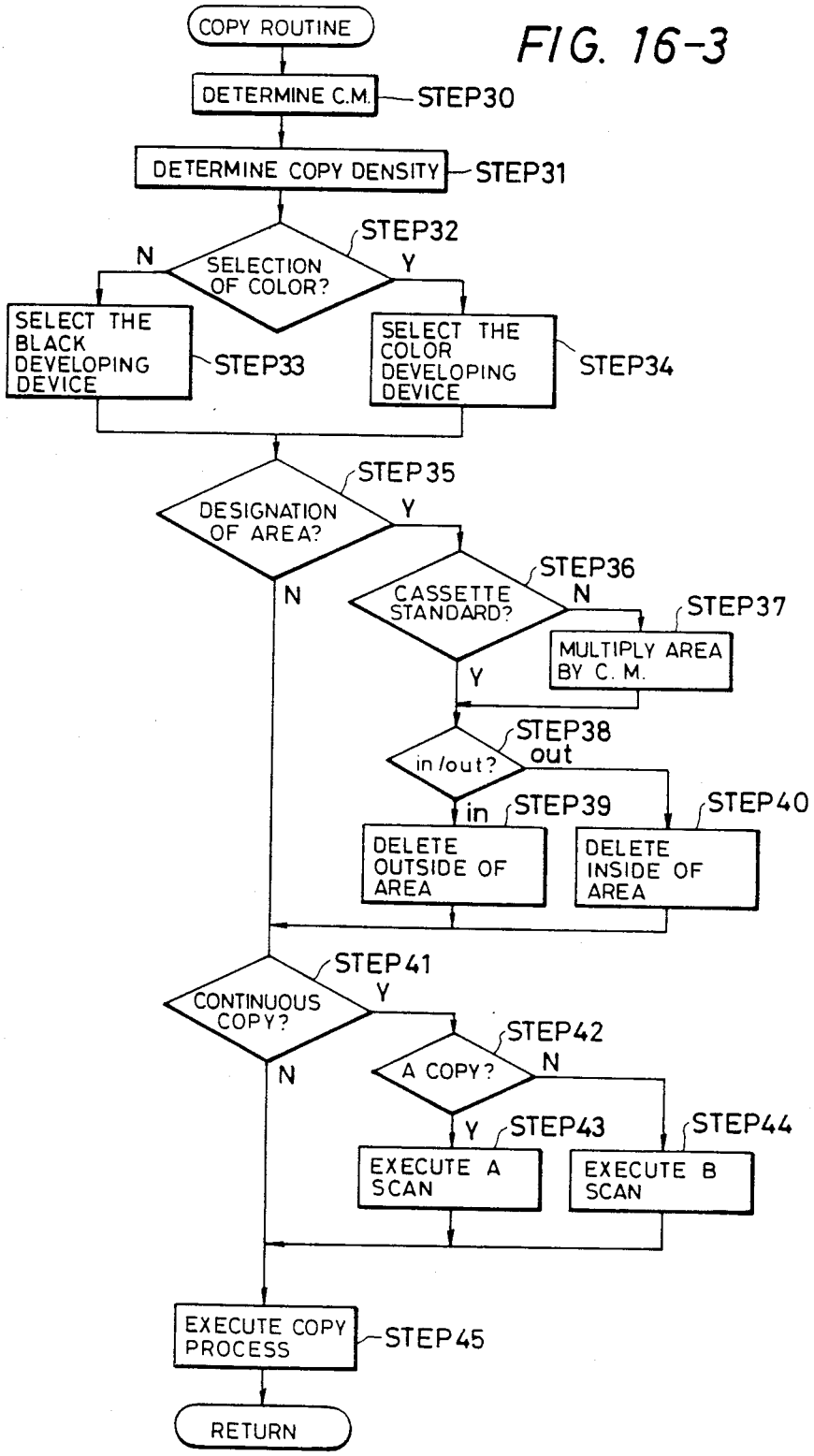
Figures 4, 16:
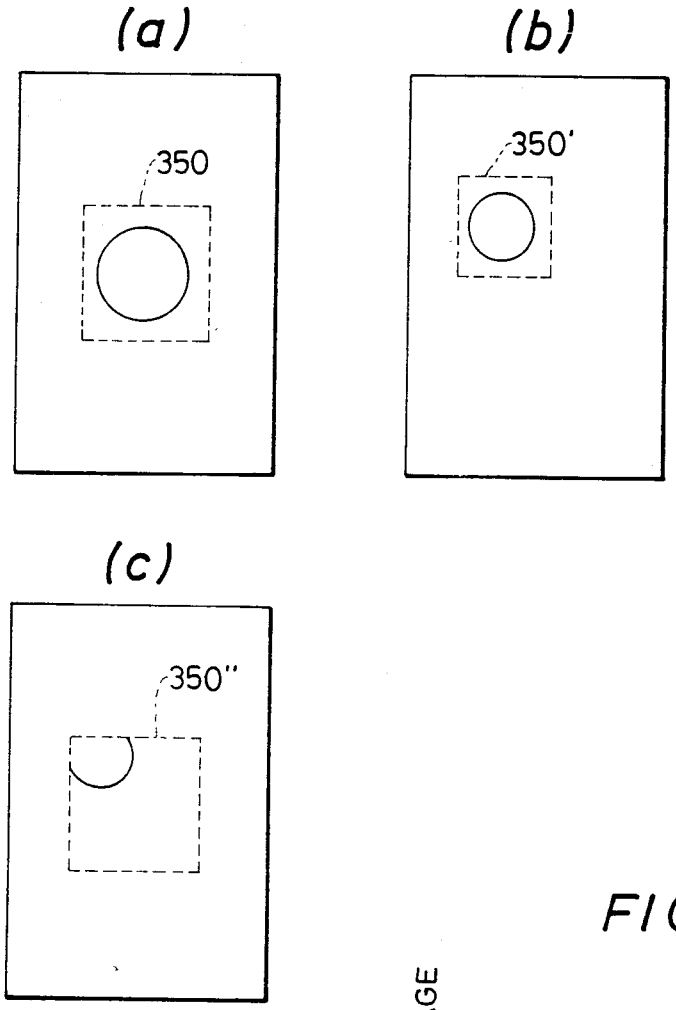

FIG. 16-1 is a flowchart in the case of determining the copy magnification using the digitizer or ten-key. The first coordinates corresponding to the size of original, for example, are first inputted by the light pen or ten-key (step 1). Next, the second coordinates, e.g., coordinates corresponding to a desired copy size are inputted (step 2). For the input of the coordinates, the point on a diagonal line of the origin on the original glass plate is designated. In the case of inputting the coordinates by the ten-key, it is sufficient to input only the X or Y coordinate. The copy magnification (C.M) is calculated from the ratio of the coordinate 2/coordinate 1 which are inputted (step 3). A check is made to see if the calculated copy magnification lines within a possible range for reduction or enlargement of the apparatus or not (step 4). If it lies within the possible range, the magnification at this time is displayed (step 8). If it is out of the possible range, the root of the calculated C.M. is obtained to check whether or not the copy can be completed by executing twice (step 5). A check is made on the basis of the value of the root to see if the C.M. lies within the possible range or not (step 6). If it lies within the possible range, the value of the root obtained is used as the C.M. and the first and second copy magnifications are displayed (step 9). If it is out of the possible range, this fact is warned by displaying on the message display (step 10).

If the first and second C.M. are the same, namely, they are the root of a desired magnification, there is no need to set the second C.M.

The first and second C.M. are not necessarily obtained by the root. The possible C.M. upon the first copy is set to the first C.M. The value of quotient of the division between the C.M. as a divided which was calculated for the first time and the resultant first C.M. as a divisor may be also used as the second C.M. Therefore, several kinds of combinations exist. In addition, it will be obviously understood that unless the picture quality is considered, a further wide magnification can be derived due to the copy of three or four times.

The control of the copy operation will then be described with reference to flowcharts of FIGS. 16-2 and 16-3 with respect to the functions of the continuous copy, multi-copy, area designation, etc. In step 11, a check is made to see if the copy start key is ON or not. If it is ON, the copy routine is executed (step 12).

The copy routine of FIG. 16-3 will be explained. First, the copy magnification (C.M.) and copy concentration are determined and the position of the lens and the developing bias and the like are adjusted (steps 30 and 31). A color selection is discriminated, namely, a check is made to see if the color copy mode has been designated or not (step 32). Unless the color mode is selected, the black developing device is selected (step 33). If the color mode was selected, the color developing device is selected (step 34). A check is then made to see if an area has been designated or not (step 35). If an area was designated, a check is made to see if it is based on the cassette standard of a variable magnification or not (step 36). Unless it is the cassette standard, it is the original standard and the area itself is also enlarged or reduced in accordance with the variable magnification. Therefore, the area which is obtained by multiplying the designated area with the C.M. determined in step 30 is used as the set area (step 37). Therefore, in the case of performing the copy out of or in the area, it is sufficient to light up the LEDs for blanking corresponding to the new area. A check is then made to see into which mode the in/out key has been set, in other words, to see if the copy has been set to the in-mode or out-mode (step 38). In the case of the in-mode, the flag is set so as to delete the portion out of the area by controlling the blank exposure lamp (step 39). In the case of the out-mode, the flag is set so as to delete the portion inside of the area (step 40).

If no area is designated, the above-mentioned control is not executed. A check is made to see if the copy mode is the continuous copy mode or not (step 41). If it is YES, a check is made to see if the A copy (the left half portion of the original put on the original plate is copied) is performed or not to determine the scan width (step 42). If it is the A copy, the flag is set so as to perform the A scan (the left half portion of the original put on the original plate is scanned) (step 43). Unless it is the A copy, the flag is set so as to execute the B scan (the right half portion of the original is scanned) (step 44). Unless it is the continuous copy mode, the scan corresponding to the size of original is performed. The copy processes of the exposure, development, transfer, fixing, and the like are executed in accordance with the conditions which are determined in the above discrimination steps (step 45).

The copy routine is executed as described above. Returning to FIG. 16-2, a check is made to see if the copy mode is the two-sided copy mode or not in step 12-1. If it is YES, the sheet is loaded onto the middle tray with the copied side up (step 12-2). If it is NO, a check is made to see if the copy mode is the multi-copy mode or not in step 13. Unless it is the multi-copy mode, the paper is ejected out onto the paper delivery tray (step 14). If it is the multi-copy mode, the sheet is loaded onto the middle tray with the copied side down (step 15). A check is made to see if the apparatus is in the automatic conversion mode of color and area or not, namely, to see if the key 140 or 141 to perform the automatic conversion of the in/out modes of the area and the automatic color conversion between the first and second copies has been pressed or not (step 16). If the automatic conversion mode has been set, the color and in/out modes of the area are converted (step 17). A check is made to see if the copy mode is the continuous copy mode or not (step 18). If it is NO, the apparatus waits until the copy start key is manually pressed (step 20). If it is YES, the copy routine is again executed (step 21).

FIG. 16-4 shows an example when the area was designated and the copy was performed at a variable magnification in the out-mode.

(a) shows an original and a broken line 350 indicates the designated area. When the copy was executed at a variable magnification on the basis of the original standard, as shown in (b), the area is also enlarged or reduced, so that the image is fully copied within the enlarged or reduced area without a lack of image. However, in the case where the copy was carried out at a variable magnification on the basis of the cassette standard, as shown in (c), the area is not enlarged or reduced and only the image is enlarged or reduced, so that there is also a case where a part of image lacks.

The color conversion in the two-sided copy in the continuous copy mode will then be described. Two originals (A4 size or smaller) are set on the original plate. The continuous copy/two-sided copy selection key 133 is pressed. The automatic color switching key 141 is pressed. Thus, the mode to execute the two-sided copy in different colors in the continuous copy mode is set. When the copy start key 151 is pressed in this mode, only the original set on the left side is scanned and copied on the front side of the recording paper. The paper is then loaded onto the middle tray. At this time, the switching device 41 is set to the upper side, so that the recording paper is loaded onto the middle tray with the copied side up. To change the color, the developing device is automatically changed and the next original is scanned. In this state, the blank exposure lamp is lit on during the scanning of the first original and the latent image of the first original is not formed. The recording paper loaded onto the middle tray is fed to the position of the registration roller and sent toward the drum at the timing when the latent image tip of the second original coincides with the head of the recording paper. In the case of forming a binding margin, the timing is advanced or delayed by a time corresponding to the binding margin. The original image on the right side is copied on the back side of the recording paper and the copied paper is then ejected out of the apparatus. In this way, the two-sided copy in which the images were copied in different colors on the front and back sides is obtained.

If the switching device 41 is set to the lower side, the recording paper is loaded onto the middle tray with the copied side down. Thus, the mutli-copy in which the image of the left original and the image of the right original were copied in different colors is derived.

On one hand, when the two-sided copy or multi-copy is executed, the area can be designated and copied.

The color conversion can be also performed in the mode other than the continuous copy mode. In the cases of the multi-copy mode and two-sided copy mode, after the first scan, the developing device is automatically exchanged and the apparatus waits for the second scan.

(Operation of the CCD)

Figure 17:
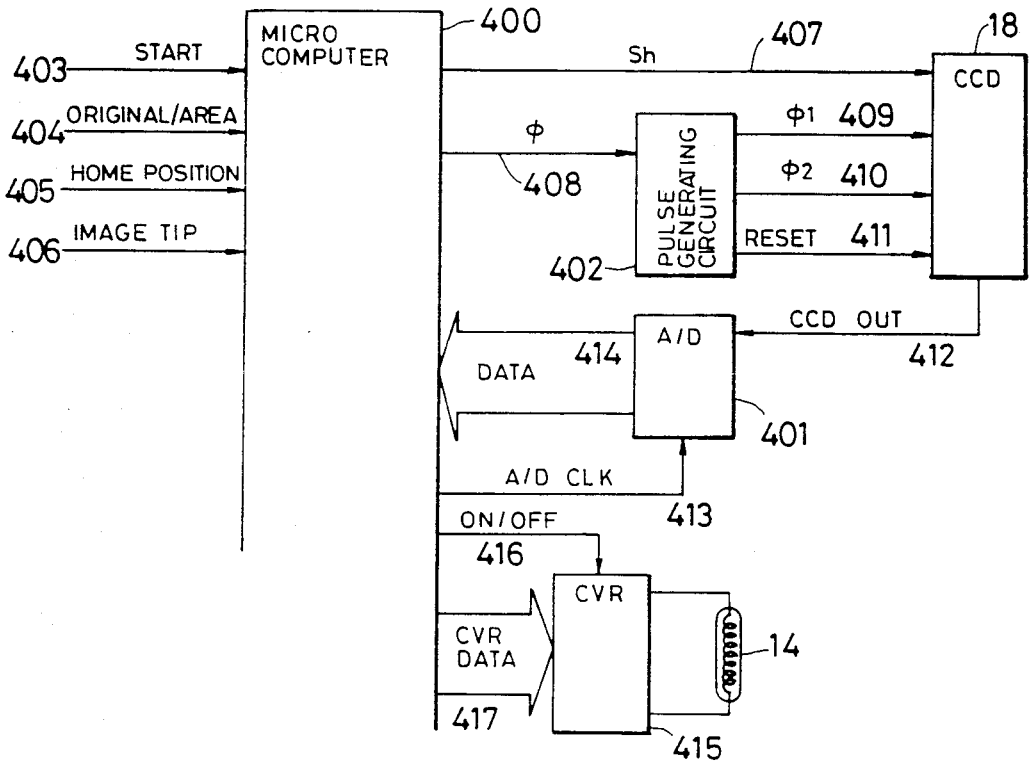
FIG. 17 is a circuit block diagram of an embodiment of the invention.

FIG. 17 is a circuit block diagram of the embodiment. Reference numeral 400 denotes a microcomputer for control; 18 is the CCD image sensor; 401 is an A/D converter; and 402 is a CCD drive pulse generating circuit. Numeral 403 denotes a copy start signal from an external circuit; 404 is likwise an original/area mode switching signal from the external circuit; 405 a home position signal from an optical system home position sensor 15; 406 an image tip signal from the image tip sensor 30; 407 a shift pulse signal of the CCD image sensor 18; 408 a reference clock signal $\phi$; 409 a transfer clock signal $\phi_1$ of the sensor 18; 410 likewise a transfer clock signal $\phi_2$; 411 a reset pulse RS of the sensor 18; 412 an output signal CCD OUT of the sensor 18; 413 a clock signal A/D CLK of the A/D converter 401; 414 a digital signal DATA after the A/D conversion of the output of the sensor 18; 14 the original illumination lamp; 415 a lamp light regulation circuit; 416 ON/OFF signal of the lamp; and 417 a light regulation data.

The light regulation circuit 415 applies to the lamp 14 the voltage which proportionally corresponds to the value of the light regulation data 417.

The operation will be simply explained. First, when the copy start signal 403 is supplied to the microcomputer 400 from the outside, the programs to detect the original and recognize the area, which will be explained later, are read out from a ROM (not shown) and started.

First, the microcomputer 400 outputs the reference clock signal $\phi$ 408 and A/D converter clock signal A/D CLK 413 to the pulse generating circuit 402 and A/D converter 401 using a timer function equipped in the microcomputer 400, respectively. The transfer clocks $\phi_1$ 409 and $\phi_2$ 410 and the reset pulse RS 411 are produced from the reference clock signal $\phi$ 408 by the CCD drive pulse generating circuit 402. The output signal CCD OUT 412 of the CCD image sensor 18, which is driven by these clock pulses, is A/D converted by the A/D converter 401. The digital output DATA 414 is read from the input port of the microcomputer 400. The original/area mode switching signal 404, home position signal 405, and image tip signal 406 will be described with reference to flowcharts, which will be explained later.

When the light regulation is needed for the sensor 18, the light regulation circuit 415 lights up the lamp 14 in response to the ON/OFF signal 416 of the lamp. The microcomputer 400 checks the A/D converted value DATA 414 of the output signal of the sensor 18 and changes the light regulation data CVR DATA 417, thereby regulating the light of the lamp 14 so as to obtain the proper brightness. The value of the light regulation data 417 at this time is stored.

Upon AE execution, the value of the light regulation data 417 is changed by the AE data, which will be explained later, and the lighting voltage of the lamp 14 is controlled so that the proper exposure is obtained.

Figure 18:
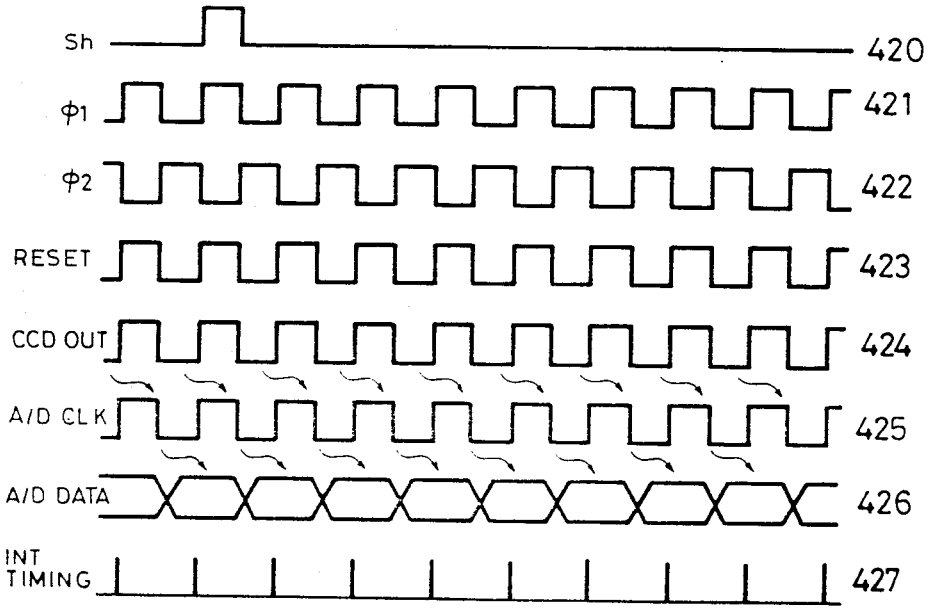
FIG. 18 is a timing chart of control pulses.

FIG. 18 is a timing chart showing the phase relations among a shift pulse sh 420, transfer clocks $\phi_1$ 421, and $\phi_2$ 422, a reset pulse RESET 423, an output signal CCD OUT 424 of the CCD, an A/D converter clock A/D CLK 425, an output DATA 426 of the A/D converter, and an interruption timing 427. The interruption program will be explained later.

Figure 19:
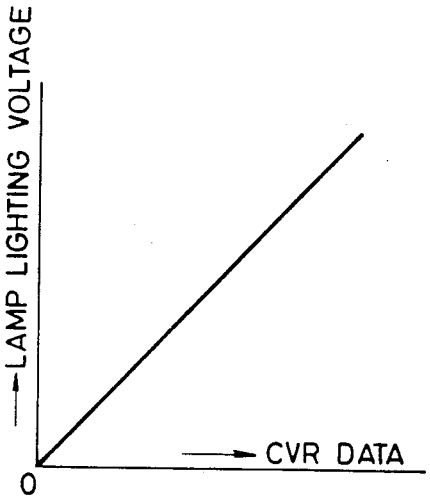
FIG. 19 is a diagram showing the relation between the CVRDATA and the lighting voltage of a lamp.

FIG. 19 is a diagram showing the relation between the CVR DATA and the lighting voltage of the lamp.

Figure 20:
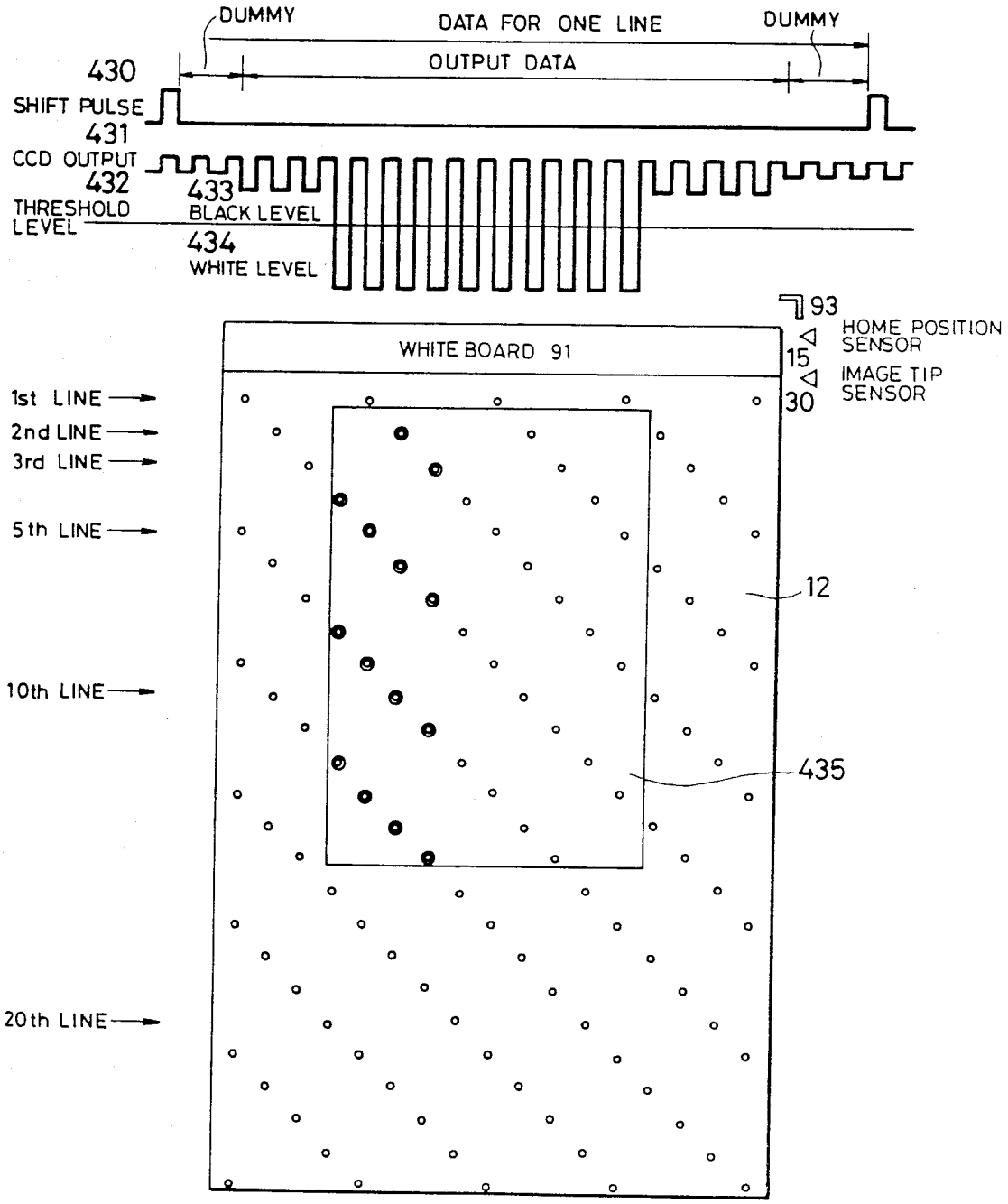
FIG. 20 is a diagram for explaining an original detecting method.

FIG. 20 is a simple principle diagram of the original detecting method. Numeral 430 corresponds to the shift pulse signal sh 407 of the CCD image sensor; 431 corresponds to the output signal CCD OUT of the CCD image sensor; 432 is a threshold level; 91 is a standard white board; 93 an original mounting reference position; 15 is the optical system home position sensor; 30 an image tip sensor; 12 the original plate; 435 an original; and 436 a position where the output of the CCD image sensor is processed by the microcomputer 400.

As shown in the diagram, all of the output data of the CCD image sensor are not processed in each line but processed at regular intervals. This is because no problem will be caused even if the processing speed of the microcomputer 400 is slow. The reason why the processing position is shifted for every line is because it is intended to prevent a deterioration in detection accuracy as possible.

Figure 21:
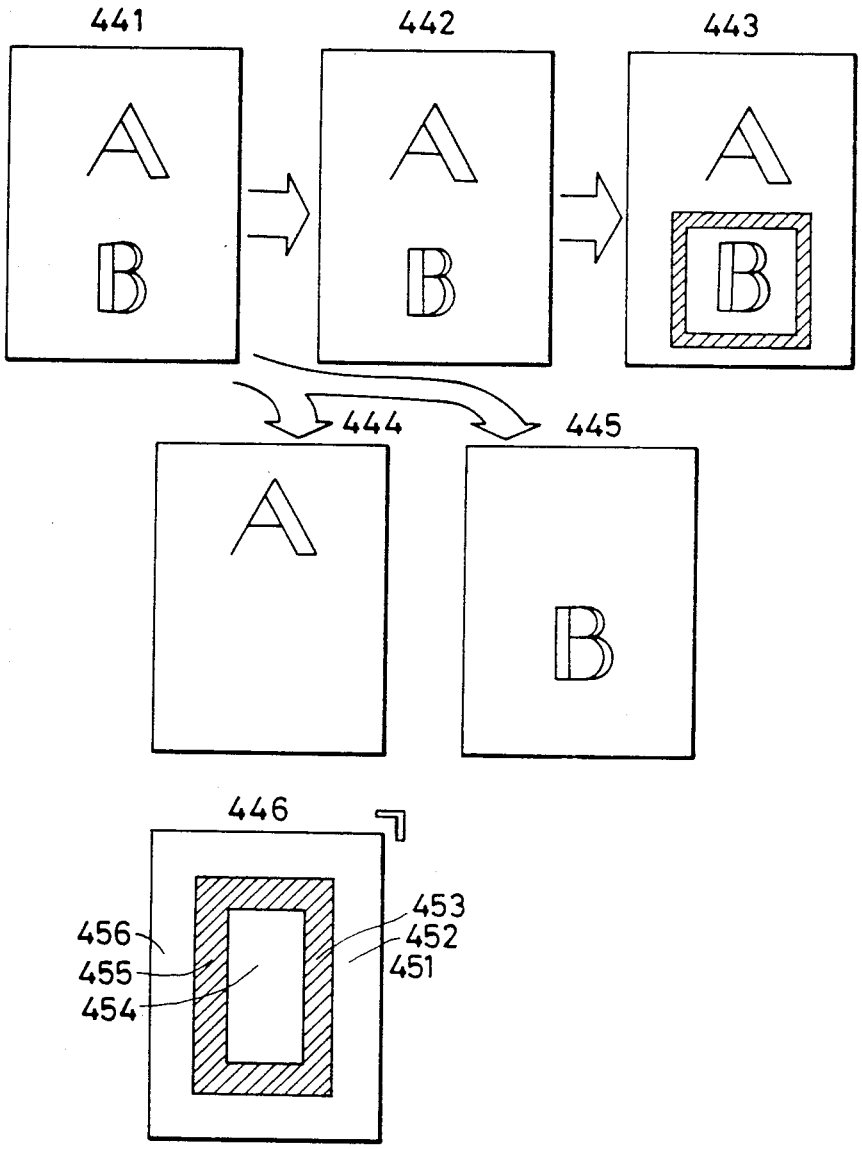
FIG. 21 is a diagram for explaining the designation of areas due to the marking.

FIG. 21 is a conceptional diagram for the area designation by way of the marking. Numeral 441 denotes an original; 442 is a dummy copy which is formed from the original 441 (this dummy copy is used as an original for area recognition by the CCD); 443 shows the dummy copy after the marking; and 444 and 445 are copies obtained.

The procedure will then be described. First, the original 441 is set onto the original plate and the copy operation is executed in the dummy copy mode and the dummy copy 442 in thin color is obtained using the color toner of red or the like. The area to be designated of the dummy copy 442 is marked using a black marking pen or the like as shown at 443. Next, the marked dummy copy is set onto the original plate and the optical system is scanned in the area recognition mode, thereby detecting the marked area. Then, the original 441 is once set onto the original plate and the portion in or out of the area is designated and copied, so that the copy as shown at 444 or 445 can be obtained.

Numeral 446 shows denominations of the respective portions when the marked original is processed in accordance with the programs to detect the original and recognize the area, which will be expalined hereinafter, and numerals 451 to 456 are referred to as the first to sixth stages, respectively.

Figure 22:
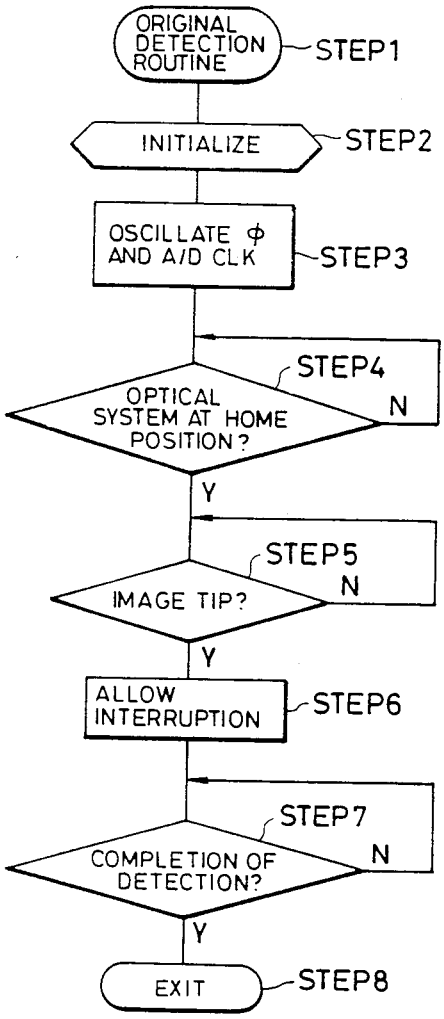
FIGS. 22 to 31 are sequence flowcharts for the detection of an original and recognitiion of areas, respectively.

FIG. 22 is a main flowchart of the programs for original detection and area recognition. The whole control program is constituted such that these programs are executed when it is necessary to detect the original or recognize the area in the copy sequence flow. The flowchart will now be described with reference to FIG. 22. First, when there occurs necessity of the original detection or area recognition as mentioned above, the program based on the flowchart is executed from step 1. In step 2, various counters (clock counter, line counter) and the like in the RAM are first initialized. Next, the reference clock $\phi$408 and clock pulse A/D CLK 413 of the A/D converter are outputted to generate various kinds of pulses to drive the CCD image sensor in step 3. In this embodiment, two clock pulses are oscillated due to the timer function (with the interruption function) built in the microcomputer 400. In the next step 4, the apparatus waits until the optical system home position signal 405 is inputted. When the signal 405 is detectedl, the apparatus waits until the image tip signal 406 is inputted in step 5. When the image tip signal 406 is detected, the interruption is permitted in step 6. In step 7, the apparatus waits until the flag indicative of the end of detection of the original or area is set. If it is set, this program is ended in step 8 and another program follows.

Figure 23:
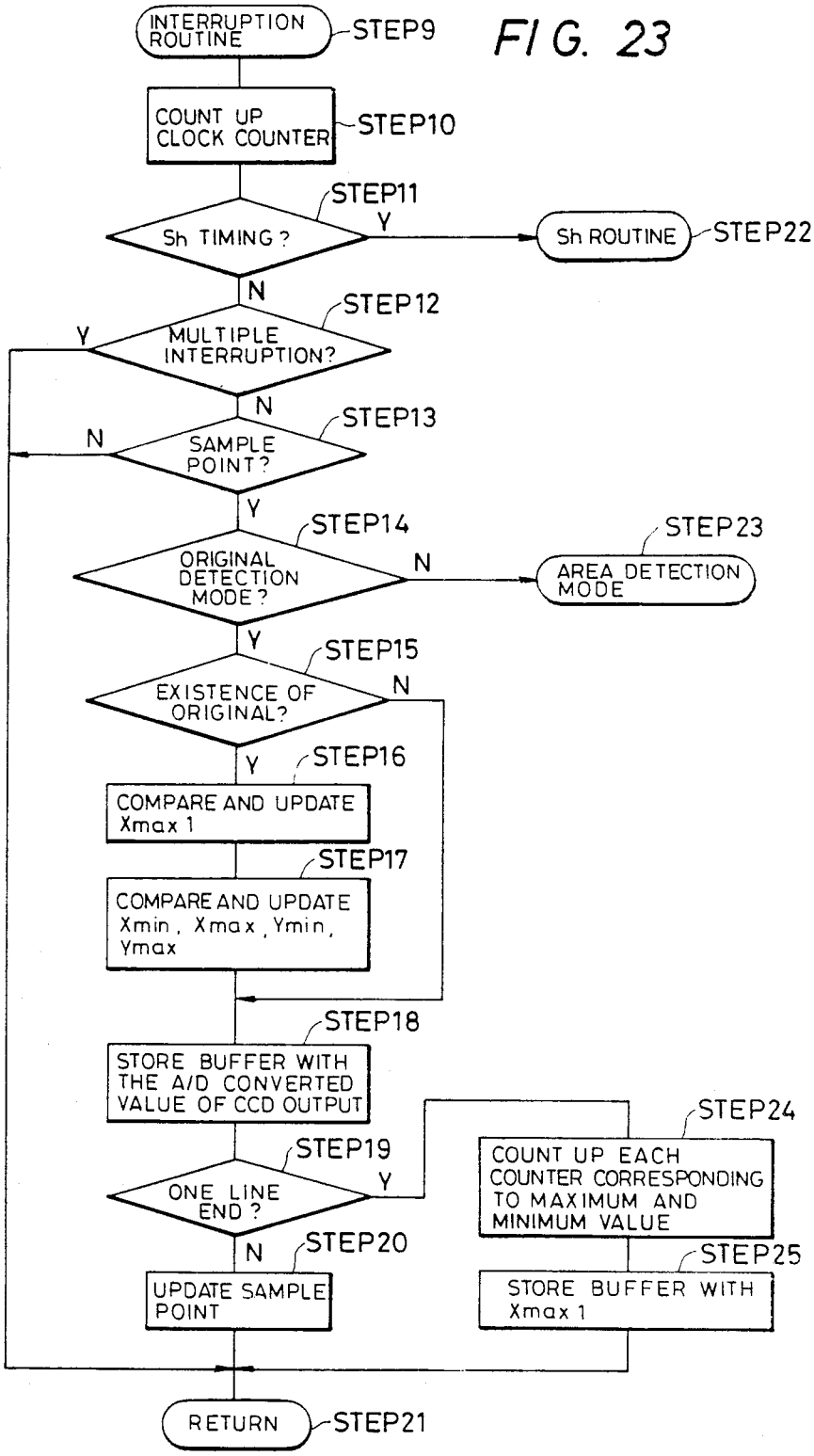

FIG. 23 shows a part of interruption routine of the programs for the original detection and area recognition and is a flowchart which is executed at the timings shown in FIG. 18. When the interruption occurs, this flow starts from step 9. In step 10, the clock counter which counts the number of output data for every series which is time-sequentially outputted from the CCD image sensor is counted up. In step 11, a check is made to see if it comes the timing to output the shift pulse 407 or not from the value of the clock counter. If it is YES, the sh routine as shown in step 22 follows. If it is NO, a check is made from the flag in step 12 to see if the program which is at present being executed is the multiple interruption or not. In the case of the multiple interruption, the interruption program is ended in step 21. If it is NO, in step 13, a check is made to see if it comes the data reading position (timing) or not due to the comparison between the value of the sample point and the value of the clock counter (i.e., in dependence on whether these values coincide or not). If these values differ, step 21 follows and the interruption program is finished. If they coincide, it is determined that the reading position came, and step 14 follows and the mode is decided by the original/area signal 404. In the case of the area detection mode, as shown in step 23, the routine in the area detection mode is executed. In the case of the original detection mode, step 15 follows and a check is made to see if the original is set at the position on the original plate 12 which is indicated by the current values of the line and clock counters due to the comparison between the A/D converted value of the output of the CCD image sensor and the value of the set threshold level. If no original is set, step 18 follows. If the original has been set, step 16 follows and the value of the clock counter is loaded as $X_{max1}$ into the buffer. This value is updated every time the existence of original is detected in one line. Finally, the value of the clock counter in the case of the data in which it was decided at last that the original existed among the data of the line is all stored for every line.

In the next step 17, the maximum value $X_{max}$ and the minimum value $X_{min}$ among the values of the clock counter and the maximum value $Y_{max}$ and the minimum value $Y_{min}$ among the values of the line counter in all of the lines processed so far when it was determined that the original existed are compared with the current values of the clock and line counters. These values are updated as necessary.

In the next step 18, the A/D converted value of the output of the CCD image sensor is stored into the buffer of one line. In step 19, a check is made from the value of the clock counter to see if the data processes of one line have been completed or not. If it is NO, the sample point which is the collecting position of the AE data is updated in step 20. Then, step 21 follows and the interruption program is ended. If it is YES in step 19, step 24 follows and each AE data counter corresponding to the maximum and minimum values from among the data from the first data when it was determined that the original existed to the last data when it was decided that the original existed among the A/D converted values of the output of the CCD image sensor of one line is counted up. However, when the area for collection of the AE data has been set, the AE data counters only in this area are counted up.

The AE data counters are prepared for all possible values with regard to the maximum and minimum values of each line and their AE data become the data for executing the AE. In the next step 25, the value of $X_{max1}$ is stored into the RAM which is peculiar to the line so that it is not updated by the next line process. Then, step 21 follows and the interruption program is ended.

Figure 24:
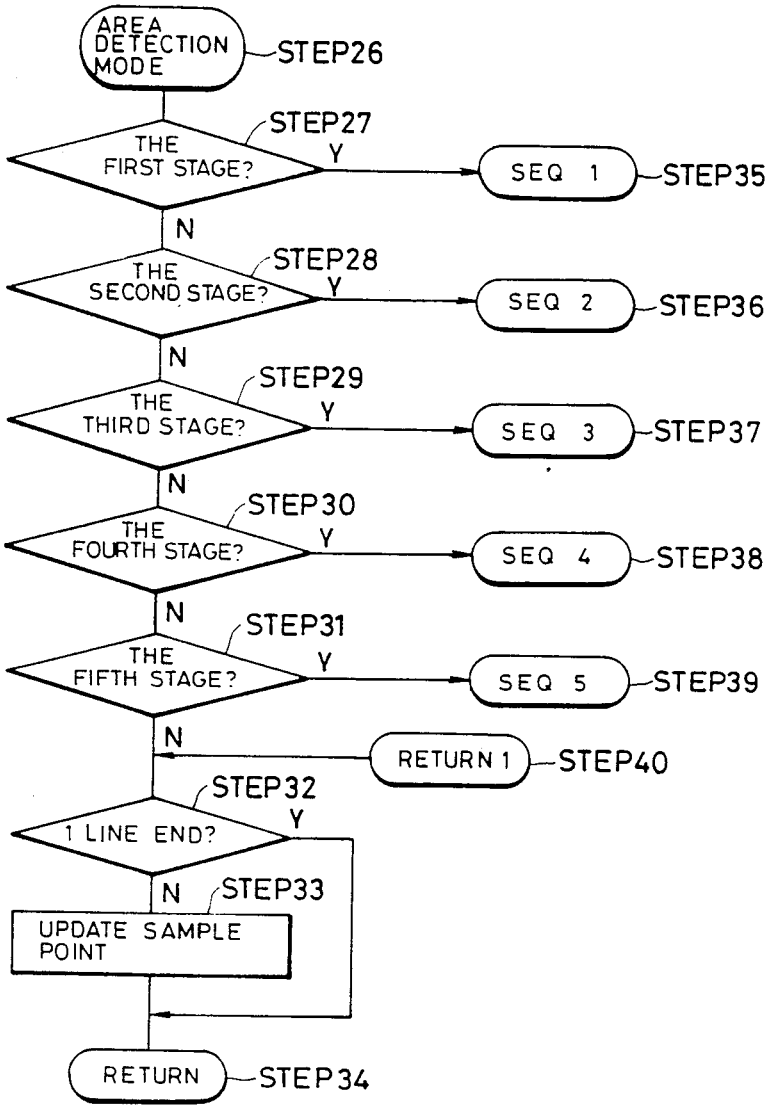

FIG. 24 shows a part of interruption routine of the programs for the original detection and area recognition. If the area detection mode was determined in step 14 in FIG. 23, step 26 in FIG. 24 follows as shown in step 23 in FIG. 23. In step 27, a check is made from the flag to see if the stage is the first stage in FIG. 21 or not. In the case of the first stage, the $SEQ_1$ routine follows as shown in step 35. In a manner similar to the above, each check is made to see if the stage is the second, third, fourth, and fifth stages in FIG. 21 or not from the flags in steps 28 to 31. If they are YES, respectively, the $SEQ_2$, $SEQ_3$, $SEQ_4$, and $SEQ_5$ routines follow as shown in steps 36 to 39. If they are NO, step 32 follows.

In step 32, a check is made to see if the data process of one line has been completed or not by the value of the clock counter. If it is YES, step 34 follows and the interruption program is ended. If it is NO, the sample point is updated in step 33 and then step 34 follows and the interruption program is finished.

Figure 25:
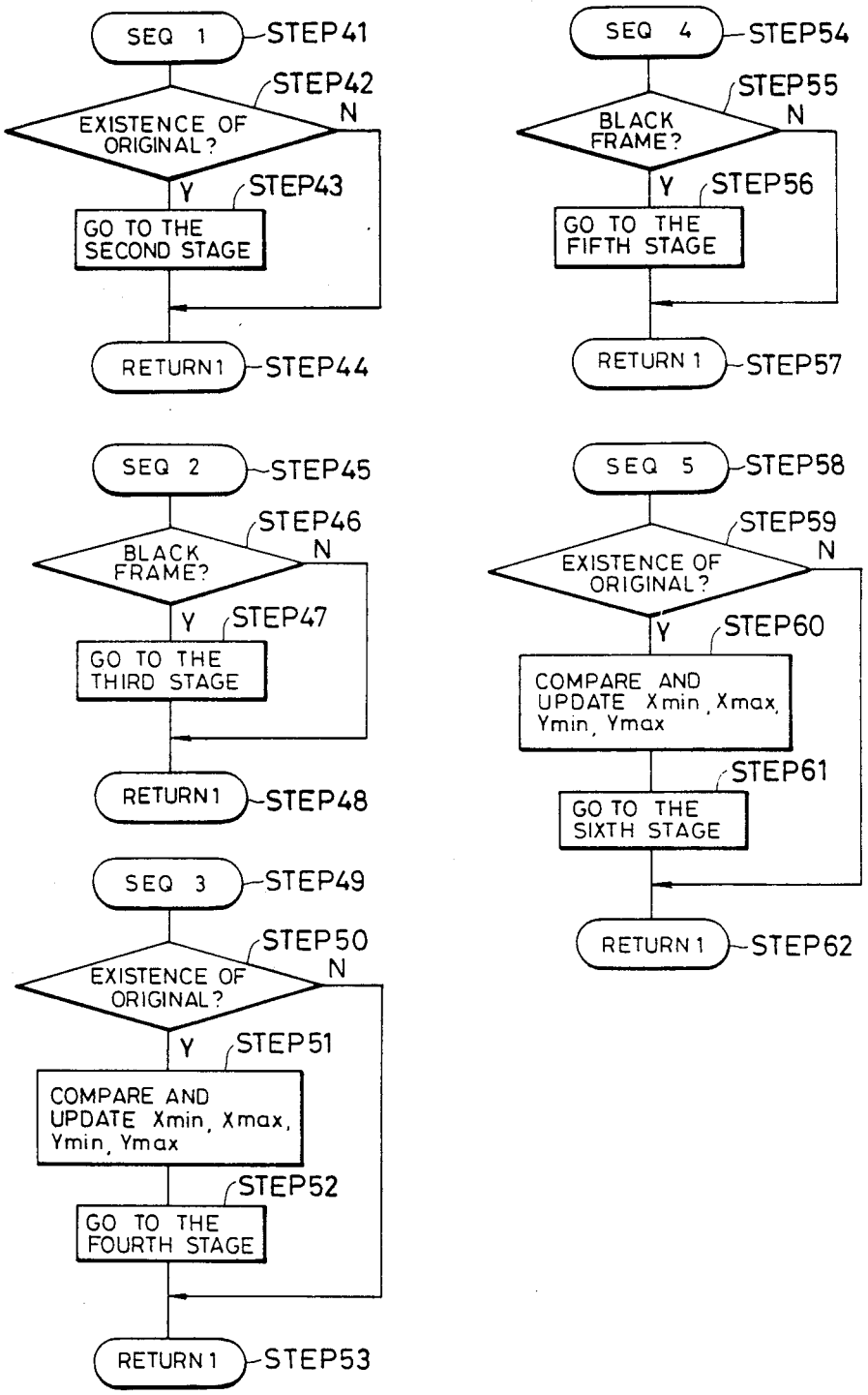

FIG. 25 shows a part of the interruption routine of the programs for the original detection and area recognition. After steps 27, 28, 29, 30, and 31 in FIG. 24, steps 41, 45, 49, 54, and 58 in FIG. 25 are executed, respectively.

When the processing routine advances to step 41, the A/D converted value of the output of the CCD image sensor is compared with the value of the set threshold level in step 42 and a check is made to see if the original has been set at the position on the original plate 12 which is indicated by the current values of the line and clock counters. If no original exists, step 44 follows and step 40 in FIG. 24 is executed. If the original existed, the flag is set to the second stage in step 43. And after step 44, step 40 in FIG. 24 is executed.

When the processing routine advances to step 45, the A/D converted value of the output of the CCD image sensor is then compared with the value of the set threshold level and a check is made to see if the level indicates the black frame level or not in step 46. If it is NO, step 40 in FIG. 24 is executed through step 48. If it is the black frame level, the flag is set to the third stage in step 47 and step 40 in FIG. 24 is then execueed through step 48.

When the processing routine advances to step 49, a check is similarly made to see if the original has been set or not in step 50. If no original exists, step 53 follows and step 40 in FIG. 24 is then executed. If the original existed, step 50 follows and the values of $X_{min}$, $X_{max}$, $Y_{min}$, and $Y_{max}$ are compared with the current values of the line and clock counters and updated. In the next step 52, the flag is set to the fourth stage and step 53 follows and step 40 in FIG. 24 is then executed.

When the processing routine advances to step 54, a check is made to see if the level is the black frame level or not in step 55 in a manner similar to the above. If it is NO, step 57 follows and step 40 in FIG. 24 is executed. If it is the black frame level, the flag is set to the fifth stage in step 56 and step 40 in FIG. 24 is then executed through step 57.

When the processing routine advances to step 58, a check is made to see if the original has been set or not in step 59 in a manner similar to the above. If no original is set, step 40 in FIG. 24 is executed through step 62. If the original existed, the values of $X_{min}$, $X_{max}$, $Y_{min}$, and $Y_{max}$ are compared with the current values of the line and clock counters and updated in step 60. In the next step 61, the flag is set to the sixth stage and then step 40 in FIG. 24 is executed through step 62.

Figure 26:
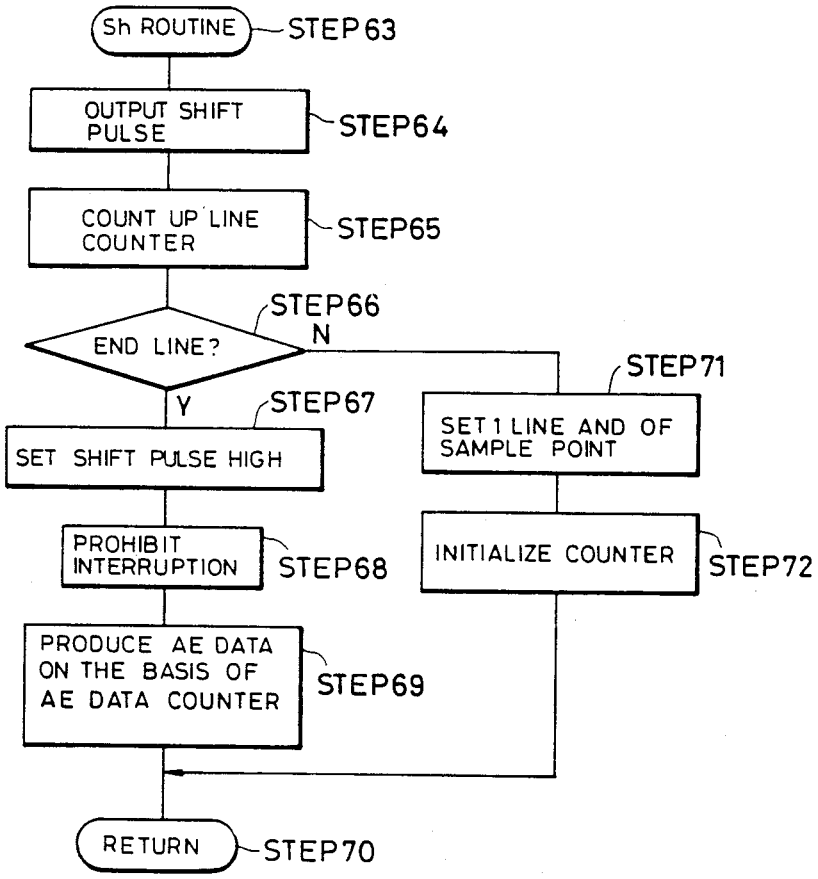

FIG. 26 shows a part of the interruption routine of the programs for the original detection and area recognition. When it is determined that it came the timing to output the shift pulse (407) in step 11 in FIG. 23, step 63 in FIG. 26 follows as shown in step 22 in FIG. 23. In the next step 64, the shift pulse 407 is outputted at the timing as shown in FIG. 18. The line counter is counted up in step 65. Then, a check is made to see if the last line to be processed has been completed or not in step 66 on the basis of the value of the line counter. If it is YES, step 67 follows and the output level of the shift pulse 407 is fixed to a high level. The interruption is inhibited in step 68. The AE data is produced in step 69. Then step 70 follows and the interruption program is ended. If it is NO in step 66, step 70 follows and the sample point and the value of one line end are set. The counters and the like are initialized in step 71. Then, step 72 follows and the interruption program is ended.

Figure 27:
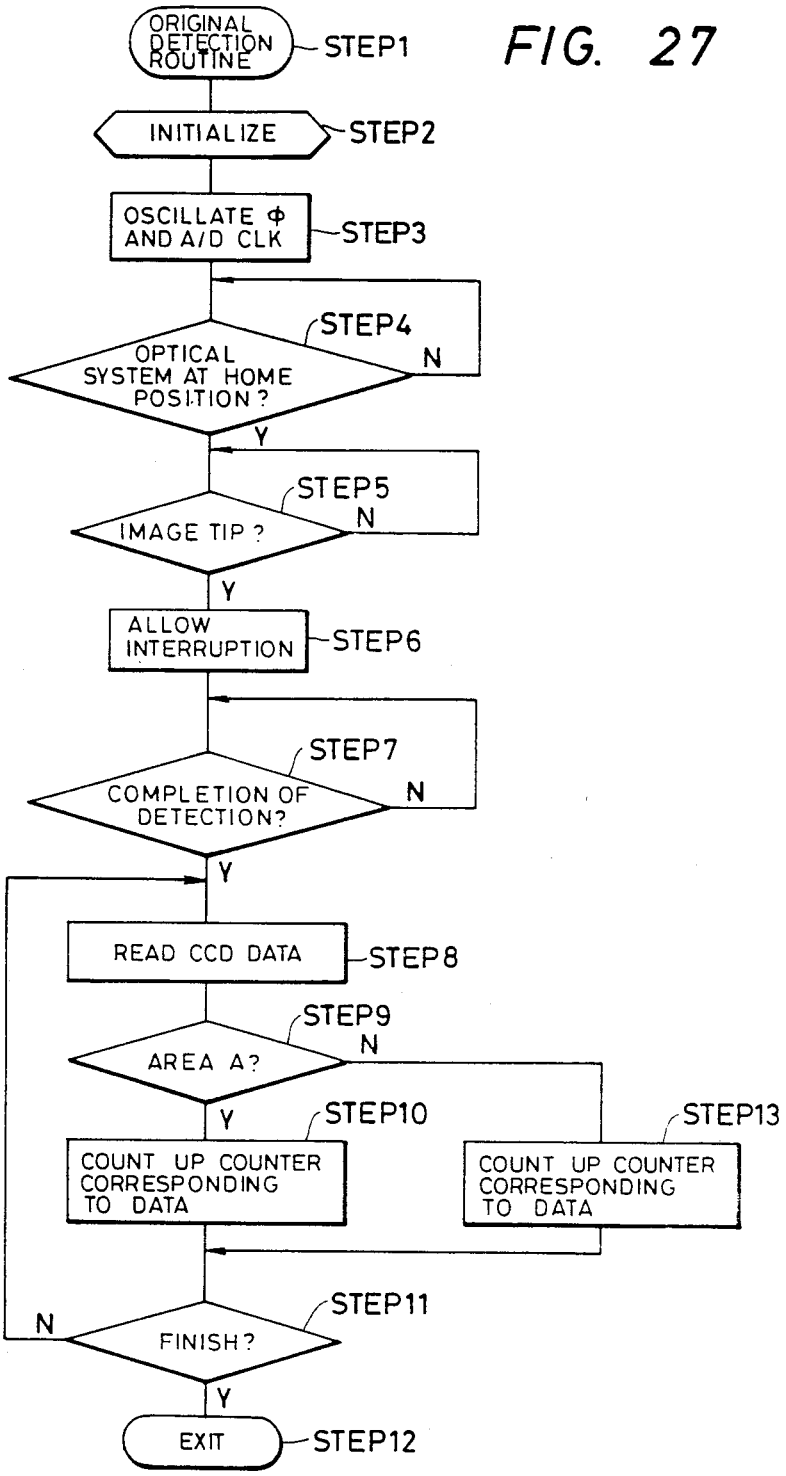

FIG. 27 is a main flowchart of the programs for the original detection and area recognition when a page memory was used. The whole control program is constituted such that when there occurs necessity of original detection or area recognition in the copy sequence flow, this program is executed. The flowchart will then be explained with reference to FIG. 27. First, as mentioned above, when a necessity of the original detection or area recognition occurs, the program based on the flowchart is executed after step 1. In step 2, various counters (clock counter, line counter) and the like in the RAM are first initialized. In the next step 3, the reference clock $\phi$408 and the clock pulse A/D CLK 413 of the A/D converter are outputted to generate various pulses to drive the CCD image sensor. In this embodiment, two clock pulses are oscillated due to the timer function (with the interruption function) provided in the microcomputer 400. Then, the apparatus waits until the optical system home position signal 405 is inputted in step 4. If the signal 405 was detected, the apparatus then waits until the image tip signal 406 is inputted in step 5. If the signal 405 was detected, the interruption is permitted in step 6. The apparatus waits until the flag indicative of the end of original or area detection is set in step 7. If the flag was set, the CCD output data in the page memory is sequentially read in step 8. A check is made to see if the area A (FIG. 21) has been set or not in step 9. If it is YES, the AE data counter corresponding to the data in the area A is counted up in step 10. If it is NO, the AE data counter corresponding to the data in the area B (FIG. 21) is counted up in step 13. Steps 8 to 11 are repeated until the processes regarding all of the data are finished in step 11. If the processes of all of the data have been completed, step 12 follows and this program is ended.

Figure 28:
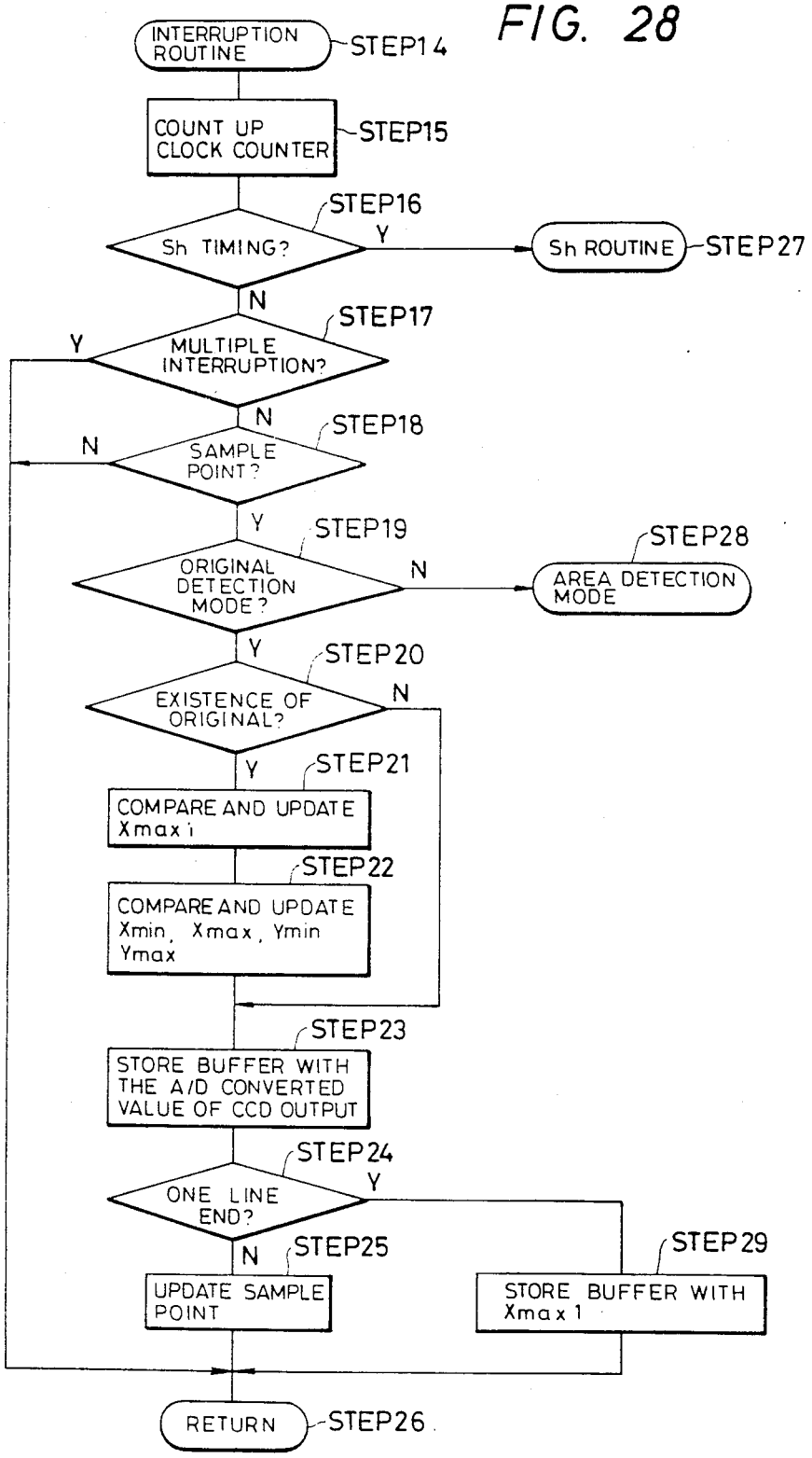

FIG. 28 shows a part of the interruption routine of the programs for the original detection and area recognition and is a flow which is executed at the timings as shown in FIG. 18. When the interruptionoccurs, this flow is started from step 14. The clock counter which counts the number for every series of the output data which is time-sequentially outputted from the CCD image sensor is counted up in step 15. A check is made in step 16 to see if it comes the timing to output the shift pulse 407 from the value of the clock counter. If it came the timing, the sh routine is executed as shown in step 27. If it is NO, a check is made by the flag to see if the program which is at present being executed is the multiple interruption or not in step 17. In the case of the multiple interruption, step 26 follows and the interruption program is ended. If it is NO, step 18 follows and a check is made to see if it comes the data reading position or not by comparing the value of the sample point with the value of the clock counter. If these values differ, step 26 follows and the interruption program is ended. If they coincide, it is determined that the reading position came and step 19 follows to determine the mode by the original/area mode switching signal 404. If it is the area detection mode, the routine of the area detection mode is executed as shown in step 28. If it is the original detection mode, step 20 follows and the A/D converted value of the output of the CCD image sensor is compared with the value of the set threshold level, thereby detecting whether the original has been set at the position on the original plate 12 which is indicated by the current values of the line and clock counters or not. If no original is set, step 23 follows. If the original existed, step 21 follows. The value of the clock counter is stored as $X_{max1}$ into the buffer in step 21. This value is updated each time the existence of the original was detected in one line. The value of the clock counter in the case of the data in which it was finally determined that the orignal existed among the data of the line is finally all stored for every line.

In the next step 22, the maximum value $X_{max}$ and the minimum value $X_{min}$ among the values of the clock counter and the maximum value $Y_{max}$ and the minimum value $Y_{min}$ among the values of the line counter when it was determined that the original existed in all of the lines processed so far are compared with the current values of the clock and line counters. These values are updated as necessary.

In the next step 23, the A/D converted value of the output of the CCD image sensor is stored into the buffer of one page. A check is made by the value of the clock counter to see if the data processes of one line have been completed or not in step 24. If it is NO, the sample point is updated in step 25 and step 26 then follows and the interruption program is ended. If it is YES, the value of $X_{max1}$ which is the last data when it was determined that the original existed among the A/D converted values of the output of the CCD image sensor of one line is stored into the RAM which is peculiar to this line in step 29 such that it is not updated by the next line process. Then step 26 follows and the interruption program is ended.

Figure 29:
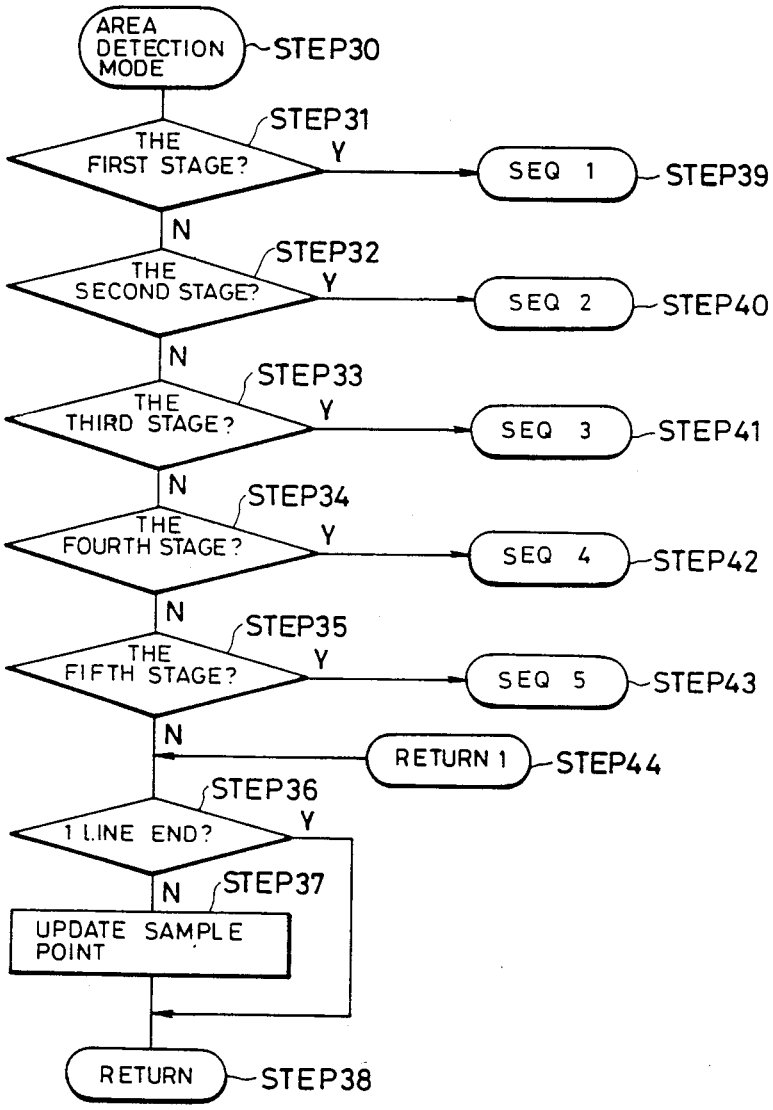

FIG. 29 shows a part of the interruption routine of the programs for the original detection and area recognition. In the case of the area detection mode in step 19 in FIG. 28, step 30 in FIG. 29 is executed as shown in step 28 in FIG. 28. In step 31, a check is made to see if the first stage in FIG. 29 has been set or not from the flag. In the case of the first stage, the $SEQ_1$ routine is executed as shown in step 39. In a manner similar to the above, checks are made by the flags to see if the second, third, fourth, and fifth stages in FIG. 29 have been set or not in steps 32 to 35, respectively. If they are YES, the $SEQ_2$, $SEQ_3$, $SEQ_4$, and $SEQ_5$ routines are executed as shown in steps 40 to 43, respectively. If they are NO, step 36 follows.

In step 36, a check is made by the value of the clock counter to see if the datta processes of one line have been finished or not. If it is YES, step 38 follows and the interruption program is finished. If it is NO, the sample point is updated in step 37 and then step 38 follows and the interruption program is finished.

Figure 30:
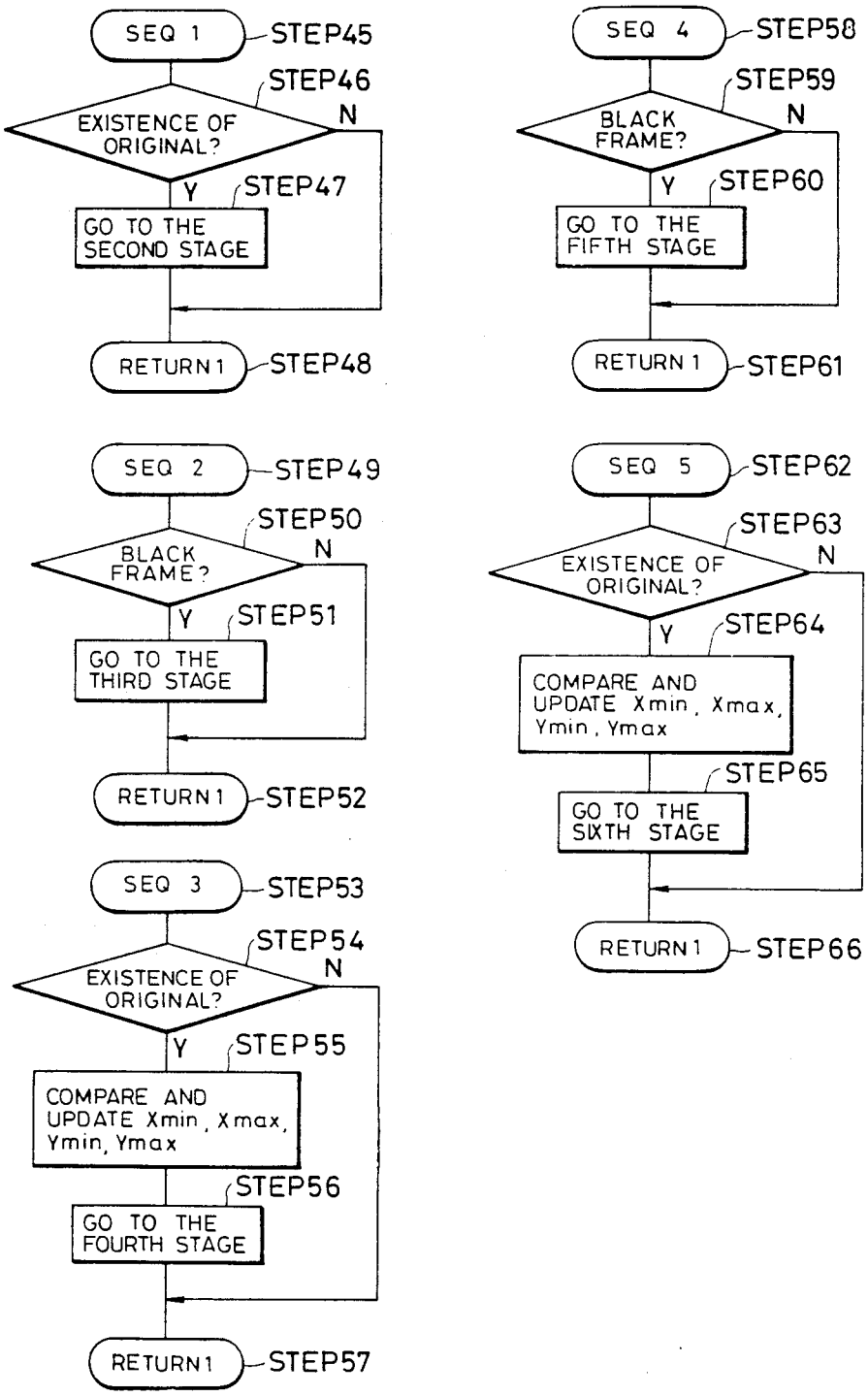

FIG. 30 shows a part of the interruption routine of the programs for the original detection and area recognition. After steps 39, 40, 41, 42 and 43 in FIG. 29, steps 45, 49, 53, 58, and 62 in FIG. 30 are executed.

When the processing routine advances to step 45, the A/D converted value of the output of the CCD image sensor is then compared with the value of the set threshold level and a check is made to see if the original has been set at the position on the original plate 12 which is indicated by the current values of the line and clock counters or not in step 46. If no original is set, step 48 follows and then step 44 in FIG. 29 is executed. If the original existed, the flag is set to the second stage in step 47 and then step 48 follows and step 44 in FIG. 29 is executed.

When the processing routine advances to step 49, the A/D converted value of the output of the CCD image sensor is then compared with the value of the set threshold level and a check is made to see if the level is the black frame level or not in step 50. If it is NO, steop 44 in FIG. 29 is executed after step 52. If it is the black frame level, the flag is set to the third stage in step 51. Then step 52 follows and step 44 in FIG. 29 is executed.

When the processing routine advances to step 53, the existence of the original is similarly discriminated in step 54. If no original is set, step 57 follows and then step 44 in FIG. 29 is executed. If the original existed, the values of $X_{min}$, $X_{max}$, $Y_{min}$, and $Y_{max}$ are compared with the current values of the line and clock counters and updated in step 55. In the next step 56, the flag is set to the fourth stage and step 44 in FIG. 29 is executed thriough step 57.

When the processing routine advances to step 58, a check is made to see if the level is the black frame level or not in step 59 in a manner similar to the above. If it is NO, step 44 in FIG. 29 is executed from step 61. If it is YES, the flag is set to the fifth stage in step 60 and then step 44 in FIG. 29 is executed through step 61.

When the processing routine advances to step 62, and the presence or absence of the original is similarly discriminated in step 63. If no original is set, step 66 follows and then step 44 in FIG. 29 is executed. If the original existed, the values of $X_{min}$, $X_{max}$, $Y_{min}$, and $Y_{max}$ are then compared with the current values of the line and clock counters and updated in step 64. The flag is set to the sixth stage in step 65 and then step 44 in FIG. 29 is executed through step 66.

Figure 31:
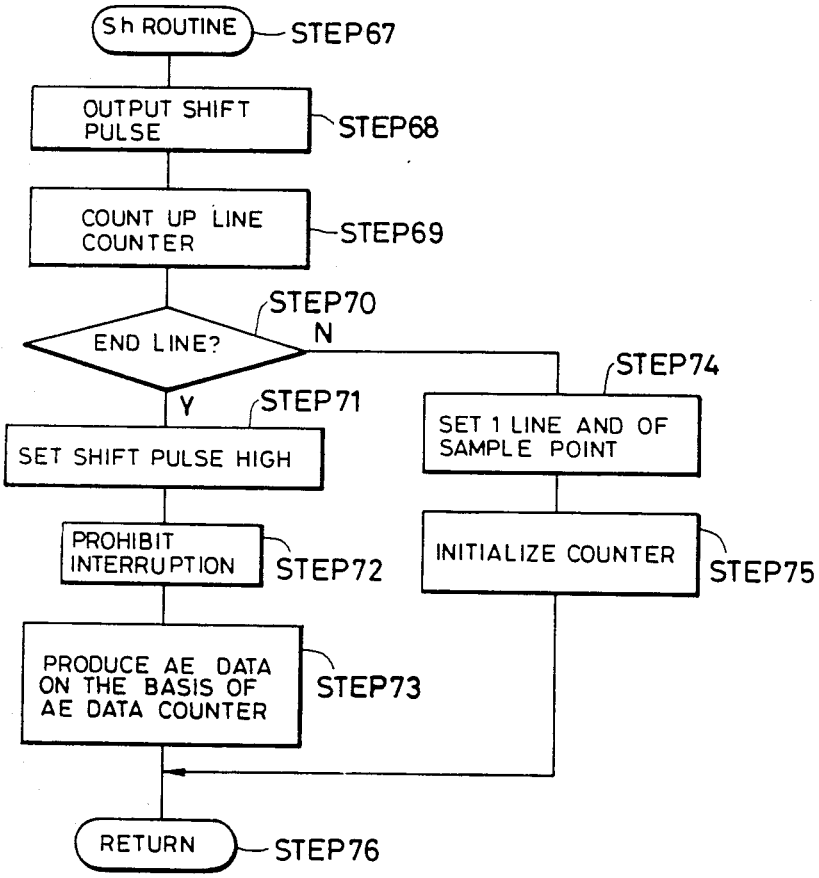

FIG. 31 shows a part of the interruption routine of the programs for the original detection and area recognition. If it was determined in step 16 in FIG. 28 that it came the timing to output the shift pulse 407, step 67 in FIG. 31 is executed as shown in step 27 in FIG. 28. The shift pulse 407 is outputted at the timing as shown in FIG. 18 in step 68. The line counter is counted up in step 69. A check is then made by the value of the line counter to see if the data process of the last line to be processed has been completed or not in step 70. If it is YES, step 74 follows and the output level of the shift pulse 407 is fixed to high. The interruption is inhibited in step 72. The AE data is produced in step 73. The interruption program is then ended through step 76. If it is NO in step 70, step 74 follows and the sample point and the value of the one line end are set. The counters and the like are initialized in step 75 and the interruption program is finished through step 76.

Figure 32:
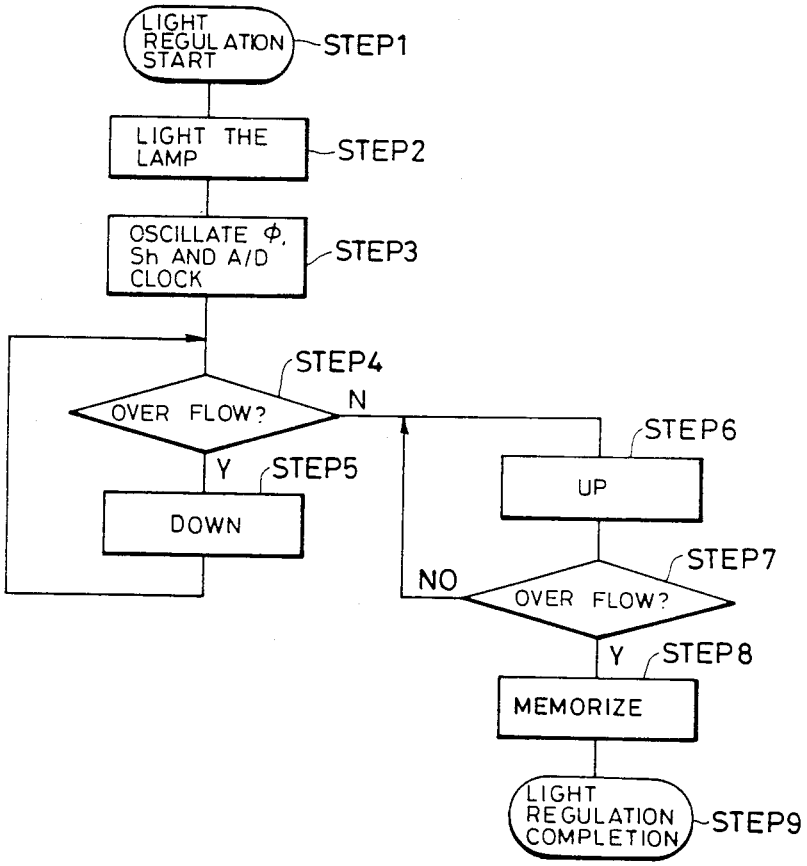
FIG. 32 is a sequence flowchart for the light regulation.

FIG. 32 shows a flowchart of the light regulation program. If the light regulation for the CCD image sensor is needed in the sequence, the program based on this flowchart is executed. After step 1, the lamp is first lit up by the ON/OFF signal of the lamp in step 2. The light regulation data at this time has a predetermined value. In the next step 3, the reference clock $\phi$408, A/D converter clock A/D CLK 413, and shift pulse sh 407 are outputted and the CCD image sensor is driven. Then, a check is made in step 4 to see if the value of the digital signal DATA 414 after the A/D conversion of the output of the CCD imae sensor has overflowed or not. If it has overflowed, the light regulation data 417 is counted down by only one in step 5 and the processing routine is returned to step 4. This loop is continued until the value of the DATA 414 doesn't overflow. If it is NO in step 4, the light regulation data 417 is counted up in step 6. In the next step 7, the overflow is checked and the processing routine is returned to step 6 when no overflow occurs. This loop is continued until the overflow occurs. When the overflow occurs, the light regulation data is stored in step 8 and the light regulation program is ended in step 9.

Figure 33:
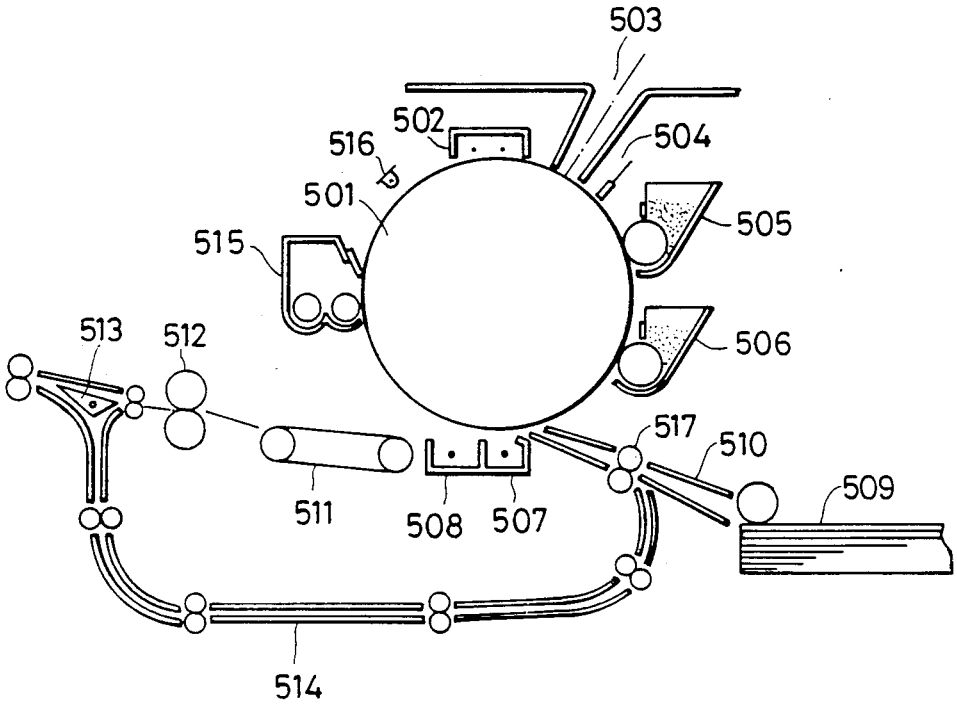
FIG. 33 is a diagrammatical cross sectional view of another embodiment of the present invention.

FIG. 33 is a cross sectional view showing another embodiment of the present invention. In the diagram, reference numeral 501 denotes a photo sensitive drum. After the drum 501 was uniformly charged by a charging device 502, an electrostatic latent image is formed on the drum 501 in correspondence to a light image 503 from the original. An LED array 504 is ordinarily used to erase the charges of the non-image section; however, it is also used to erase an arbitrary area of the original in this embodiment.

Figure 34:
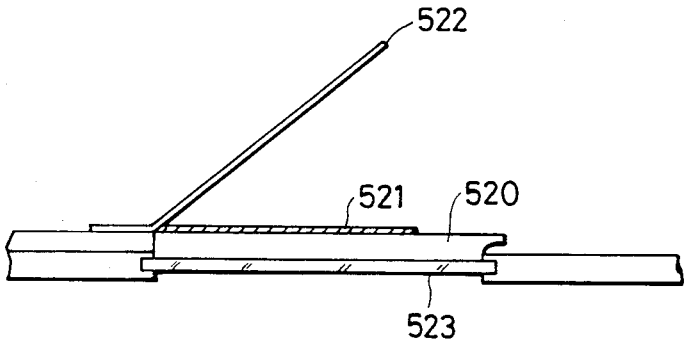
FIG. 34 is a cross sectional view showing the state when an original is put on an original pressing plate.
Figure 35:
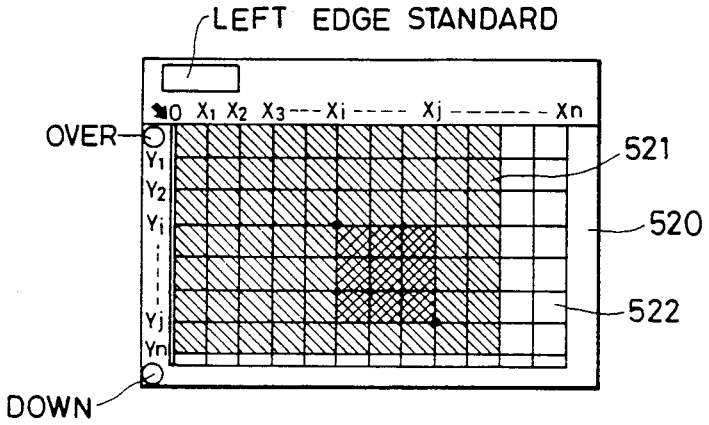
FIG. 35 is a diagrammatical top view of an original pressing plate when it is looked down.

To designate an arbitrary area of the original, an original 521 is set on an original pressing plate 520 with the image side up as shown in FIG. 34. The original position can be accurately known by covering a menu spot sheet 522 on the set original 521 (FIG. 35). The original is set such as to abut on the reference position on the upper left side of the original pressing plate 520. The original is displayed such that its left end becomes a reference. A digitizer is embedded on the plate 520. By pushing two points ($X_1$, $Y_1$) and ($X_2$, $Y_2$) on a diagonal line in the designated area, it is possible to designate the area in which these two points are located at the diagonal corners.

Figure 36:
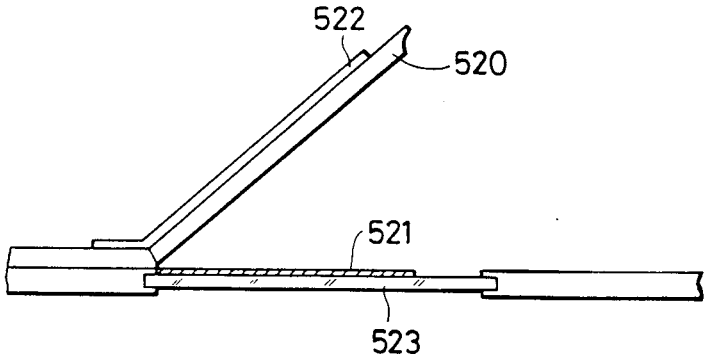
FIG. 36 is a diagrammatical cross sectional view when an original is put on an original glass plate.
Figure 37:
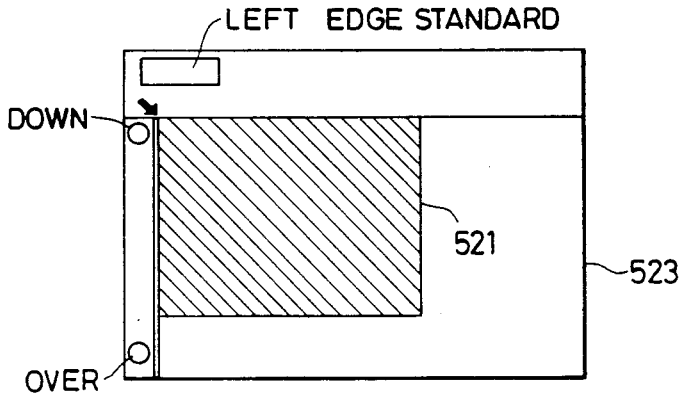
FIG. 37 is a diagrammatical top view when an original is put on the original glass plate in the case where they are looked down.

Although the area designated original 521 is set on the original glass as shown in FIG. 36, its front and back sides are reversed. As shown in FIG. 37, the left upper portion of the original glass 521 is used as an abutment reference position and the original is displayed such that its left end becomes a reference. Therefore, the upper and lower sides in the Y direction of the original are reversed.

In this way, the original 521 is set upside down to the original glass plate 523 through the original pressing plate 520 such that the left end of the original becomes a reference. Thus, the value of position read by digitizer is substantially identical to the actual position of the original 521 over the glass plate 523 with respect to the X direction; however, there is the opposite relation between those positions with respect to the Y direction.

Figure 38:
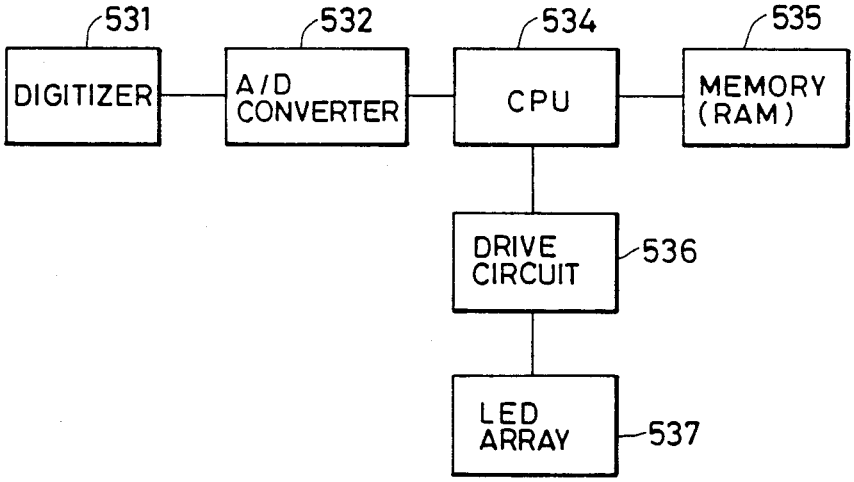
FIG. 38 is a block diagram showing the control of an LED array when a digitizer is used.

The analog coordinate data which is designated by a digitizer 531 is converted into the digital data by an A/D converter 532 as shown in FIG. 38. This digital data is inputted to a CPU 534 and calculated and also stored into a memory (RAM) 535. A signal processed by the CPU 534 is sent to a drive circuit 536, by which the flickering of an LED array 537 is controlled.

The lighting of the LED array is controlled by the timing when the position of the drum corresponding to $X_1$ reaches the LED array 504 and by the time when the drum position reaches from $X_1$ to $X_2$ with respect to the scanning direction of the original (X direction). The lighting of the LED array is controlled by the number of LEDs which are lit up with regard to the direction (Y direction) normal to the original scanning direction. Although the original position on the digitizer and the position of the original on the glass are opposite in the Y direction, the correcting process is also executed by the CPU 534.

An explanation will be further made with reference to FIG. 33. The photo sensitive drum 501 is uniformly charged by the charging device 502. The image of the original on the drum 501 is exposed by the exposure unit 503, so that the latent image is formed. The latent image in the non-designated area of the latent image is selectively erased by the LED array 537 as mentioned above. Thus, the electrostatic latent image is formed only in the area of the original which is designated by ($X_1$, $Y_1$) and ($X_2$, $Y_2$). The latent image in the designated area is developed by a red developing device 505. At this time, to prevent that it is developed in black, a black developing device 506 is arranged at a position sufficiently away from the drum 501 or the bias of a polarity such as to prevent the black toner from being adsorbed to the photo sensitive material is applied to the black developing device 506, thereby avoiding the development in black. The image visualized by the red toner is electrostatically transferred by a transfer charging device 507 onto a transfer material 509 which is conveyed through a paper feed guide 510. The transfer material 509 is then separated from the drum 501 by a separation discharging device 508 and is conveyed by conveying means 511. The image on the transfer material 509 is fixed by a fixing device 512. The fixed image is returned to the position near the paper feed guide 510 through a conveying path 514 for multi-copy by switching means 513.

After completion of the transfer separation, the residual toner on the drum 501 is removed by cleaning means 515. The potential on the drum is uniformed by a charge eraser lamp 516 and thereafter, the copy cycle to form the next black image is executed. In a manner similar to the preceding copy cycle, an electrostatic latent image corresponding to the light image 503 from the original is formed on the drum 501 which is uniformly charged by the charging device 502. However, in this case, the latent image in the area which was not erased by the previous cycle is erased by the LED array 504 (537) opposite to the latent image in the area which was erased by the previous cycle (in this case, the area to be erased and the area which is not erased may be newly designated at all).

The image data in the designated area which was obtained by the preceding cycle is stored in the memory (RAM) 535. The image data is read out from the memory 535 by the CPU 534 by the present cycle and calculated and the lighting timing and lighting number of LEDs of the LED array 537 are controlled in a manner such that LEDs which are lit up become substantially opposite to those in the preceding cycle.

The area which was not erased by the present cycle is developed by the black developing device 506. Therefore, the red developing device 505 is arranged at a position away from the drum 501 similarly to the black developing device 506 in the preceding cycle. Or, the bias of a level such that the development of red is not performed is applied with the red development device 505 come into contact with the drum 501. The copy paper developed by the red toner by the preceding cycle is fed by a registration roller 517 at a proper timing based on the image position on the drum. The image visualized by the black toner is electrostatically transferred onto this copy paper by the transfer charging device 507. The paper is then separated from the drum 501 by the separation discharging device 508 and conveyed by the conveying means 511. The image is then fixed by the fixing device 512. Thereafter, the paper is ejected out by the switching means 513, so that the double-color copy is automatically obtained.

Figure 39:
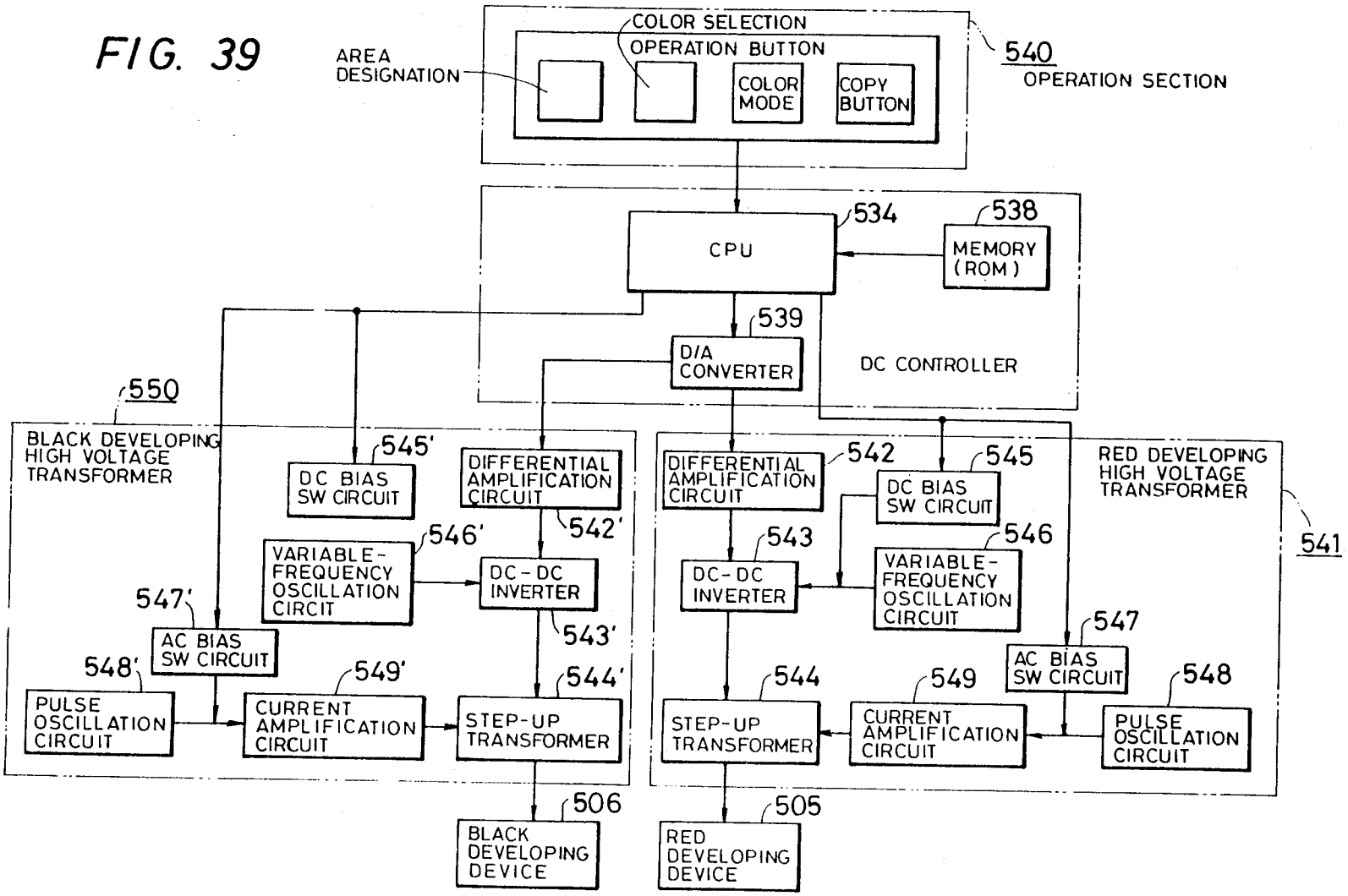
FIG. 39 is a block diagram for explaining the operations of developing devices.

The operation of the developing device when the double-color copy is automatically obtained will then be described on the basis of FIG. 39.

In general, in the case of using multi-color developing devices, there is used a mechanical method whereby the developing devices which are not used are separated apart from the photo sensitive drum by using a plunger or an eccentric cam or the like, or whereby the heads of the developing agent on the developing cylinder are cut, or the like.

On the other hand, in the jumping development, the developing agent is not come into contact with the photo sensitive drum; therefore, this method is advantageous in terms of prevention of color mixture as compared with the magnetic brushes of two components. There is also a case where it is sufficient to use only the developing bias. It will be apparently understood that even in this case, the color mixture can be further certainly prevented by using the mechanical color mixture preventing means for the developing devices which are not used.

When the area designation, color selection, and color mode are selected by operation buttons in an operation section 540 and then the copy button is pressed, the apparatus is made operative in the automatic double-color copy mode by the CPU 534.

An explanation will then be made with respect to the operation in the case of applying an output of a red developing high-voltage transformer 541 to the red developing device 505 when the area correspoding to one color is copied in red.

A set value of a concentration control volume (not shown) is inputted to the CPU 534 and calculated, so that a DC vias control signal is inputted to the transformer 541 through a D/A converter 539. This control signal is inputted to a differential amplification circuit 542 and then inputted to a DC-DC inverter 543. A signal from a variable-frequency oscillation circuit 546 is inputted to the inverter 543. A pulse current which is generated from a pulse oscillation circuit 548 is amplified by an current amplification circuit 549 and then increased by a step-up transformer 544. An output of the inverter 543 is added to the AD component increased by the step-up transformer 544. An output of the transformer 544 is applied to the red developing device 505. In this case, a DC bias switching circuit 545 and an AC bias switching circuit 547 for the transformer 541 perform the switching operations so as to generate DC and AC high voltages.

On the other hand, in a black developing high-voltage transformer 550, an AC output is cut off by a signal from the CPU 534 and only a DC high-voltage output is in the ON state by a DC bias switching circuit 545' and controlled to a voltage such that the black toner from the black developing device 506 is not deposited onto the drum.

An explanation will then be made with respect to the black copy program of the second color stored in a ROM 358. In this case, quite opposite to the case of the red copy, the DC and AC components of the black developing high-voltage transformer 550 become the ON state in a manner similar to the case of the red development. On the contrary, in the red development high-voltage transformer 541, the AC high-voltage component is cut off and the DC high-voltage component is controlled to a voltage such that the red toner from the red developing device is not deposited onto the drum.

The case where two red and black developing high-voltage transformers were used has been described above. Howevder, if the development characteristics of red and black are similar, it is also possible to commonly use the high-voltage transformer of a single color in combination of the contact and removal of the developing devices. Or, the transformer for the AC high-voltage component can be commonly used and the DC high-voltage transformers can be also separately provided.

Although the digitizer was used as the method of area designation in the embodiments, the invention is not limited to this method but may use a method whereby the coordinates of the original are read and inputted with the keys.

Figure 40:
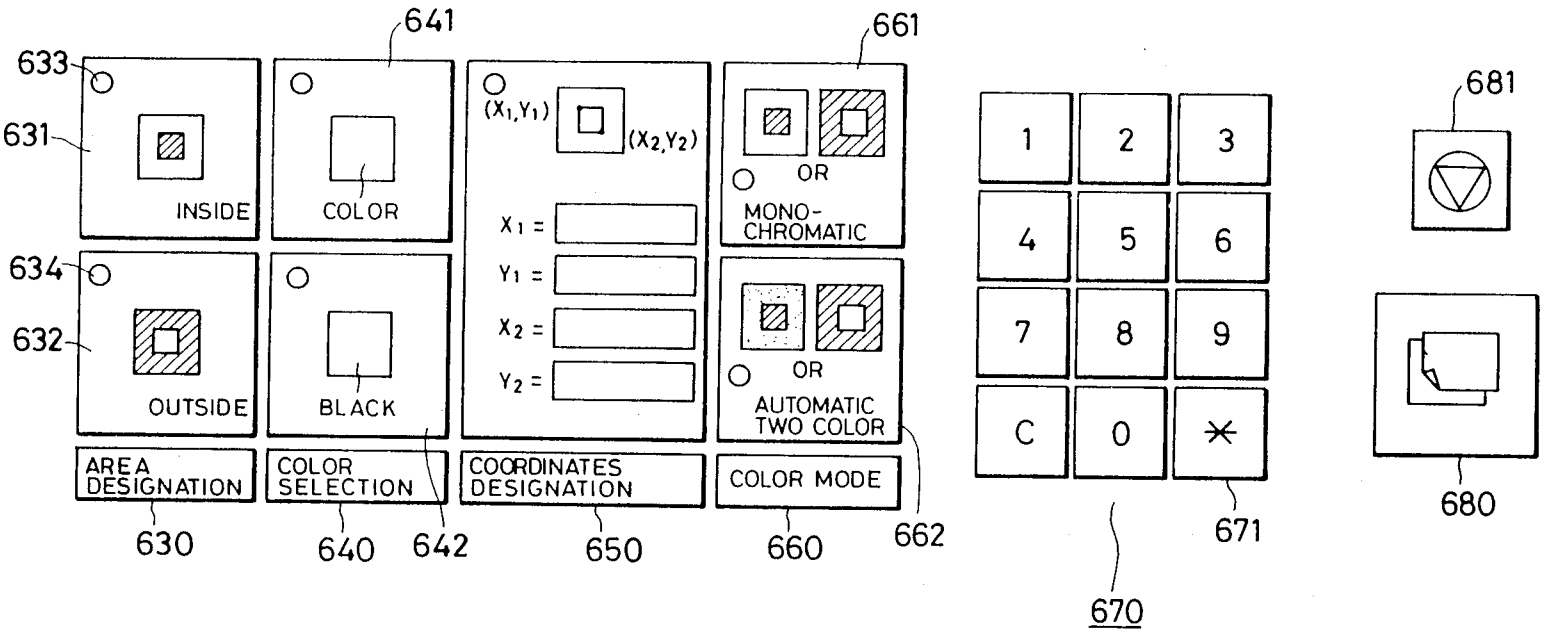
FIG. 40 is a diagram showing an operating section to designate areas due to the key input.

An operating method in the case of the automatic double-color copy of area designation by way of the key input will then be described with reference to FIG. 40.

First, the copy of the area inside (631) of the designated area of the copy or the area outside (632) of the designated area is designated by pressing an area designation key 630. LEDs 633 and 634 indicate the mode selected. Next, the color of the designated area is selected by pressing a color selection key 640. For example, in the case of copying the area inside of the designated area in color, the inside 631 is selected by the area designation key 630 and a color 641 is selected by the color selection key 640. Next, the coordinates of the designated area are designated by inputting two points on a diagonal line of the rectangular area using a ten-key 670. Namely, an input key 671 is pressed and the coordinates ($X_1$, $Y_1$) and ($X_2$, $Y_2$) are inputted. The input of the coordinates are ended by pressing the input key 671 after the respective coordinates were inputted. This input operation is executed independently of the setting of a copy quantity. For example, when $X_1=10$, $Y_1=5$, $X_2=20$, and $Y_2=15$, The keys are inputted as follows.

[*] [1] [0] [*] [5] [*] [2] [0] [*] [1] [5] [*]

Next, a selection is made between the two cases (661) and (662). Namely, in the case (661), only the area which is designated by a color mode key 660 is copied in a single color selected. In the other case (662), the designated area is copied in a single color selected and then the other areas are copied in another color (e.g., black) which is not selected; namely, the automatic double-color copy is executed.

In this manner, it is sufficient to press a copy start key 680 after the area designation, color selection, coordinate designation, and color mode were selected.

Another method can be considered whereby the color mode selection button 660 is not provided but respective display panels 661 and 662 are used as the copy keys upon color copy.

Although only a single area of a rectangular shape was designated in the embodiments, two or more areas or an area of a complicated shape can be also designated if the digitizer, CPU, and memory have sufficient capacities.

In addition, although the black and color (e.g., red) developing devices were used in the embodiments, both color developing devices (e.g., red and green) may be obviously used. The invention can be also applied to the case of using two or more developing devices. Although the LED array was used as the charge erasure means, on one hand, other means such as a liquid crystal shutter array or the like can be also used.

Figure 41:
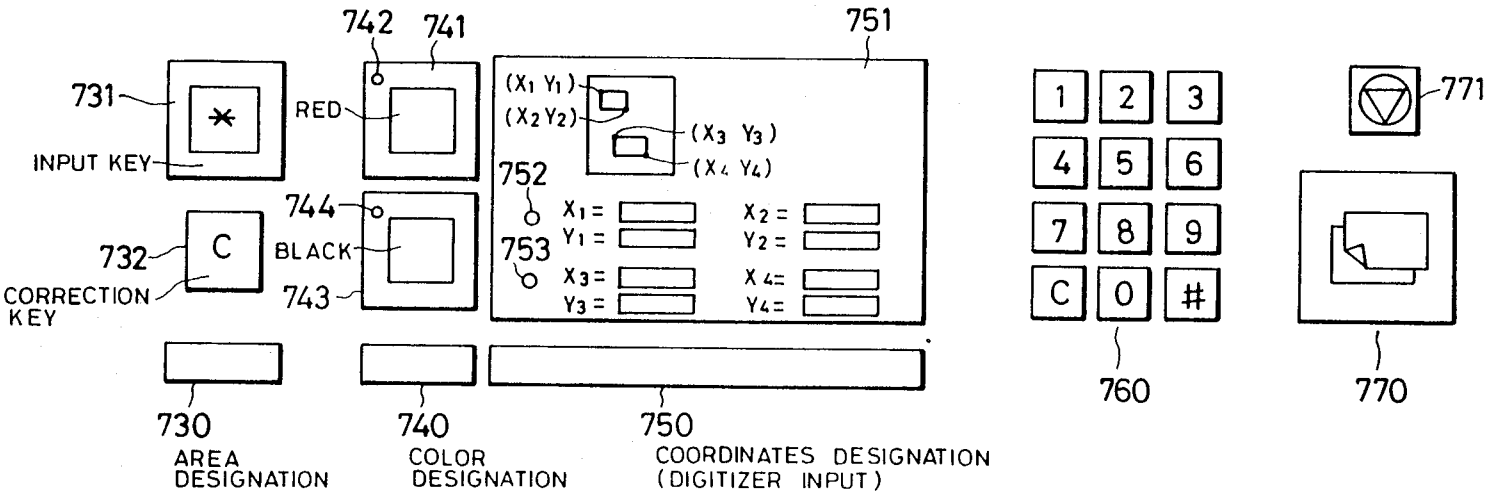
FIG. 41 is a diagram showing another embodiment of an operating section.

FIG. 41 is a diagram showing another embodiment of the present invention. In this embodiment, two different areas can be designated and these areas can be copied in different colors.

FIG. 41 shows an embodiment of the operation panel.

The operation panel fundamentally has an area designation key 730, a color designation key 740, and a coordinate designation key 750. Since this embodiment relates to a multi-color copying apparatus of two colors, e.g., red and black, the color designation key 740 includes a red designation key 741 and a black designation key 743.

The operation method of the automatic double-color copy of area designation by way of the key input will then be described with reference to FIG. 41. First, to designate the area, an input key 731 of the area designation key 730 is pressed to set the area designation mode. Next, to select the color of the designated area, the color designation key 741 or 743 of the color designation key 740 is pressed.

The red designation key 741 is pressed to copy the area which is designated by $(X_1, Y_1)$ and $(X_2, Y_2)$ in red. Pressing the key 741 allows a display LED 742 to be lit up. At the same time, an LED 752 corresponding to the position of $(X_1, Y_1)$ and $(X_2, Y_2)$ of a coordinate designation panel 751 is lit up, thereby instructing the input of the coordinates. At this time, by inputting the coordinates by the digitizer on the original pressing plate 520, the values of the coordinates are displayed on the panel 751.

Subsequently, to copy the area which is designated by $(X_3, Y_3)$ and $X_4, Y_4)$ in black, the area designation key 730 is pressed and the black designation key 743 of the color designation button is pressed. After confirming that an LED 744 was lit up and an LED 753 of the coordinate designation display panel 751 was lit up, the coordinates of $(X_3, Y_3)$ and $(X_4, Y_4)$ are inputted by the digitizer. Thus, the respective coordinates ae displayed on the panel 751.

Next, by pressing an input key 731, the end of input is informed.

After the original was set onto the original glass plate 523, the copy quantity is set by a key 760 and a copy button 770 is pressed in a manner similar to the ordinary copy, so that the copy operation is started.

The coordinates designated by the digitizer in accordance with the above-mentioned method are stored into the RAM 535.

When the latent image is formed on the photo sensitive drum, only the area designated by $(X_1, Y_1)$ and $(X_2, Y_2)$ of the original is developed by the red developing device 505 similarly to the copy of the first color in the foregoing embodiment. At this time, the black developing device 506 is controlled in a manner similar to the foregoing embodiment.

The developed image is transferred onto the transfer paper similarly to the foregoing embodiment and the copy cycle of the second color is executed.

Similarly to the preceding cycle, an electrostatic latent image corresponding to the light image 503 from the original is formed on the drum 501 which was uniformly charged by the charging device 502. However, in this case, the LED array 504 erases the latent image of the area excluding the area which is designated by $(X_3, Y_3)$ and $(X_4, Y_4)$ for the black copy.

The image data of the designated area is stored in the memory (RAM) 535. This data is read out from the memory (RAM) 535 by the CPU 534 in the copy cycle and calculated. The lighting timing and number of lighting LEDs of the LED array 504 are controlled in a manner such that the LED corrsponding to the positions of $(X_3, Y_3)$ and $(X_4, Y_4)$ are lit up.

Since the image of the area which is designated by $(X_3, Y_3)$ and $(X_4, Y_4)$ by the present copy cycle is developed by the black developing device 506, the red developing device 505 is separated at a position which is sufficiently away from the drum 501 or the bias voltage of a polarity such that the red toner is not deposited onto the photosensitive material is applied with the red developing device 505 come into contact with the drum in a manner similar to the black developing device 506 in the preceding cycle. The image visualized by the black toner is copied at the timing basedon the image position of the drum and the transfer paper is then ejected out of the apparatus by the registration roller 517 similarly to the foregoing embodiment.

Due to the above-mentioned copy operation, the double-color copy in which two designated areas were developed in different colors is automatically obtained.

Although the double-color copy due to the multi-copy has been shown as an example in the embodiment, in the case of obtaining the copy in which the designated areas on both sides of the copy paper are copied in different colors, the two-sided copy mode is set. In this case, it is sufficient to reverse the front and back sides of the copy paper by the foregoing method before the copy of the first color is fixed and returned to the paper feed port.

Although the double-color copy has been shown in the above embodiment, in the case of the copy of three or more colors as well, a multi-color copy can be obtained by preparing a plurality of developing devices and repeating the copy cycle similar to the above embodiment.

The present invention can be also applied to a digital copying apparatus which photoelectrically reads the original and processes an image signal as a digital signal. In this case, it is enough to output only the image signal corresponding to the designated area to the printer side.

The present invention is not limited to the foregoing embodiments but many modifications and variations are possible within the spirit and scope of the appended claims of the invention.

What is claimed is:

1. An image processing apparatus comprising:

first area designating means for designating an arbitrary area of an original, said first area designating means including a first designating system;

second area designating means for designating an arbitrary area of an original, said second area designating means including a second designating system, wherein the first designating system is different from the second designating system;

memory means for storing data representative of an area designated by said first area designating means and data representative of an area designated by said second designating means;

wherein data stored in said memory means in response to actuation of one of said first and second area designating means is modifiable by the other of said first and second area designating means.

2. An image processing apparatus according to claim 1, further comprising scanning means for scanning said original.

3. An image processing apparatus according to claim 2, further comprising processing means for processing images in said designated areas in a way which is different from a way in which an image outside said designated areas is processed.

4. An image processing apparatus according to claim 1, further comprising holding means for holding an original, wherein said first area designating means is coupled to said holding means.

5. An image processing apparatus according to claim 4, wherein said first area designating means includes a digitizer.

6. An image processing apparatus according to claim 1, wherein said second area designating means includes key input means.

7. An image processing apparatus according to claim 6, wherein said key input means includes numerical value input means.

8. An image processing apparatus according to claim 1, further comprising mode setting means for setting a mode for modifying said data stored in said memory.

9. An image processing apparatus according to claim 1, wherein said memory is operable to store a plurality of data of a plurality of areas.

10. An image processing apparatus according to claim 9, further comprising display means for displaying the number of designated areas.

11. An image processing apparatus according to claim 1, further comprising display means for displaying an area designated by said first area designating means or said second area designating means.

12. An image processing apparatus according to claim 11, wherein said display means numerically displays said area.

13. An image processing apparatus according to claim 11, wherein said display means graphically displays said area.

14. An image processing apparatus according to claim 1, further comprising display means for displaying a position of which said data representing said designated area is indicative.

15. An image processing apparatus according to claim 1, wherein said memory is operable to store a plurality of data of a plurality of areas, and further comprising selecting means for selecting an area data to be modified.

* * * * *